US005967582A

United States Patent [19]

Saito

[11] Patent Number: 5,967,582

[45] Date of Patent: Oct. 19, 1999

[54] HOISTING AND CLAMPING APPARATUS

[76] Inventor: Takeya Saito, 97 Aza-Gotan, Oaza-Oshikiri-shinden, Mikawa-machi, Higashitagawa-gun, Yamagata-ken, Japan

[21] Appl. No.: 08/881,135

[22] Filed: Jun. 24, 1997

[30] Foreign Application Priority Data

| | | | |
|---|---|---|---|
| Jun. 24, 1996 | [JP] | Japan | 8-199517 |
| May 9, 1997 | [JP] | Japan | 9-135952 |
| May 27, 1997 | [JP] | Japan | 9-152842 |

[51] Int. Cl.[6] ..... B66C 1/44

[52] U.S. Cl. ..... 294/110.1; 294/86.41; 294/902

[58] Field of Search ..... 294/67.31, 67.33, 294/86.4, 86.41, 103.1, 104, 106, 110.1, 110.2, 111, 112, 119.1, 902

[56] References Cited

U.S. PATENT DOCUMENTS

| | | | |
|---|---|---|---|
| 2,610,890 | 9/1952 | Jaeger | 294/110.1 |
| 3,488,080 | 1/1970 | Hamilton | 294/110.1 |
| 3,561,812 | 2/1971 | Dixon | 294/110.1 |
| 3,768,853 | 10/1973 | Rennie | 294/110.1 |
| 4,133,570 | 1/1979 | Hammink et al. | 294/110.1 |

FOREIGN PATENT DOCUMENTS 6-191786 7/1994 Japan .

*Primary Examiner*—Johnny D. Cherry
*Attorney, Agent, or Firm*—Flynn, Thiel, Boutell & Tanis, P.C.

[57] ABSTRACT

A hoisting and clamping apparatus for a heavy object. The apparatus includes a telescopic body positioned substantially perpendicularly to the ground, a first swing body positioned substantially in a horizontal direction, and a second swing body positioned substantially in a horizontal direction. A lower end of the telescopic body and inner ends of the swing bodies are coupled with one another to freely vertically swing by a turning shaft to form an inverted T-shape. Contact pressers are provided at each lower surface of the swing bodies, wherein the contact pressers are brought into contact with a heavy object at opposite sides thereof. The swing bodies are lifted in a substantially C-shape to bring the contact pressers into clamping contact with the sides of the heavy object.

15 Claims, 29 Drawing Sheets

HOISTING AND CLAMPING APPARATUS

FIELD OF THE INVENTION

The present invention relates to a hoisting and clamping apparatus which is suspended by a crane, etc. and capable of clamping and hoisting a heavy object, such as a concrete block, and of automatically releasing the clamping of the heavy object. The hoisting and clamping apparatus also can turn the clamped and hoisted heavy object in a horizontal direction, and can also hoist a heavy object with a displaced center of the gravity.

BACKGROUND OF THE INVENTION

An operation for hoisting and moving a heavy object such as a concrete block, etc. in a construction or building site has been conventionally frequently performed manually, i.e. by operators. However, various operation machines for clamping and hoisting a heavy object have been developed for saving time and labor and for preventing danger.

Many of these hoisting and clamping apparatuses are structured in that presser plates are brought into contact with both sides of a heavy object to thereby clamp the heavy object owing to friction generated between the heavy object and the presser plates. Such a hoisting and clamping apparatus is hoisted by a crane, etc. and it is moved to an intended spot while it clamps the heavy object. In the operation for clamping the heavy object by the hoisting and clamping apparatus, an operator is disposed in a position close to the heavy object in addition to an operator of the crane and the engagement or retention between the hoisting and clamping apparatus and heavy object must be set. Further, in installing the heavy object hoisted by the hoisting and clamping apparatus at an intended spot, to release the engagement or retention between the hoisting and clamping apparatus and heavy object, another operator must release such engagement. Under the circumstances, when the heavy object is hoisted and moved by this apparatus, the operator for operating the crane and another operator for setting and releasing the clamping of the heavy object at a position close to the heavy object are needed thereby costing personal expenses. Still further, another operator must work at a position close to the heavy object hoisted by the hoisting and clamping apparatus, which causes another operator to be involved in danger because there is a possibility that the heavy object falls due to the improper clamping of the heavy object.

As mentioned above, since the engagement or retention between the hoisting and clamping apparatus and heavy object are performed manually according to the conventional hoisting and clamping apparatus, this applies a heavy burden to the operators at a working site. Accordingly, there is developed a hoisting and clamping apparatus which automatically performs the engagement or releasing of the engagement between the hoisting and clamping apparatus and the heavy object by vertically moving a wire or chain suspended by a crane. For example, such hoisting and clamping apparatus is disclosed in JP-A 6-191786. This hoisting and clamping apparatus comprises double extendible cylinders wherein an inclined plate is fixed inside an upper cylinder and a T-shaped rod protrudes in a lower cylinder. In this structure, the rod is alternately retained by the inclined plate at two parts thereof and a wire of the crane is vertically moved to change the lengths of the double cylinders, thereby alternately performing a clamping or releasing operation.

In this hoisting and clamping apparatus, since the amount of opening of an arm is determined by a rate of expansion of a pantograph and a cam shape, the amount of movement of the arm is not constant because of dispersion of the length of the heavy object to be clamped so that the heavy object cannot be clamped with assurance. Further, although the clamping of the heavy object can be automatically performed, the arm is liable to be transformed when the load of the heavy object is applied to the arm because the heavy object is clamped by the right and left pantographs, and hence such a hoisting and clamping apparatus cannot be used for a long period of time.

The hoisting and clamping apparatus for clamping the heavy object can be moved to an intended spot by a crane. However, there are many cases in practical construction or building sites that the suspended heavy object must be turned in accordance with the site where the heavy object is arranged. For example, in the operation for constructing a side ditch, the axial direction of a block for use in U-shaped ditch (hereinafter referred to as U-shaped ditching block) is conformed to the longitudinal direction of the ditch so as to arrange the U-shaped ditching block. However, in the conventional hoisting and clamping apparatus, the axial direction of the suspended U-shaped ditching block (heavy object) cannot be turned, and hence the suspended U-shaped ditching block is turned by an operator manually so as to conform the direction of the side ditch to that of the U-shaped ditching block. In the conventional hoisting and clamping apparatus, the hoisting by clamping the heavy object and the releasing of the clamping of the heavy object from the hoisting and clamping apparatus are automatically performed by a crane, leading to the requirement of another operator for turning of the axial direction of the heavy object, which does not save time and labor. Further, since another operator is disposed in a position close to the heavy object, there is a likelihood of risk of injuries to persons owing to the falling of the heavy object.

Still further, a specific block for use in revetment and walls of buildings as a transformed concrete block (hereinafter referred to as simply block) has been widely used recently. This block has such a shape that the position where the presser plates of the hoisting and clamping apparatus contact the heavy object and the center of gravity thereof are not accorded with each other in the same axial line, and hence the center of gravity is displaced from the physical center of the block. When such a block is clamped and hoisted by conventional hoisting and clamping apparatus, the clamping position and the center of gravity are not accorded with each other, and hence the block has not been clamped properly.

SUMMARY OF THE INVENTION

It is an object of the invention to provide a hoisting and clamping apparatus capable of clamping and hoisting a heavy object such as a concrete block, etc. and of automatically permitting contact pressers provided on right and left swing bodies to contact both sides of the heavy object and of permitting the contact pressers to release the heavy object by vertically moving the hoisting and clamping apparatus by a crane. In a variation of the invention, the hoisting and clamping apparatus and heavy object can be turned in a horizontal direction by a turning driving body in a state where the heavy object is hoisted, and only an operator on the crane can hoist, move and conform the direction of the heavy object and that of the spot where the heavy object is installed, and can conform the longitudinal direction of the hoisting and clamping apparatus to that of the heavy object. With such an operation, a number of operators can be reduced to save time and labor. In a further variation for a heavy object such as the block with a displaced center of gravity, contact pressers are brought into contact with the heavy object in three directions so as to stably clamp and hoist the heavy object.

To achieve the above objects, a hoisting and clamping apparatus according to one aspect of the invention comprises a telescopic body which is positioned substantially perpendicularly to the ground, a first swing body which is positioned substantially in a horizontal direction, and a second swing body which is positioned substantially in another horizontal direction, and wherein a lower end of the telescopic body and tip end of the swing bodies are coupled with one another to be freely vertically turned by a turning shaft to form an inverted T-shape. Contact pressers are provided at each lower surface of the swing bodies, wherein the contact pressers are brought into contact with a heavy object at right and left sides thereof, and wherein the swing bodies coupled to the lower end of the telescopic body are lifted in substantially C-shape so as to bring the contact pressers into contact with the right and left sides of the heavy object to effect clamping and hoisting of the heavy object. The telescopic body can be extended or contracted in a longitudinal direction thereof, and can be stopped at a position where it is extended or at a position where it is contracted. A closable restriction mechanism is provided at one swing body for restricting the swing bodies from turning (i.e. swinging) downward about the turning shaft. The closable restriction mechanism is interlocked and synchronized with telescopic operation of the telescopic body to alternately restrict the closing or opening operation of the swing bodies so as to alternately clamp or release the heavy object.

According to the present invention, when the hoisting and clamping apparatus is suspended by a chain hung by a crane, etc., and the swing bodies under the hoisting and clamping apparatus are brought into contact with an upper surface of a heavy object while the swing bodies remain extended to the right and left, then the contact pressers are brought into position adjacent both sides of the heavy object. The swing bodies are then lifted upward substantially in a C-shape to form a link mechanism so as to permit the contact pressers to contact the heavy object with strong force, and hence the heavy object is clamped and hoisted. Further, since the hoisted heavy object can be turned in a horizontal direction by a turning driving device, the longitudinal direction of the heavy object is turned in accordance with the direction where the heavy object is installed. Further, the clamping of the heavy object and the releasing of such clamping can be performed by the telescopic body which is telescopically movable and the closable restriction mechanism which is interlocked with the operation of the telescopic body. Accordingly, the clamping of the heavy object and the releasing of such clamping are automatically performed by vertically moving a chain hung by a crane, which dispenses with another operator for clamping and releasing the clamping at a position close to the heavy object so that the above operations can be performed by the crane operator.

According to another aspect of the present invention, the hoisting and clamping apparatus comprises a pair of swing bodies and an auxiliary swing body which are disposed horizontally in a T-shape and contact pressers are provided at outer ends of each of the swing bodies, whereby the heavy object can be retained by contact pressers at the sides thereof in three directions. When these swing bodies are lifted by the telescopic body, the swing bodies and auxiliary body can be lifted in a C-shape to form a link mechanism to generate component force, so that each of the contact pressers can be brought into contact with the heavy object with strong force. In such a manner, since the heavy object can be clamped by the contact pressers from three directions, the heavy object can be securely retained by the hoisting and clamping apparatus even when operation for clamping and hoisting the heavy object which is displaced in the center of gravity is displaced relative to the alignment between the pair of swing bodies. And the turning of each swing body can be automatically performed by the operator at the crane and the hoisted heavy object can be turned horizontally by the turning driving body.

BRIEF DESCRIPTION OF THE DRAWINGS

FIGS. 1 to 13 are views of a hoisting and clamping apparatus according to a first embodiment of the invention, wherein FIG. 1 is a perspective view of a first embodiment of the hoisting and clamping apparatus as viewed from an opening adjusting side thereof;

FIG. 2 is a perspective view of the hoisting and clamping apparatus as viewed from a closing adjusting side thereof;

FIG. 3 is an exploded perspective view showing the components constituting the hoisting and clamping apparatus in a separated condition;

FIG. 4 is an enlarged exploded perspective view showing that the closing adjusting part;

FIG. 5 is an exploded perspective view showing the components constituting the telescopic body;

FIG. 6 is an exploded perspective view showing a position stopping mechanism provided in the telescopic body;

FIG. 7 is a plan view of a cam surface shape of a cam plate constituting the position stopping mechanism;

FIG. 8 is a perspective view for explaining an operation of hoisting a heavy object W before the heavy object W is hoisted;

FIG. 9 is a side view for explaining an operation of hoisting a heavy object W before the heavy object W is hoisted;

FIG. 10 is a perspective view for explaining an operation of hoisting a heavy object W after the heavy object W is hoisted;

FIG. 11 is a side view for explaining an operation of hoisting a heavy object W after the heavy object W is hoisted;

FIG. 12 is a perspective view showing a state where right and left rail arms are restricted to turn by the telescopic body; and FIG. 13 is a perspective view showing a state where right and left rail arms are released from the restriction of turning by the telescopic body.

FIGS. 14–26 are views of a second embodiment of the invention wherein:

FIG. 14 is a perspective view of the second embodiment of the hoisting and clamping apparatus as viewed from the opening adjusting side thereof;

FIG. 15 is a perspective view of the hoisting and clamping apparatus as viewed from the closing adjusting side thereof;

FIG. 16 is an exploded perspective view showing the components constituting the entire hoisting and clamping apparatus;

FIG. 17 is a side view of a turning driving body a side part of which is partially cut away;

FIG. 18 is a top view of the turning driving body, an upper part of which is partially cut away;

FIG. 19 is an end view of the turning driving body, a side part of which is partially cut away and which is viewed from line I—I in FIG. 18;

FIG. 20 is an exploded perspective view of the turning driving body showing the components thereof;

FIG. 21 is an exploded perspective view of parts of the turning driving body;

FIG. 22 is an electric circuit diagram for controlling the turning driving body;

FIG. 23 is a perspective view of the hoisting and clamping apparatus for explaining a hoisting operation before hoisting a heavy object W;

FIG. 24 is a side view of the hoisting and clamping apparatus for explaining a hoisting operation before hoisting a heavy object W;

FIG. 25 is a perspective view of the hoisting and clamping apparatus for explaining a hoisting operation after hoisting a heavy object W; and FIG. 26 is a side view of the hoisting and clamping apparatus for explaining a hoisting operation after hoisting a heavy object W.

FIGS. 27–29 are views of a third embodiment of the invention, wherein:

FIG. 27 is a perspective view of a hoisting and clamping apparatus according to the third embodiment of the invention as viewed from an opening adjusting side thereof;

FIG. 28 is an exploded perspective view of the hoisting and clamping apparatus of FIG. 27 and showing the components thereof; and FIG. 29 is a perspective view of the hoisting and clamping apparatus in FIG. 27 for explaining an operation of hoisting a block.

DETAILED DESCRIPTION

A hoisting and clamping apparatus according to a first embodiment of the invention will be now described in detail with reference to FIGS. 1 to 13.

Figure 1:
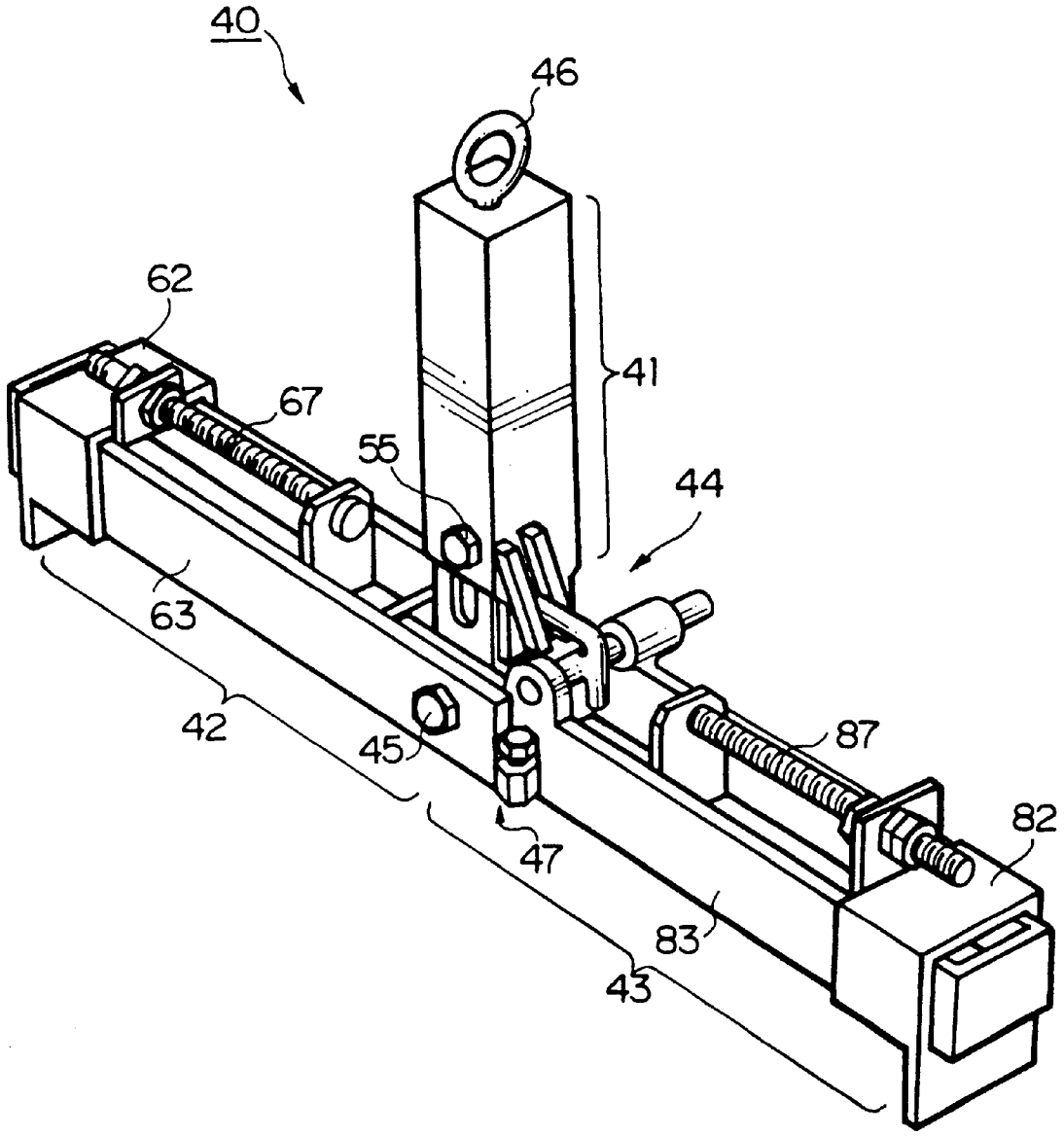
Figure 2:
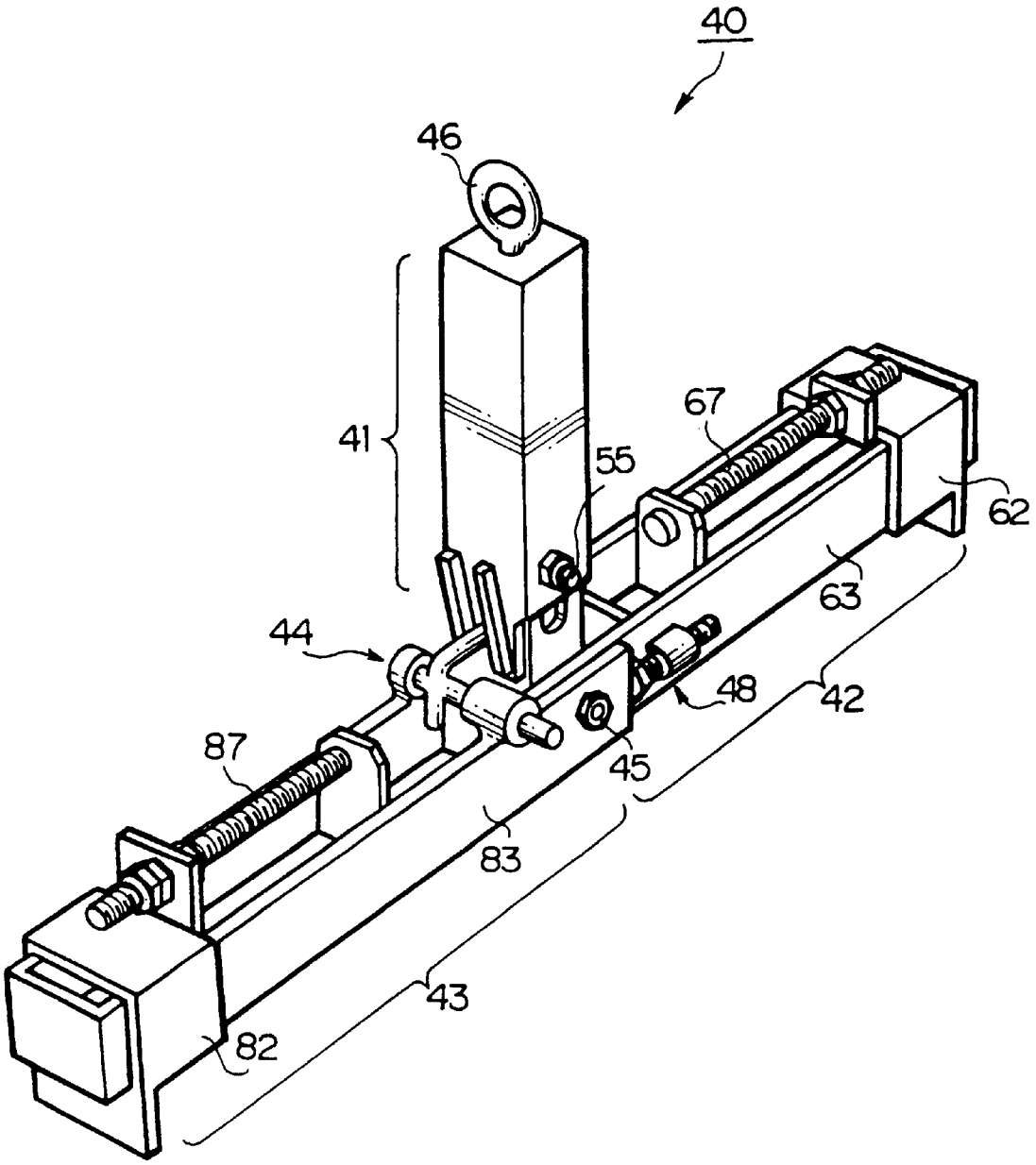

FIG. 1 is a view of a hoisting and clamping apparatus 40 which is viewed from a right upper slanting direction, and FIG. 2 is a view of the same which is viewed from a left upper slanting direction at the opposite side of FIG. 1.

The hoisting and clamping apparatus 40 comprises a telescopic body 41, a left swing body 42 as one swing body and a right swing body 43 as another swing body. The telescopic body 41, left swing body 42 and right swing body 43 are integrated and assembled with one another to constitute the hoisting and clamping apparatus 40. The telescopic body 41 is telescopically movable, namely, it can be extended and contracted vertically and the entire length thereof can be automatically adjusted with a click stop function. The telescopic body 41 has a long tubular shape. The left swing body 42 has a long frame shape which is opened at both ends in the longitudinal direction thereof and has two side walls which are parallel with each other. A slide body 62 is movable along the longitudinal direction of the left swing body 42 and it is inserted into the left swing body 42. The right swing body 43 has a symmetrical shape with respect to the left swing body 42. The right swing body 43 has a long frame shape which is opened at both ends in the longitudinal direction thereof and has two side walls which are parallel with each other. A slide body 82 is movable along the longitudinal direction of the right swing body 43 and it is inserted into the right swing body 43. The lower portion of the telescopic body 41, the tip end of the left swing body 42 (right front end in FIG. 1 and left front end in FIG. 2), and the tip end of the right swing body 43 (left front end in FIG. 1 and right front end in FIG. 2) are respectively meshed or jointed with one another, and a through pin 45 is inserted as a turning shaft into holes defined in each side wall of these overlapped members whereby these members are engaged or jointed with one another. The telescopic body 41, left swing body 42 and right swing body 43 are assembled in an inverted T shape as shown in FIGS. 1 and 2, and these members can turn about the through pin 45. A ring-shaped hoisting ring 46 is fixed to an upper end of the telescopic body 41 by welding, etc. and to which a wire or chain of a crane is hooked for hoisting the entire hoisting and clamping apparatus 40.

An opening adjusting part 47 is provided at the portion close to the tip end of the left swing body 42 as shown in FIG. 1, and a closable restriction mechanism 44 is provided at the upper portion of the tip end of the right swing body 43. When the closable restriction mechanism 44 and the opening adjusting part 47 cooperate with each other, an opening angle (i.e., the angle between the left swing body 42 and right swing body 43 at which angle they are lifted upward as if wings are spread) is fixed or released when the left swing body 42 and right swing body 43 perform opening or closing operation about the through pin 45. The closable restriction mechanism 44 is interlocked with the telescopic operation of the telescopic body 41 and can perform a switching operation for engaging with or disengaging from the opening adjusting part 47. As shown in FIG. 2, a closing adjusting part 48 is provided at the portion adjacent to the tip end of the left swing body 42. The tip end of the closing adjusting part 48 can move toward or away from the front surface (right front end in FIG. 2) of the tip end of the right swing body 43, and it can restrict the closing angle (angle between the left swing body 42 and right swing body 43 at which angle they hang downward) when the left swing body 42 and right swing body 43 open or close about the through pin 45. These operations are described hereinafter.

Figure 3:
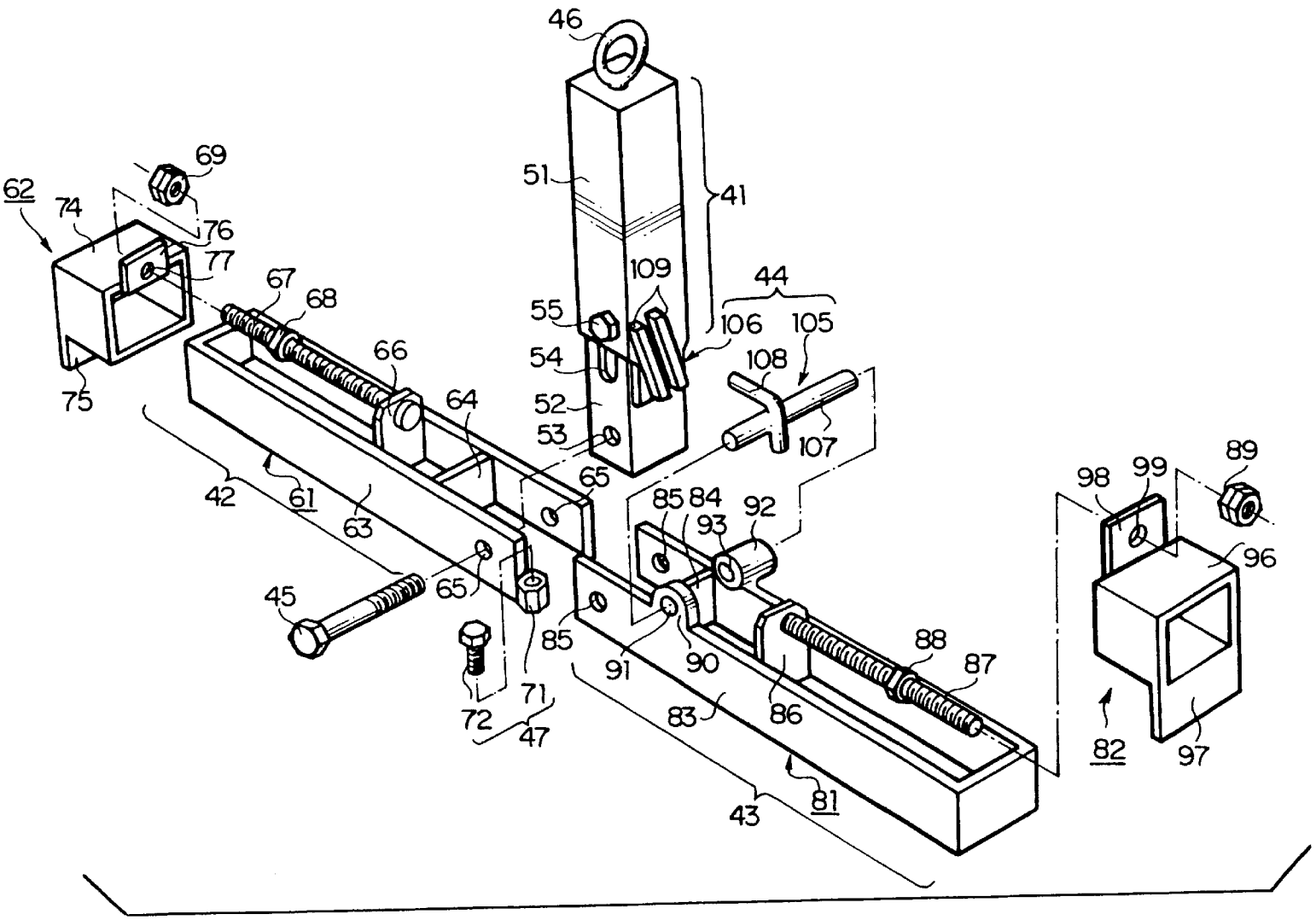

FIG. 3 is an exploded view of the hoisting and clamping apparatus 40 and it is viewed from the right upper slanting direction in the same manner as FIG. 1.

The telescopic body 41 comprises an outer cylinder 51 as an upper telescopic body and inner cylinder 52 as a lower telescopic body wherein the outer cylinder 51 is formed of a square pipe which is hollow at the inside thereof and is closed at the upper end thereof and has a square shape in cross section. The hoisting ring 46 is fixed to the upper end of the outer cylinder 51. The inner cylinder 52 is formed of a square pipe which is hollow at the inside thereof and is opened at both ends thereof and has a square shape in cross section. The outer dimensions of the inner cylinder 52 are less than the inner dimensions of the outer cylinder 51, and the upper end of the inner cylinder 52 is slidably inserted from the lower end opening of the outer cylinder 51 to the inside of the outer cylinder 51. Pin holes 53 are defined in both sides of the inner cylinder 52 at the lower portion thereof, and vertically long slots 54 are defined in both sides of the inner cylinder 52 at the central portion thereof. When the outer cylinder 51 and the inner cylinder 52 are assembled, a bolt 55 as a coupling pin is inserted from one side of the outer cylinder 51 at the lower portion thereof, and the bolt 55 is inserted into the long slots 54 of the inner cylinder 52 so that the inner cylinder 52 is vertically slidable relative to the outer cylinder 51 in the longitudinal direction thereof. A slide operation body 106 is provided on one side of the outer cylinder 51 at the position perpendicular to the side where the bolt 55 is inserted. The slide operation body 106 comprises a pair of aslant rails 109 each formed of long metal pieces, wherein the aslant rails 109 are arranged in parallel with each other at a given interval, and they are arranged aslant in the manner that the longitudinal direction of each aslant rail 109 forms a small angle relative to the longitudinal direction of the outer cylinder 51.

The left swing body 42 comprises an arm body 61 and a slide body 62, and the arm body 61 comprises a rail arm 63, a reinforcing plate 64, a bolt fixing plate 66, a long bolt 67, etc.

The rail arm 63 is formed by bending a long sheet steel in substantially U shape, and the opposite side walls are arranged to be in parallel with each other at a given spacing. The reinforcing plate 64 is fixed to both inner surfaces of the side walls to extend thereover in a position close to the opened U-shaped side walls. Accordingly, the arm body 61 is closed in the U shape by the rail arm 63 and the reinforcing plate 64 to structure the long frame shape which is opened vertically. The bolt fixing plate 66 protrudes upward from the rail arm 63 at the central portion of the rail arm 63 so as to bridge the inner surfaces of both side walls. The bolt fixing plate 66 is formed of a thin steel, and the upper half thereof is exposed from the upper surface of the rail arm 63 while the head of the long bolt 67 is fixed to the bolt fixing plate 66. The long bolt 67 is in parallel with the rail arm 63 in the longitudinal direction, and the screw portion of the long bolt 67 is directed to the rear portion of the rail arm 63 (innermost leftward in FIG. 3). A nut 68 is screwed onto the long bolt 67 to move in the longitudinal direction of the long bolt 67 when it is rotated.

The slide body 62 is inserted onto the arm body 61, and is freely movable in the longitudinal direction thereof. The slide body 62 is mainly formed of a slide frame 74 which has a square shape in cross section, and the inner opening of the slide frame 74 is slightly larger than the outer dimensions of the rail arm 63 so that the opening of the slide frame 74 can be inserted from the rear end of the rail arm 63 (innermost left side in FIG. 3). A contact presser 75 is fixed to the rear end of the slide frame 74 at the lower surface (innermost left side in FIG. 3) in the manner of protruding downward, and the side surface of the contact presser 75 is arranged to be perpendicular to the longitudinal direction of the slide frame 74. A positioning plate 76 formed of a thin sheet steel is vertically fixed to the slide frame 74 at the upper front side (right front side in FIG. 3). An insertion hole 77 is defined in the positioning plate 76 at the upper portion thereof. The long bolt 67 is inserted onto the insertion hole 77 from the tip end thereof, and a double nut 69 is screwed onto the long bolt 67 from the tip end thereof while the nut 68 and the double nut 69 fasten the positioning plate 76 therebetween so as to fix the slide body 62 to the arm body 61. A pair of pin holes 65 are defined in both sides of the rail arm 63 at the tip end thereof (right side in FIG. 3) while the axis thereof is perpendicular to the longitudinal direction of the rail arm 63.

The opening adjusting part 47 comprises a fixing nut 71 and an adjusting bolt 72. The fixing nut 71 is fixed to the vertical edge of the rail arm 63 at one end (right front side in FIG. 3) by welding, etc. The fixing nut 71 has an opening which forms a screw hole at the center thereof, and the axis thereof is arranged perpendicular to the longitudinal direction of the rail arm 63. The adjusting bolt 72 is screwed into the opening of the fixing nut 71 from the upper portion thereof. The lengthwise position of the head of the adjusting bolt 72 can be adjusted depending on a screwing length of the adjusting bolt 72.

The right swing body 43 is formed substantially symmetrical with respect to the left swing body 42, and it comprises an arm body 81 and a slide body 82. The arm body 81 comprises a rail arm 83, a reinforcing plate 84, a bolt fixing plate 86, a long bolt 87, etc.

Since these components of the right swing body 43 have the same structures and functions as those of the left swing body 42, the structures and functions thereof are omitted.

The closable restriction mechanism 44 comprises the slide operation body 106 and a lateral slide body 105, wherein they can have one function when they are engaged with each other. The slide operation body 106 is fixed to the outer cylinder 51 as mentioned above, but the lateral slide body 105 is disposed on the rail arm 83.

A shaft-protrusion 90 which is semicircularly protruded from the rail arm 83 is formed at the tip end of the rail arm 83 (innermost left side in FIG. 3) and at one upper edge of one side of the rail arm 83, and a shaft hole 91 is defined in the shaft protrusion 90. A shaft bearing 92, which is formed by cutting a round pipe, is fixed to the rail arm 83 at the tip end of the rail arm 83 (innermost left side in FIG. 3) and at the other upper edge of one side of the rail arm 83. A shaft hole 93 is defined in the center of the shaft pipe 92. The axis of the shaft hole 91 conforms to that of the shaft hole 93 so as to be in line with each other, and the axes thereof are arranged to be perpendicular to the longitudinal direction of the rail arm 83.

The lateral slide body 105 is freely movably inserted into the shaft holes 91 and 93. The lateral slide body 105 comprises a long slide shaft 107 and a retaining claw 108 which is fixed to the slide shaft 107 at substantially a central part thereof. The retaining claw 108 is formed by bending a round rod at the center thereof at right angles so as to form an L shape, wherein one side of the L shape is fixed to the central part of the slide shaft 107 so as to cross at a right angle therewith. One end of the slide shaft 107 is inserted into the shaft hole 91 and the other end thereof is inserted into the shaft hole 93 so that the lateral slide body 105 is freely movably retained by the rail arm 83 in the direction perpendicular to the longitudinal direction of the rail arm 83. At this time, the retaining claw or finger 108 fixed to the slide shaft 107 is positioned and movable between the shaft protrusion 90 and shaft pipe 92. The axis of the retaining claw 108 is directed perpendicularly to the axis of the slide shaft 107, and the tip end of the retaining claw 108 which is bent in L-shape is engaged in the space or slot between the pair of aslant rails 109.

Figure 4:
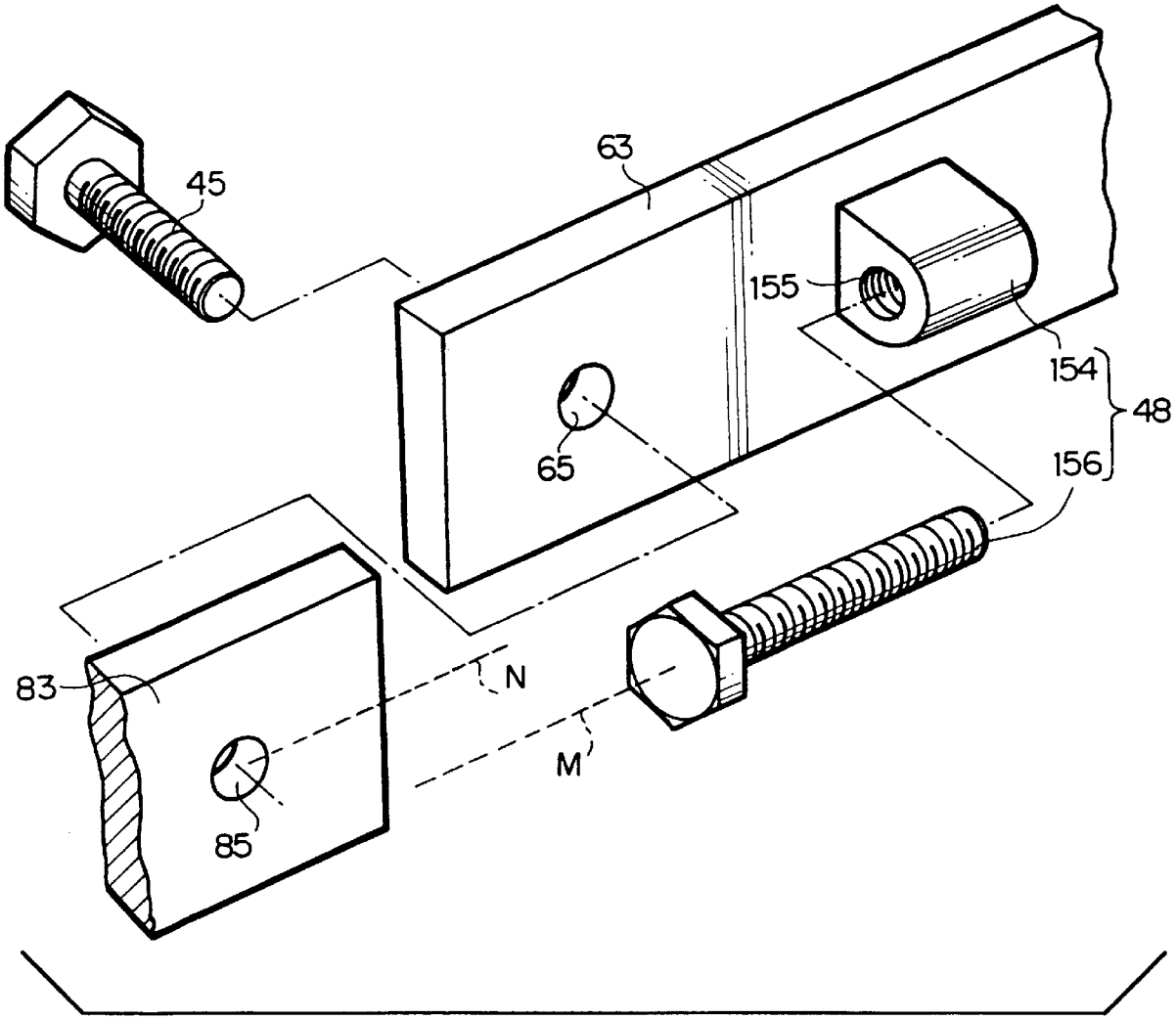

FIG. 4 explains the closing adjusting part 48 which includes a positioning adjusting body 154 fixed to one side of the rail arm 63 at the portion close to the tip end thereof (left front side in FIG. 4) and a screw hole 155 perforated in the positioning adjusting body 154 at the center thereof. The positioning adjusting body 154 is fixed to the rail arm 63 and protrudes from one side thereof, and the axis of the screw hole 155 is in parallel with the longitudinal direction of the rail arm 63 and is positioned slightly lower than that of the pin hole 65. An adjusting bolt 156 can be screwed into the screw hole 155, and the lengthwise position of the head of the adjusting bolt 156 can be adjusted depending on the screwing length of the adjusting bolt 156.

The pin hole 65 is defined in the rail arm 63 at the tip end thereof and the pin hole 85 is defined in the other rail arm 83 at the tip end thereof. The through pin 45 is inserted into the pin holes 65 and 68 while the pin holes 65 and 85 are aligned with each other at the central axis thereof so that the rail arm 63 and rail arm 83 are coupled with each other so as to be freely turnable. At this time, the axis of the screw hole 155 and that of the pin hole 65 are vertically spaced from each other so that a central axis M of the adjusting bolt 156 which is screwed into the screw hole 155 is vertically spaced from a central axis N of the pin hole 85. Since the central axes M and N are spaced vertically, the head of the adjusting bolt 156 contacts the lower portion of the rail arm 83 at the tip end edge (innermost right side in FIG. 4). Even if the rail arm 63 and rail arm 83 can turn about the through pin 45, the lower surface of the rail arm 83 at the tip end edge thereof contacts the head of the adjusting bolt 156, so that the rail arm 63 and the rail arm 83 are restricted not to turn further. That is, even if the rail arm 63 and rail arm 83 are suspended by the telescopic body 41, they form a substantially C-shape, namely they slightly hang downward, and the angle therebetween does not further narrow. The angle formed when the rail arm 63 and the rail arm 83 close downward can be changed by adjusting the amount of screwing of the adjusting bolt 156 into the screw hole 155 so as to move the position of the head of the adjusting bolt 156.

In such a manner, the telescopic body 41, left swing body 42 and right swing body 43 are respectively structured. When these components are assembled to form the hoisting and clamping apparatus 40, the tip end of the rail arm 63 (right front side in FIG. 3) and the tip end of the rail arm 83 (innermost left side in FIG. 3) are staggered and engaged with each other and then the positions of the pin holes 65 and pin holes 85 are conformed to each other. Thereafter, the lower end of the inner cylinder 52 is engaged in a space between the rail arms 63 and 83, and the pin holes 53 are aligned with the pin holes 65 and 85. Thereafter, the through pin 45 is inserted into the pin holes 53, 65 and 85 in this order from one side of the rail arm 63, and the nut is screwed onto the tip end of the through pin 45 so as to connect them. The telescopic body 41, left swing body 42 and right swing body 43 are assembled by the through pin 45, and they can turn about the through pin 45.

Figure 5:
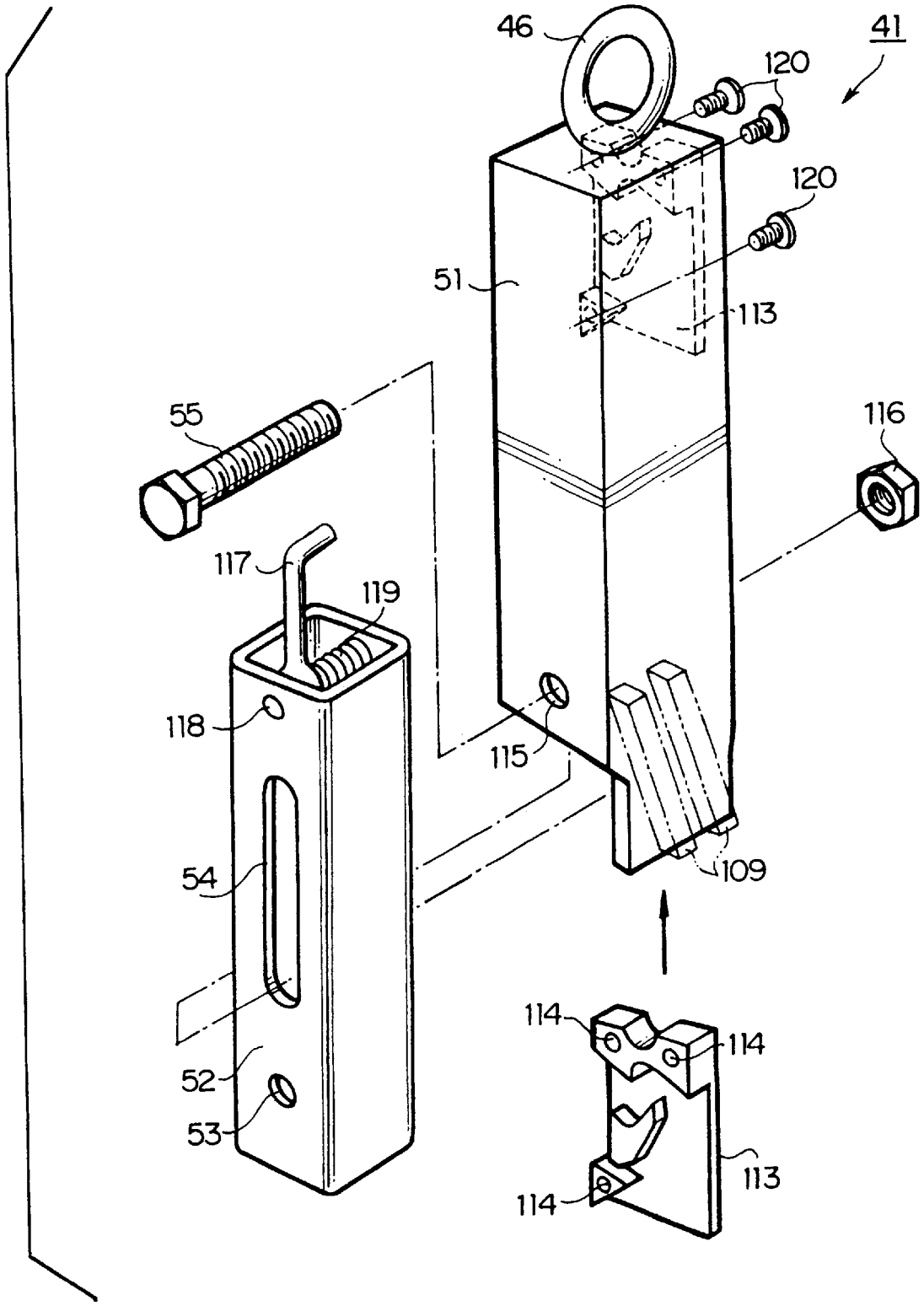

FIG. 5 explains the telescopic body 41 more in detail. As set forth above, the telescopic body 41 mainly comprises the outer cylinder 51 and the inner cylinder 52. A cam plate 113 as a sliding guiding body is inserted into the outer cylinder 51 at the inner upper surface thereof (innermost right surface in FIG. 5). Screw holes 114 are defined in the cam plate 113 at the upper right and left sides and the one lower side thereof. The cam plate 113 is brought into contact with the inner surface of the outer cylinder 51 while the screws 120 are inserted into openings (not shown) defined in one side of the outer cylinder 51, so that the screws 120 are screwed into the screw holes 114 to fix the cam plate 113 to the outer cylinder 51. The insertion holes 115 are defined at both sides of the outer cylinder 51 at the lower portions thereof so as to be perpendicular to the longitudinal directions of the outer cylinder 51. The pair of aslant rails 109 are fixed to one side of the outer cylinder 51 at the lower portion thereof in a position perpendicular to the insertion holes 115 as shown by broken line in FIG. 5.

The inner cylinder 52 is hollow and opened at both ends thereof and it has a long square-piped shape. The outer dimensions of the inner cylinder 52 are slightly less than the inner space of the outer cylinder 51 in cross section. The pin holes 53 are defined in both sides of the inner cylinder 52 at the lower portion thereof, and the axes of the pin holes 53 are arranged to be perpendicular to the longitudinal direction of the inner cylinder 52 (although one pin hole 53 is illustrated in FIG. 5, another pin hole 53 is also defined in the opposite side.) The long holes or slits 54 which are long in vertical direction are defined in both sides of the inner cylinder 52 at central portions thereof in a position above the pin holes 53 (although one long hole 54 is illustrated in FIG. 5, another long hole 54 is also defined in the opposite side, not shown). A pin 118 is inserted into and fixed to both sides of the inner cylinder 52 at the upper portion thereof, and it is positioned perpendicularly to the longitudinal direction of the inner cylinder 52. A supporting shaft is formed by this pin 118 at the portion close to the upper opening of the inner cylinder 52, and a swinging claw or finger 117 as a contact moving body is supported by the pin 118 so as to be swingable to the right and left. A coil spring 119 is inserted onto the pin 118. The swinging claw 117 protrudes upward from the upper end opening of the inner cylinder 52 and has an L-shape as a whole. The tip end of the swinging claw 117 which is bent to form a hook shape is arranged to be in parallel with the pin 118. The coil spring 119 always presses the swinging claw 117 toward the inner wall of the inner cylinder 52, and it operates to hold the swinging claw 117 in an angular position so that the swinging claw 117 does not tip in either direction by its own weight owing to friction between the inner wall surface of the wall 52 and the claw 117. That is, the swinging claw 117 is pressed against the inner wall surface of the inner cylinder 52 by the coil spring 119, and hence it is maintained in the angular position if force is not applied thereto.

When the telescopic body 41 is assembled, the upper end of the inner cylinder 52 is inserted from the lower opening of the outer cylinder 51, then the long holes 54 and the insertion holes 115 are aligned, and then the bolt 55 is inserted into the insertion holes 115 from one side of the outer cylinder 51. Since the tip end of the bolt 55 protrudes from the back surface of the outer cylinder 51 after passing through the insertion holes 115 and long holes 54, a nut 116 is screwed onto the tip end of the bolt 55 so as to connect the outer cylinder 51 and inner cylinder 52. When the telescopic body 41 is assembled in such a manner, the inner cylinder 52 can vertically slide with respect to the outer cylinder 51 within the vertical length thereof. In the state where the inner cylinder 52 is inserted into the outer cylinder 51, the hooked tip end of the swinging claw 117 which is bent in L-shape is brought into contact with a cam surface on the cam plate 113.

A position stopping mechanism 130 (FIG. 6) can temporarily hold the outer cylinder 51 and inner cylinder 52 in a position where they are extended or contracted. Due to the position stopping mechanism 130, the inner cylinder 52 can be temporarily held in a position where the inner cylinder 52 is inserted into the outer cylinder 51 at the innermost end thereof so that the inner cylinder 52 is not extended from the outer cylinder 51 even if the former is pulled outwardly from the latter.

When the inner cylinder 52 is inserted again into the outer cylinder 51 at the innermost end thereof, the retention or holding therebetween is released so that the inner cylinder 52 can be extended from the outer cylinder 51. The outer cylinder 51 and inner cylinder 52 have a function that the minimum and maximum lengths of the contraction and extension thereof can be alternately maintained when they are extended or contracted. The position stopping mechanism 130 comprises a combination of the cam plate 113 and the swinging claw 117.

A pair of pin holes 123 are defined in the sides of the inner cylinder 52 at the upper portion thereof and the axes of these pin holes 123 are arranged to be perpendicular to the longitudinal direction of the inner cylinder 52. A pin 118 having a round rod shape can be inserted into the pin holes 123. When the pin 118 is inserted into the pin holes 123, the pin divides or bisects the square cross-section when viewed from the opened upper portion of the inner cylinder 52. The swinging claw 117 has an L-shaped hook as a whole and also has a disc-shaped turning diameter part 124 provided with a shaft hole 125 at the center thereof. The inner diameter of the swinging shaft hole 125 is larger than the outer diameter of the pin 118 so that the swinging claw 117 can turn freely relative to the pin 118. A linear swinging columnar part 126 is coupled to the upper portion of the outer periphery of the part 124 so as to extend upward and the upper end of the linear swinging columnar part 126 is coupled to the guiding claw 127 which is bent at right angles with the linear swinging columnar part 126. The swinging claw 117 is formed in substantially L-shape by the columnar part 126 and guiding claw 127 as viewed from the side thereof. The coil spring 119 has resiliency and the pin 118 can be inserted into the central opening of the coil spring 119. When the swinging claw 117 and coil spring 119 are incorporated into the inner cylinder 52, the axis of the swinging shaft hole 125 is conformed to axes of the pin holes 123 and one surface of the hub 124 is brought into contact with the inner wall of the inner cylinder 52. Then, the coil spring 119 is interposed between the other side of the hub 124 and the opposite inner wall of the inner cylinder 52, and the pin 118 is linearly inserted into the pin holes 123, 125 and 119. The coil spring 119 is retained in the inner cylinder 52 owing to its resiliency. Because of this resiliency, friction is generated between one side of the hub 124 and the inner wall of the inner cylinder 52, so that the swinging claw 117 does not turn about the pin 118 owing to its weight but it remains in an upright position (final angular position of the swinging claw 117 relative to the pin 118), and this angular position is not changed unless additional force is applied thereto.

A cam surface is formed by processing or working the cam plate 113, namely by cutting a side surface of the cam plate 113 which is made of a thick sheet metal (e.g., brass). A cam surface having a special shaped cam curve is formed on the side surface of the cam plate 113. The guiding claw 127 is moved along this cam curve so that the linear swinging columnar part 126 (i.e. the entire swinging claw 117) is swung about the pin 118 in a given cycle.

The cam plate 113 has a flat shaped cam base plate 134 which is formed by cutting the thick sheet metal with a milling.

An upper cam part 135 protrudes from the upper side of plate 134 and a middle cam part 136 protrudes from the central side of the cam base plate 134. Further, a lower cam part 137 protrudes from the lower side of the cam base plate 134 at one side (left front in FIG. 6). As mentioned above, when one side of the sheet metal is subject to milling or cutting, it is possible to retain the island-shaped upper cam part 135, middle cam part 136 and lower cam part 137 to form the cam base plate 134. Screw holes 114 are perforated in the upper cam part 135 at the right and left thereof and in the lower cam part 137 at the center thereof. These screw holes 114 have female screw portions at the inner periphery thereof. Screws 120 can be screwed into these screw holes 114. The cam plate 113 is fixed to the inner wall of the outer cylinder 51 by these screws 120.

Cam surfaces as formed on the upper cam part 135, middle cam part 136 and lower cam part 137 will be now described with reference to FIG. 7.

The upper cam part 135 has a cam surface at the lower surface thereof which includes a lower circular cam surface 141 and a lower linear cam surface 142 formed respectively at the right and left sides of the upper cam part 135 which demarcates them at its central lower portion, and wherein the lower cam surface 141 and 142 are continuous with each other. The lower circular cam surface 141 has an inverted C-shape wherein one leg has an inclined linear surface which is directed right and downward and the top thereof is curved circularly and the other leg has a linear surface which is directed perpendicularly downward at the center of the upper cam part 135. The lower linear cam surface 142 has a linear lower surface wherein one end is positioned in the middle of the upper cam part 135 and the other end is positioned at the left side surface of the upper cam part 135, and wherein the lower linear cam surface 142 is gently inclined from its right lower end to its left upper end. A jointing position A between the lower circular cam surface 141 and the lower linear cam surface 142, at the ends thereof, is positioned substantially at the center of the upper cam part 135, and a top or crest B of the lower circular cam surface 141 at the semicircular part thereof is positioned slightly rightwardly from the center of the upper cam part 135.

The middle cam part 136 has a cam surface at the entire outer periphery thereof and protrudes from the center of the cam base plate 134 like an island. The middle cam part 136 has an upper circular cam surface 143 which is processed to have a shape of a receiver plate opened at the upper portion thereof. The upper circular cam surface 143 has linear side surfaces which are directed from the bottom C to the right and left at an angle inclined from the bottom C. A linear cam surface 144 is formed at the left side of the middle cam part 136, which surface 144 is arranged vertically in FIG. 7, and the upper circular cam surface 143 and linear cam surface 144 join with each other at a jointing position or corner D. The middle cam part 136 also has a lower cam surface 145 at the left lower portion thereof, which surface 145 is inclined to the right in FIG. 7, and the lower end of the linear cam surface 144 joins with the upper end of the lower cam surface 145 at a jointing position or corner E. The lower cam surface 145 is short in length. A lower linear cam surface 146 is formed at the lower portion of the middle cam part 136 so as to be continuous with the lower end of the lower cam surface 145 and it is directed and inclined upward to the right. The lower cam surface 145 and the lower linear cam surface 146 join with each other to form a jointing position or corner F.

The length of the lower linear cam surface 146 is short and a lower linear cam surface 147 is formed to be continuous with the upper end of the lower linear cam surface 146. The lower linear cam surface 147 is longer than the lower cam surface 145 and lower linear cam surface 146 and has an inclination angle which is sharply inclined upward to the right in FIG. 7 compared with the inclination angle of the lower linear cam surface 146. The lower linear cam surface 146 and lower linear cam surface 147 join with each other at a jointing position or corner G. A side linear cam surface 148 is formed vertically at the right side of the middle cam part 136 and it is linear to be continuous with the distal end of the lower linear cam surface 147. The length of the lower linear cam surface 147 is short, and the lower linear cam surface 147 and side linear cam surface 148 join with each other at a jointing position or corner H. The upper end of the side linear cam surface 148 is continuous with the right upper end of the upper circular cam surface 143, and they join with each other at a jointing position or corner J.

Figure 7:
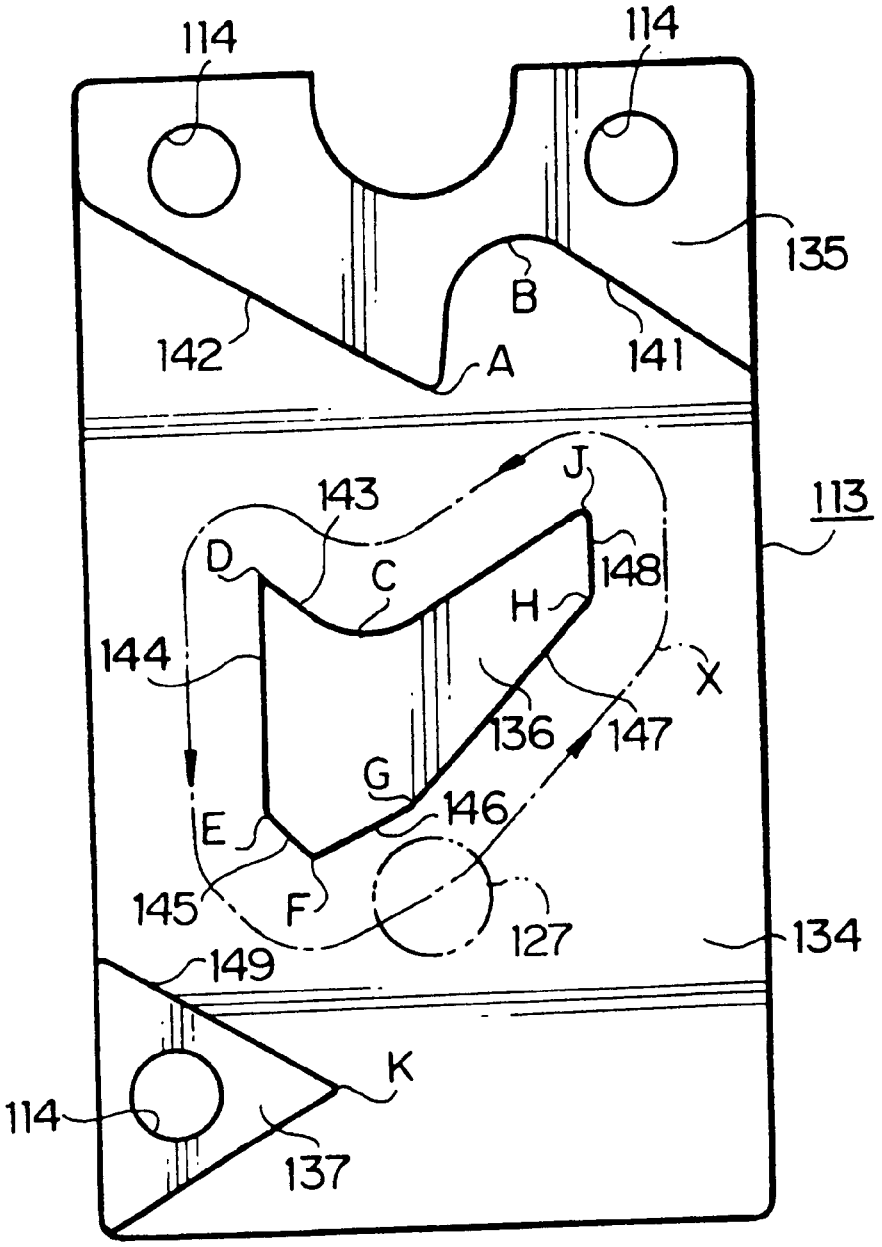

An upper linear cam surface 149 is formed at the left lower corner of the cam base plate 134 in FIG. 7 and it is inclined downward to the right, and the right distal end of the upper linear cam surface 149 forms a crest point or corner K.

The positional relation between the cam surface of the upper cam part 135, middle cam part 136 and lower cam part 137 is illustrated in FIG. 7.

The bottom of cam surface C is positioned to the left of the jointing position A which is substantially at the center of the cam plate 113. The bottom C is thus deviated to the left of the center of the cam plate 113. The jointing positions D and E are arranged along a vertical line and are also positioned at the left of the bottom C. The jointing position F is positioned slightly to the right of the jointing position E and slightly to the left of the crest point K. Next, the jointing positions H and J are arranged along a vertical line and the crest point B is positioned sidewardly between the jointing positions J and A. That is, main positions of the surfaces are illustrated in FIG. 7 in the order of the jointing position J (H), crest point B, jointing position A, jointing position G, bottom C, crest point K, jointing position F and jointing position D (E). The main positions of the cam surfaces are arranged in the vertical order of the crest point B, jointing position A, jointing position J, jointing position D, jointing position H, bottom C, jointing position E (G), jointing position F and crest point K. With such an arrangement, the track (locus) along which the guiding claw 127 moves on each cam surface is determined.

Described next is the track (locus) along which the guiding claw 127 moves from the position of the guiding claw 127 as shown in broken lines in FIG. 7. If the guiding claw 127 is moved upward in FIG. 7, it first contacts the lower linear cam surface 146 and slides upward to the right. If the guiding claw 127 passes through the jointing position G, then it contacts the lower linear cam surface 147 and slides along the lower linear cam surface 147 to move to the jointing position H, then it is moved vertically to the jointing position J while keeping in the same position. If the guiding claw 127 is further moved upward, it contacts the lower surface of the lower circular cam surface 141, and it is moved to the left in FIG. 7 along the inclined surface, and finally it is moved to the crest point B of the lower circular cam surface 141 where it is stopped.

Next, when the guiding claw 127 is pulled downward relative to the cam plate 113, it is moved away from the crest point B and contacts the inclined surface between the bottom C of the upper circular cam surface 143 and the jointing position J. If the guiding claw 127 is pulled downward while contacting the upper circular cam surface 143, it is moved leftward along the inclined surface of the upper circular cam surface 143, then it is moved to the bottom C. If the guiding claw 127 is slid to the bottom C, it stops at the bottom C, and can not be moved downward further. In this state, the guiding claw 127 is retained by the upper circular cam surface 143 and hence the swinging claw 117 including the guiding claw 127 and the inner cylinder 52 are suspended.

If the guiding claw 127 is pushed upward relative to the cam plate 113, it is moved away from the bottom C and contacts the lower surface of the lower linear cam surface 142. Since the bottom C is positioned at the left of the jointing position A in FIG. 7, the guiding claw 127 does not contact the crest point B. The guiding claw 127 which contacted the inclined surface of the lower linear cam surface 142 is pushed upward so that it is moved leftward along the inclined surface of the cam surface 142. If the guiding claw 127 which is moved slightly leftward is pulled downward relative to the cam plate 113, it contacts the vertically arranged side surface of the linear cam surface 144 and is moved downward, and finally it contacts the upper surface of the upper linear cam surface 149 since it is positioned at the left of the crest point B. When the guiding claw 127 contacts the upper linear cam surface 149, the guiding claw 127 is moved rightward along the inclined surface of the upper linear cam surface 149, and then moved to the crest point K. If the guiding claw 127 is moved downward from the crest point K, it is positioned at the right of the jointing position F.

If the guiding claw 127 is positioned as such, if it is pushed upward again relative to the cam plate 113, it does not contact the lower cam surface 145 but contacts the lower surface of the lower linear cam surface 146 since it is positioned at the right of the jointing position F. Thereafter, the guiding claw 127 performs the same operations as set forth above. In such a manner, if the guiding claw 127 is moved vertically relative to the cam plate 113, it operates to turn counterclockwise about the middle cam part 136, and this operating cycle is performed in synchronization with the vertical motion. The track (locus) of the guiding claw 127 when it is moved is expressed by the dash-dot line X in FIG. 7.

Figure 8:
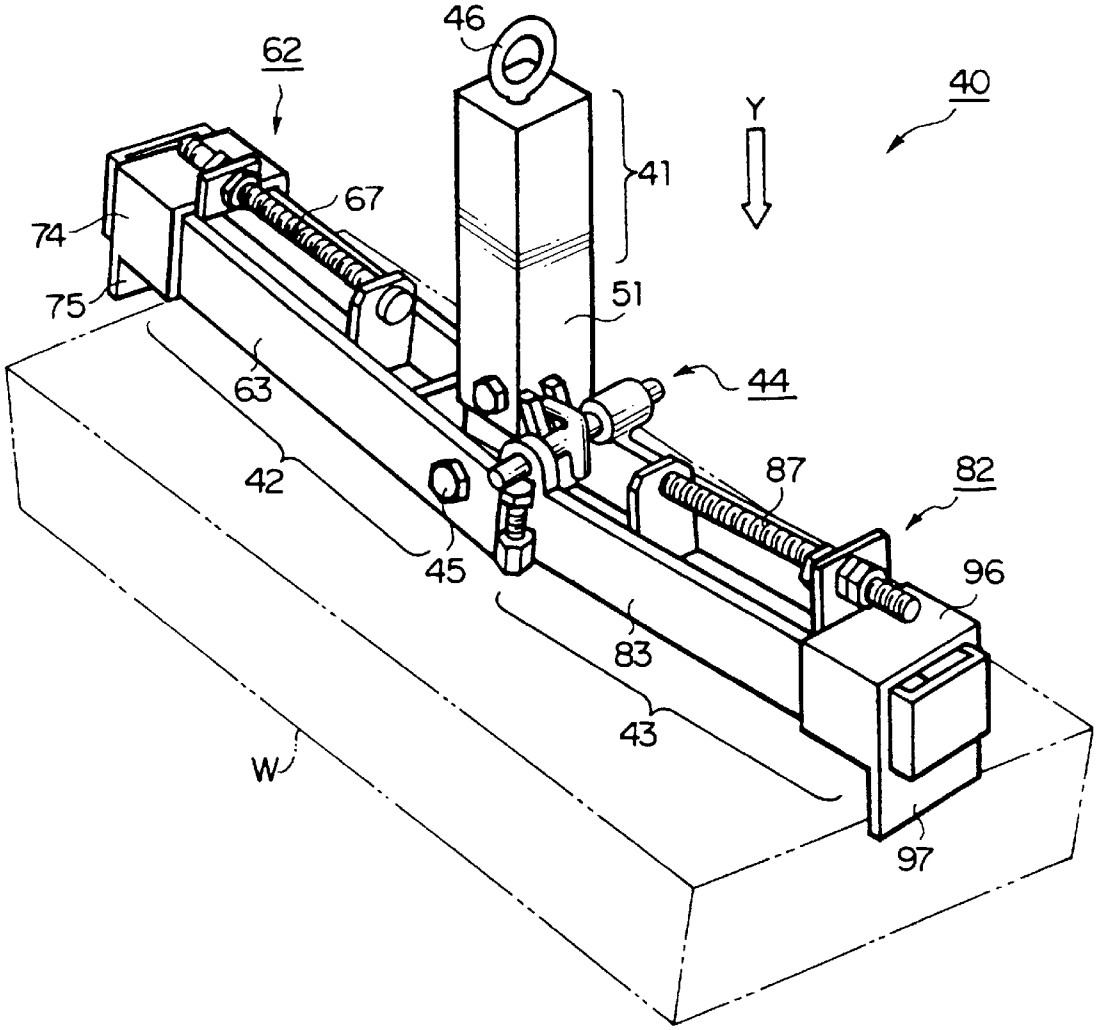

Next, an automatic setting of the clamping and releasing of a heavy object W using the hoisting and clamping apparatus 40 according to the first embodiment of the invention will be now described with reference to FIG. 8. The heavy object W is formed as a cover or block body which is made of, e.g. concrete, and weighs several kilograms, and it has no protrusion or grips for lifting. It is troublesome to lift such heavy object W.

When the heavy object W is gripped by the hoisting and clamping apparatus 40, the tip ends of the telescopic body 41, left swing body 42 and right swing body 43 are coupled with one another by the through pin 45 in an inverted T-shape as shown in FIGS. 1 and 2. In FIG. 8, the telescopic body 41 is positioned perpendicularly to the ground, and the left and right swing bodies 42 and 43 are arranged to be substantially linearly aligned. A wire or chain is inserted into the hoisting ring 46 disposed on the top of the telescopic body 41, then the wire or chain is hoisted by a crane, etc. so that the entire hoisting and clamping apparatus 40 is hoisted.

Before using the hoisting and clamping apparatus 40, the positions of the slide bodies 62 and 82 are first adjusted, with the interval between the contact pressers 75 and 97 adjusted to fit the length of the heavy object W. The adjustment of the length can be performed by operating the nuts 68 and 88 and double nuts 69 and 89. As shown in FIG. 3, the slide body 62 is slidably inserted onto the rail arm 63 and at the same time the long bolt 67 is inserted into the insertion hole 77, and hence the position of the slide body 62 relative to the rail 63 can be freely moved. When the nut 68 which is screwed onto the long bolt 67 is turned, the position of the nut 68 can be moved by the pitch of the long bolt 67 in the longitudinal direction thereof. The nut 68 is stopped at a required or needed position. When the positioning plate 76 contacts the nut 68, the slide body 62 can not further move to the innermost part of the rail arm 63, and hence the position of the slide body 62 can be set. Then the double nut 69 is screwed onto the long bolt 67 from the tip end thereof to clamp the positioning plate 76 between the nut 68 and double nut 69, thereby fixing the slide body 62 at its position.

Likewise, as shown in FIG. 3, the slide body 82 is slidably inserted onto the rail arm 83 and the long bolt 87 is inserted into the insertion hole 99 so that the position of the slide body 82 can be freely adjusted relative to the rail arm 83. When the nut 88 which is screwed onto the long bolt 87 is turned, the position of the nut 88 can be moved in the longitudinal direction thereof by the pitch of the nut 88. The nut 88 is stopped at a needed position. When the positioning plate 98 contacts the nut 88, the slide body 82 can not further move to the innermost part of the rail arm 83, and hence the position of the slide body 82 can be set. Then the double nut 89 is screwed onto the long bolt 87 from the tip end thereof to clamp the positioning plate 98 between the nut 88 and double nut 89, thereby fixing the slide body 82 at its position. In the positioning adjustment, the internal interval between the contacting pressers 75 and 97 protruding downward from the slide bodies 62 and 82 is set to be slightly longer than the length of the heavy object W. Further, the interval between the through pin 45 and the contact presser 75 and that between the through pin 45 and contact presser 97 is set to be the same. With such an adjustment, the right and left weighing balances become equal, enabling the left and right swing bodies 42 and 43 to be maintained in the horizontal position to hoist the heavy object W while the left and right swing bodies 42 and 43 are not inclined.

Figure 9:
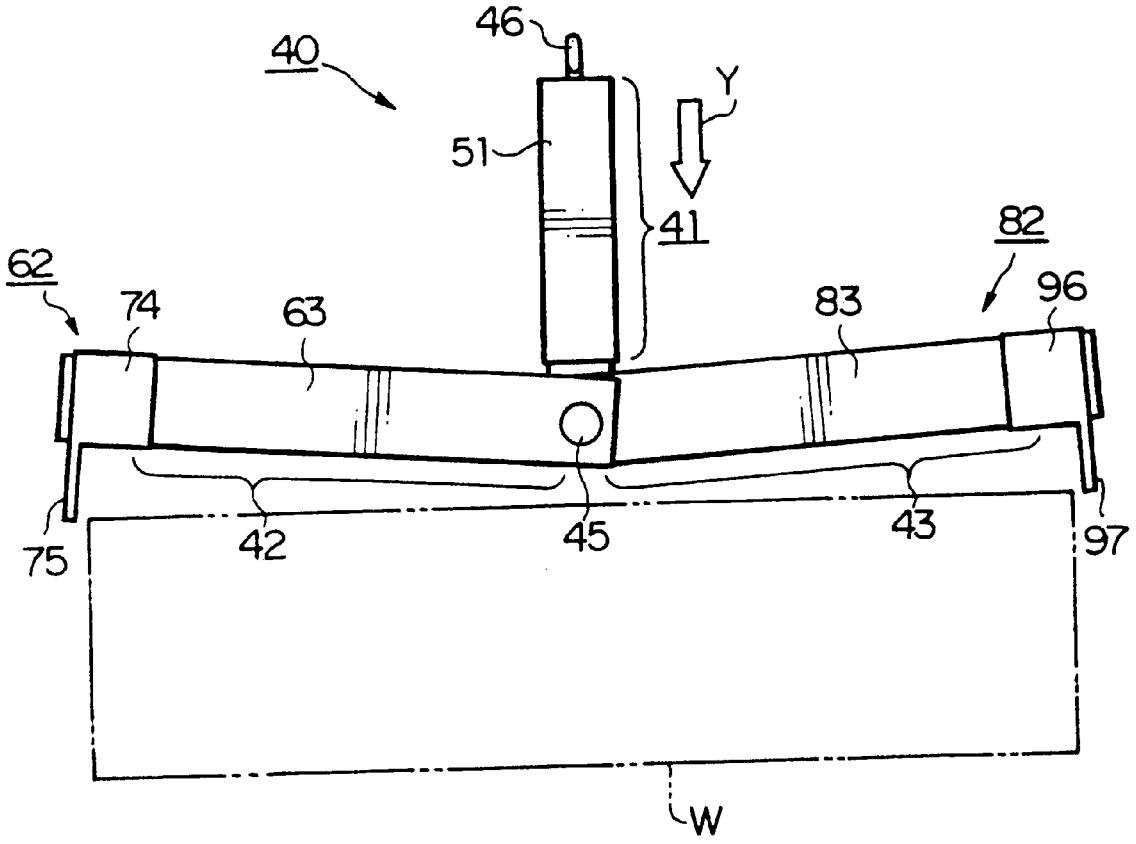

The clamping operation of the heavy object W by the hoisting and clamping apparatus 40 will be now described with reference to FIGS. 8 and 9. In these figures, the heavy object W is arranged horizontally relative to the ground. The hoisting and clamping apparatus 40 is slowly lowered toward the heavy object W from the upper portion thereof, and the center of the hoisting and clamping apparatus 40 (the position where the telescopic body 41, left swing body 42 and right swing body 43 cross one another) is made in contact with the heavy object W so that the contact pressers 75 and 97 can grip both sides of the heavy object W. When the heavy object W is gripped, the length of the telescopic body 41 is reduced, namely, the inner cylinder 52 is inserted into the outer cylinder 51. In this state, the closable restriction mechanism 44 engages with the opening adjusting part 47, and the left and right swing bodies 42 and 43 maintain their positions as if they spread wings to the left and right. The telescopic body 41 remains contracted in its length.

The relation between the closable restriction mechanism 44 and opening adjusting part 47 and between the swinging claw 117 and cam plate 113 in such a state will be now described with reference to FIG. 12.

The pair of aslant rails 109 are fixed to the lower side portion of the outer cylinder 51 and they are inclined relative to the longitudinal direction thereof. Accordingly, a force acting against one side of the outer cylinder 51 (left front direction in FIG. 12) is generated by the retaining claw 108 engaged between the aslant rails 109. The force is transmitted to the sliding shaft 107 so that the slide shaft 107 is slid along the shaft holes 91 and 93 in the direction of arrow Q in FIG. 12. This causes one end of the slide shaft 107 to protrude from the side of the shaft protrusion 90 whereby the tip end portion of the slide shaft 107 is positioned over the adjusting bolt 72. Accordingly, the head of the adjusting bolt 72 contacts the lower surface of the tip end of the slide shaft 107, thereby restricting the rail arms 63 and 83 from turning about the through hinge pin 45. Accordingly, the rail arms 63 and 83 cannot turn downward further about the pin 45, and they remain opened to the right and left (like spread wings) as shown in FIG. 8.

The relation between the swinging claw 117 and cam plate 113 inside the outer cylinder 51 will now be described with reference to FIG. 7.

When the inner cylinder 52 is inserted into the outer cylinder 51, the swinging claw 117 is pushed over the outer cylinder 51 so that the guiding claw 127 on the swinging claw 117 is positioned in a space between the upper cam part 135 and middle cam part 136. Since the outer cylinder 51 is hoisted by a wire or chain hung by the hoisting ring 46, the guiding claw 127 contacts the bottom C of the upper circular cam surface 143 and it is suspended while it is retained thereby. Accordingly, the swinging claw 117, pin 118 and inner cylinder 52 which are continuous from the guiding claw 127 are suspended like the guiding claw 127 so that the inner cylinder 52 remains inserted into the upper portion of the outer cylinder 51.

In this state, if the hoisting ring 46 is hoisted by the wire or chain hung by a crane, the contracted telescopic body 41, left swing body 42 and right swing body 43 are hoisted upward. Then, the thus hoisted hoisting and clamping apparatus 40 is slowly lowered in the direction Y in FIGS. 8 and 9 over the heavy object W. At this time, the longitudinal direction of the swing bodies 42 and 43 is conformed to that of the heavy object W so as to arrange the heavy object W between the left and right contacting pressers 75 and 97. Since the slide shaft 107 contacts the adjusting bolt 72 as mentioned above, the rail arms 63 and 83 of the hoisting and clamping apparatus 40 are positioned slightly over the through pin 45 at both ends thereof and inclined in the direction of the through pin 45. Accordingly, the contact pressers 75 and 97 arranged at the left and right are enlarged to form the substantially L-shape in the downward direction so that the heavy object W is positioned to be easily inserted into the lower surfaces of the rail arms 63 and 83 at the right and left corners thereof.

When the hoisting and clamping apparatus 40 is lowered in the direction Y, the lower part of the through pin 45 or body member 52 contacts the upper surface of the heavy object W and the hoisting and clamping apparatus 40 turns about the through pin 45 so that the rail arms 63 and 83 are arranged linearly.

If the outer cylinder 51 is further lowered downward after the hoisting and clamping apparatus 40 is placed on the heavy object W when the lower surfaces of the rail arms 63 and 83 contact the surface of the heavy object W (when the wire hung by the crane is lowered, the outer cylinder 51 lowers owing to its own weight), the outer cylinder 51 lowers downward relative to the inner cylinder 52, so that the swinging claw 117 provided inside the inner cylinder 52 moves upward relatively. As a result, as shown in FIG. 7, the guiding claw 127 is released from contact with the bottom C of the upper circular cam surface 143, and hence it moves upward.

That is, when the outer cylinder 51 lowers relative to the inner cylinder 52, the swinging claws 117 and 127 move upward relatively, and the guiding claw 127 moves away from the bottom C and moves vertically as shown in FIG. 7 so that it contacts the lower surface of the lower linear cam surface 142. The guiding claw 127 which contacts the lower surface of the lower linear cam surface 142 is pushed upward so that it is moved leftward in FIG. 7 along the inclination of the cam surface 142 and the swinging claw 117 is turned about the pin 118.

In such a manner, when the outer cylinder 51 is lowered to the lowest position while it is inserted onto the inner cylinder 52, the swinging claw 117 is turned and the guiding claw 127 is moved leftward. Once the outer cylinder 51 is lowered to the lowest position, the hoisting ring 46 is again hoisted by a wire hung by a crane. As a result, the outer cylinder 51 is pulled upward relative to the inner cylinder 52 so as to increase the entire length of the telescopic body 41 so that the swinging claw 117 and guiding claw 127 lower relative to the cam plate 113. Since the guiding claw 127 was moved leftward in the previous operation and stopped at the same position in FIG. 7, the guiding claw 127 does not contact the upper surface of the upper circular cam surface 143 but lowers and moves vertically along the left side of the linear cam surface 144. When the outer cylinder 51 is further pulled up relative to the inner cylinder 52, the guiding claw 127 finally contacts the upper surface of the upper linear cam surface 149.

Since the upper linear cam surface 149 is inclined from the left upper portion to the right lower portion as shown in FIG. 7, the guiding claw 127 which contacts the upper surface of the upper linear cam surface 149 is moved rightward and downward along the inclination of the upper linear cam surface 149, and the swinging claw 117 is turned clockwise about the pin 118. If the outer cylinder 51 is further pulled upward relative to the inner cylinder 52, the guiding claw 127 moves to the right of the crest K at the tip end of the upper linear cam surface 149 to release the contact between the upper linear cam surface 149 and guiding claw 127. In such a state, the guiding claw 127 does not contact either of the cam surfaces of the cam plate 113, and hence the swinging claw 117 remains positioned substantially vertically. In this state, the telescopic motion of the outer cylinder 51 is not at all restricted so that the outer cylinder 51 can be pulled up further relative to the inner cylinder 52 while the bolt 55 slides along the inner periphery of the long slots 54 as shown in FIG. 5. The telescopic body 41 assembled by the outer cylinder 51 and inner cylinder 52 is increased in the entire length thereof and it extends further until the bolt 55 engages in the inner peripheral upper edge of the long slots 54. In this state, the hoisting force, namely, the force to be hoisted by a wire hung by a crane is transmitted to the hoisting ring 46, outer cylinder 51, bolt 55 and long slots 54 in this order, thereby hoisting the inner cylinder 52. At the same time, the swing bodies 42 and 43 are hoisted by the through pin 45 which is inserted into the pin hole 53 of the inner cylinder 52.

When the outer cylinder 51 is pulled upward relative to the inner cylinder 52, the aslant rails 109 fixed to the side of the outer cylinder 51 are also pulled upward relative to the inner cylinder 52. Then the retaining claw 108 engaged in the pair of aslant rails 109 is stopped relatively because it is positioned in the side of the inner cylinder 52 so that an acting force is applied to the retaining claw 108 in the direction perpendicular to the direction where the outer cylinder 51 is pulled upward along the inclined angle of the aslant rails 109. Accordingly, the slide shaft 107 to which the retaining claw 108 is fixed is moved in the direction R in FIG. 13 and slides inside the shaft holes 91 and 93. Accordingly, one end of the slide shaft 107 (left front side in FIG. 13) is pulled inside the shaft protrusion 90 so that the slide shaft 107 does not protrude from the shaft protrusion 90, and hence the head of the adjusting bolt 72 is not covered. When one end of the slide shaft 107 is pulled inside the shaft protrusion 90, the slide shaft 107 no longer obstructs the head of the adjusting bolt 72 and thus releases the rail arms 63 and 83 so they are free to turn about the through pin 45. Then, the rail arms 63 and 83 respectively turn downward in the direction P in FIG. 13 so that each of the rail arms 63 and 83 can move freely about the through pin 45.

When the rail arms 63 and 83 can turn downward about the through pin 45, the contact pressers 75 and 97 fixed to the slide bodies 62 and 82 can contact the heavy object W at both sides thereof.

If the telescopic body 41 is now pulled upward via the hoisting ring 46 in the direction Z (FIG. 11) after the restriction against turning of the rail arms 63 and 83 is released by the slide shaft 107, the heavy object W is strongly gripped by the contact pressers 75 and 97 owing to this pulling force, and hence it is pulled upward in the direction Z. This operation is described more in detail.

When the hoisting ring 46 is pulled upward by a wire, etc. hung by the crane, the outer cylinder 51 is pulled upward, then the inner cylinder 52 is pulled upward via the bolt 55 and tip ends of the rail arms 63 and 83 are respectively pulled upward via the through pin 45. Since the restriction of the turning of the rail arms 63 and 83 by the slide shaft 107 and adjusting bolt 72 is released, when the through pin 45 is moved upward in the direction Z, the inner ends of the rail arms 63 and 83 are first pulled upward, whereas the outer ends of the rail arms 63 and 83 (left and right ends in FIG. 11) remain at the same elevational position. Then, the rail arm 63 is turned counterclockwise about the through pin 45, the rail arm 83 is turned clockwise about the through pin 45 so that the outer ends of the rail arms 63 and 83 are positioned under the through pin 45 and move into a C-shape. Consequently, the contact presser 75 of the slide body 62 fixed to the rail arm 63 is brought into contact with the left surface of the heavy object W while the contact presser 95 of the slide body 82 fixed to the rail arm 83 is brought into contact with the right surface of the heavy object W. This is caused by the generation of a gap (play) between the upper surface of the heavy object W and the inner ends of the rail arms 63 and 83 because the maximum interval between the inner surfaces of the contact pressers 75 and 95 is normally slightly longer than the length of the upper portion of the heavy object W.

Figure 11:
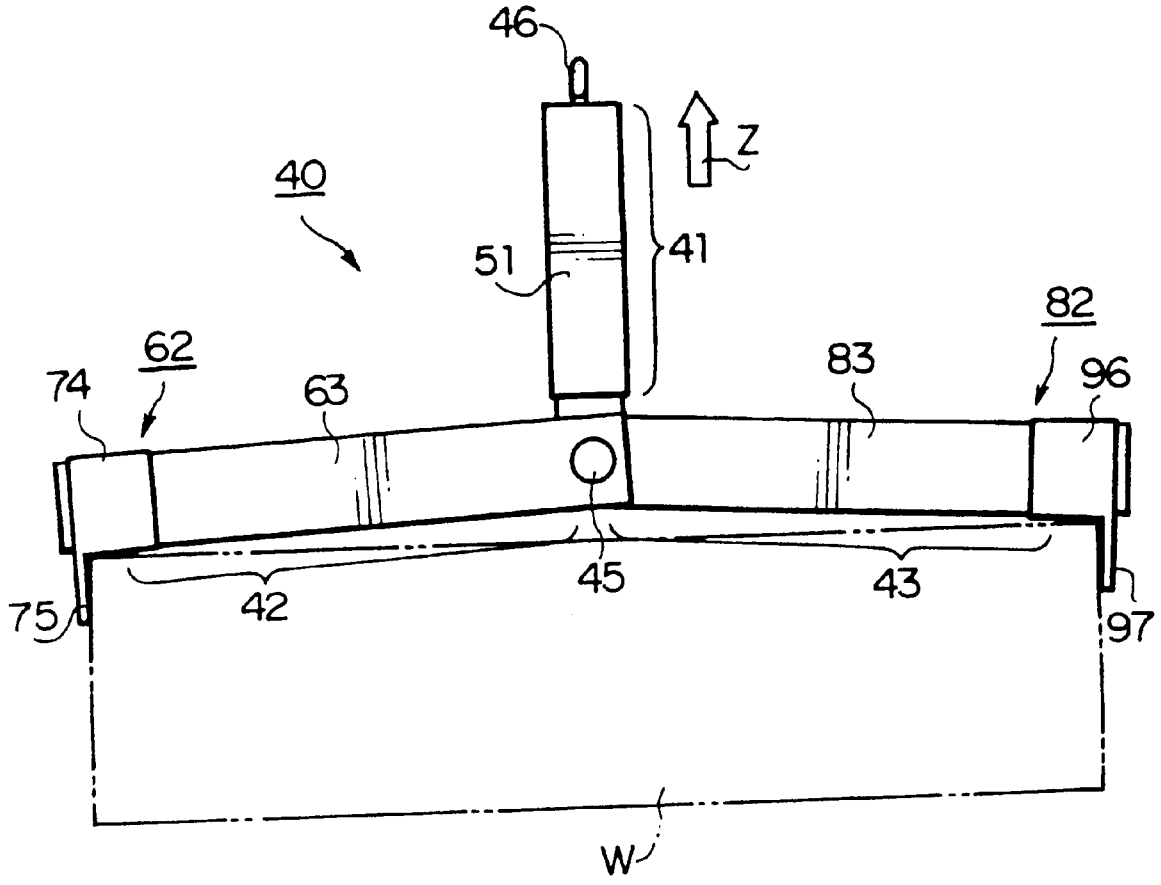
Figure 12:
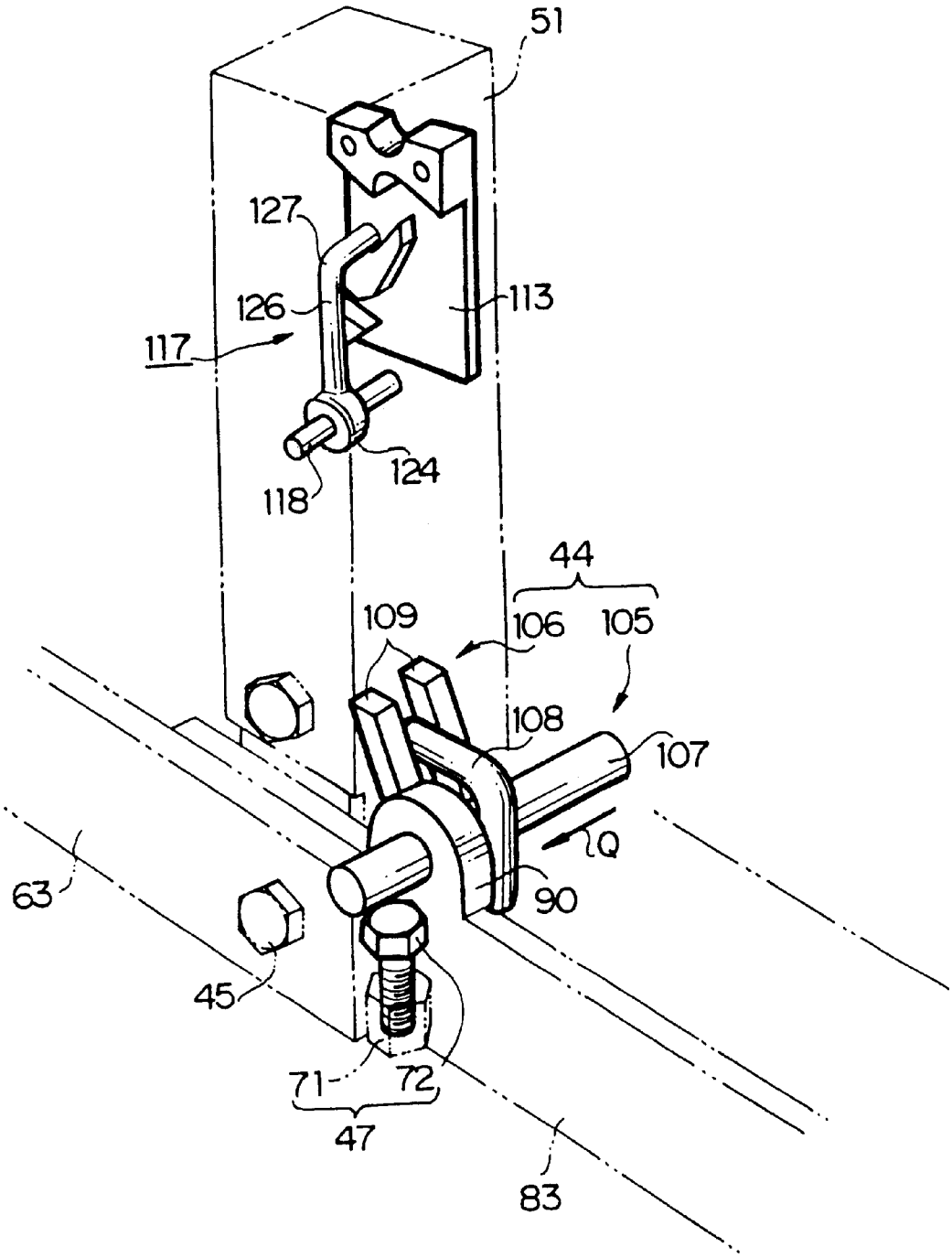
Figure 13:
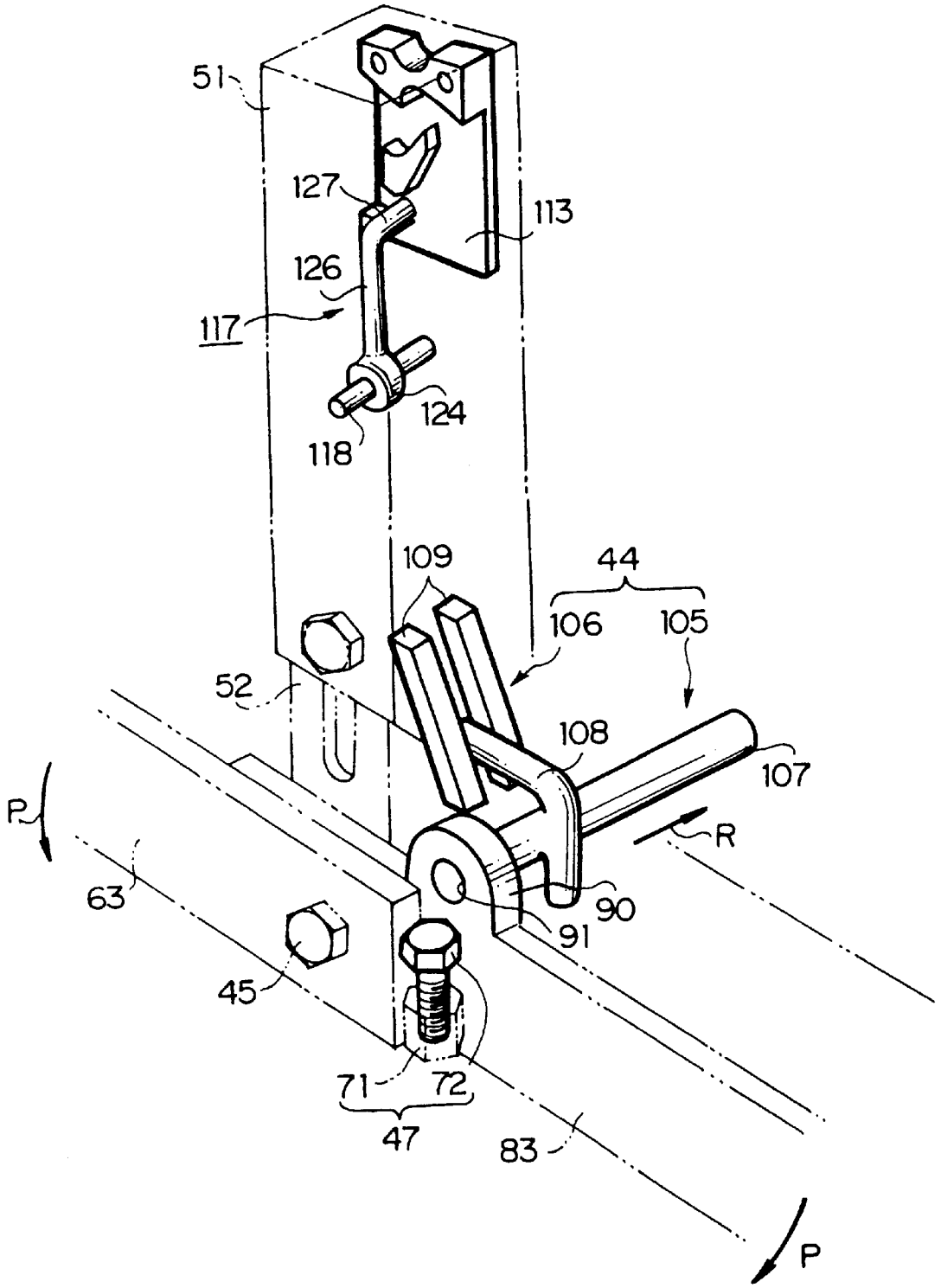

If the telescopic body 41 is pulled upward in the direction Z as shown in FIGS. 11 and 12 in a state where the inner sides of the contact pressers 75 and 95 are brought into contact with the right and left surfaces of the heavy object W, the force to pull up the telescopic body 41 in the direction Z becomes a component force of both rail arms 63 and 83 which applies to and presses against the side surfaces of the heavy object W with strong force. Since there is formed an acute angle between the rail arms 63 and 83 and that of the heavy object W, the above component force is doubled by the force to pull up the telescopic body 41 in the direction of Z. Since the side surfaces of the heavy object W are held by the strong force owing to the contact pressers 75 and 95, the heavy object W can be held by the contact pressers 75 and 95 without sliding or coming off, and hence the heavy object W can be hoisted upward together with the telescopic body 41 in the direction Z. In such a manner, the heavy object W can be gripped and hoisted, and the hoisting ring 46 can be moved horizontally by a wire, etc. hung by a crane, etc. and it is slowly lowered at the new horizontally moved position. If the heavy object W is gripped and moved to a given spot, it is lowered at that spot to thereby release the gripping. In this operation, the lower surface of the heavy object W is deposited on the ground, etc. in a state where the hoisting ring 46 is hoisted by the wire, etc. hung by the crane, and then only the hoisting ring 46 and outer cylinder 51 are moved downward, which can be automatically effected.

In a state where the heavy object W is suspended, the lower surfaces of the swing bodies 42 and 43 are spaced away from the upper surface of the heavy object W to form a C-shape. When the telescopic body 41 which is hung by the hoisting ring 46 is lowered, the lower surface of the heavy object W is brought into contact with the ground and hence it is not further lowered. Accordingly, the swing bodies 42 and 43 are lowered owing to their own weights and the rail arms 63 and 83 turn about the through pin 45 so that the lower surfaces of the rail arms 63 and 83 are brought into contact with the surface of the heavy object W. In this state, the inner cylinder 52 coupled with the rail arms 63 and 83 is not further lowered, and they remain stopped at that position.

If the wire hung by the crane is lowered to lower the hoisting ring 46, the outer cylinder 51 lowers further owing to its own weight so as to push the inner cylinder 52 into the outer cylinder 51 so that the telescopic body 41 is reduced in the entire length thereof. Since the outer cylinder 51 lowers, the inner cylinder 52 rises relatively and the swinging claw 117 coupled with the inner cylinder 52 is moved over the outer cylinder 51 so that the guiding claw 127 of the swinging claw 117 contacts the cam surface of the cam plate 113. This state is explained with reference to FIG. 7. When the guiding claw 127 which is positioned under the cam plate 113 rises relatively in the lowering of the outer cylinder 51, it first contacts the lower surface of the lower linear cam surface 146. Then the guiding claw 127 is moved rightward in FIG. 7 due to the inclination of the cam surface of the lower linear cam surface 146. Then, the guiding claw 127 passes through the jointing point G, and then contacts the lower linear cam surface 147 and it is moved rightward along the inclination of the lower linear cam surface 147. When the guiding claw 127 is moved to the jointing point H, the guiding claw 127 is not further moved rightward but it is moved upward along the surface of the side linear cam surface 148 during the relative rising of the inner cylinder 52 as shown in FIG. 7. When the guiding claw 127 is moved linearly upward, the guiding claw 127 contacts the lower surface of the lower circular cam surface 141 and the guiding claw 127 is moved leftward along the curve of the lower circular cam surface 141. When the outer cylinder 51 reaches the lowest position, the guiding claw 127 is moved to the crest B which is the highest position of the lower circular cam surface 141 where it is stopped (since the lower circular cam surface 141 forms substantially a V-shape, the guiding claw 127 is not moved further).

When the outer cylinder 51 is lowered, and the inner cylinder 52 is inserted into the innermost part of the outer cylinder 51, the hoisting ring 46 is hoisted by the wire, etc. hung by the crane, so that the outer cylinder 51 rises. When the outer cylinder 51 rises, the cam plate 113 rises at the same time, but the guiding claw 127 lowers relatively so that the position where the guiding claw 127 contacts the cam plate 113 is defined. First, when the cam plate 113 is moved upward in FIG. 7, the guiding claw 127 lowers since it remains stopped but it is moved leftward owing to the cam curve of the lower circular cam surface 141 and is positioned to the left beyond the jointing point J. Accordingly, when the guiding claw 127 is vertically downwardly moved, it contacts the upper surface of the upper circular cam surface 143. When the guiding claw 127 lowers, it is moved leftward owing to the curve of the upper circular cam surface 143. If the guiding claw 127 further lowers, it contacts the bottom C which is the lowest position of the upper circular cam surface 143 and it is held or retained there. When the guiding claw 127 is retained by the bottom C of the upper circular cam surface 143, the guiding claw 127 cannot lower further, and hence the swinging claw 117, pin 118 and inner cylinder 52 coupled with the guiding claw 127 do not lower likewise. In this state, the outer cylinder 51 cannot be pulled out from the inner cylinder 52 and hence it stops. Further, when the hoisting ring 46 is hoisted, the through pin 45 is pulled upward in a state where the inner cylinder 52 is accommodated in the outer cylinder 51, namely, the telescopic body 41 is contracted, and hence the swing bodies 42 and 43 are hoisted by the through pin 45.

If the outer cylinder 51 lowers and the inner cylinder 52 is inserted into the outer cylinder 51, the aslant rails 109 fixed to the outer cylinder 51 also lower as shown in FIG. 12. Since the retaining claw 108 is engaged between the aslant rails 109, an operation force directed to the left front in FIG. 12 is applied to the retaining claw 108 while the aslant rails 109 lower, thereby moving the slide shaft 107 in the direction Q. When the slide shaft 107 slides along the shaft holes 91 and 93 and moves in the direction Q, the tip end of the slide shaft 107 (left front side in FIG. 12) protrudes from the side surface of the shaft protrusion 90 and stops in this state. Since the adjusting bolt 72 is positioned under the slide shaft 107, the head of the adjusting bolt 72 contacts the lower surface of the protruded tip end of the slide shaft 107. In such a manner, when the head of the adjusting bolt 72 contacts the lower surface of the slide shaft 107, the rail arms 63 and 83 cannot be turned downward about the through pin 45, and the opening angle therebetween remains fixed. That is, as shown in FIGS. 8 and 9, both rail arms 63 and 83 remain positioned as shown in FIGS. 8 and 9, namely, both ends thereof are opened slightly inclined upward as if wings are spread.

In this state, since the inner sides of the contact pressers 75 and 97 are away from both surfaces of the heavy object W, if the hoisting ring 46 is hoisted by the wire, etc. hung by the crane, the entire hoisting and clamping apparatus 40 is moved away from the heavy object W, and hence the retention between the hoisting and clamping apparatus 40 and heavy object W is automatically released.

When the above mentioned operations are performed to hoist or suspend the hoisting ring 46 by a wire hung by a crane, it is possible to grip, suspend and move the heavy object W and to release the gripping of the heavy object W.

There arises a case that the heavy object W is not gripped by the contact pressers 75 and 97 (such as slippage of the contact pressers 75 and 97) although the hoisting and clamping apparatus 40 can be vertically moved as a whole by a wire, etc. hung by a crane. When the hoisting and clamping apparatus 40 is pulled upward in the direction Z in a state shown in FIG. 11 while the restriction of turning of the rail arms 63 and 83 by the closable restriction mechanism 44 is released, since the contact pressers 75 and 97 do not contact the heavy object W, the rail arms 63 and 83 turn downward about the through pin 45 as they are and the outer ends thereof (sides to which the slide bodies 62 and 82 are attached) strike against each other. In such a state, the heavy object W cannot be automatically gripped, hoisted by the hoisting and clamping apparatus 40, and the operation to release the gripping of the heavy object W by the hoisting and clamping apparatus 40 cannot be performed. To prevent such a state, the closing adjusting part 48 has a function to restrict the angle through which the rail arms 63 and 83 turn downward about the through pin 45 and to finely adjust this angle.

Figure 10:
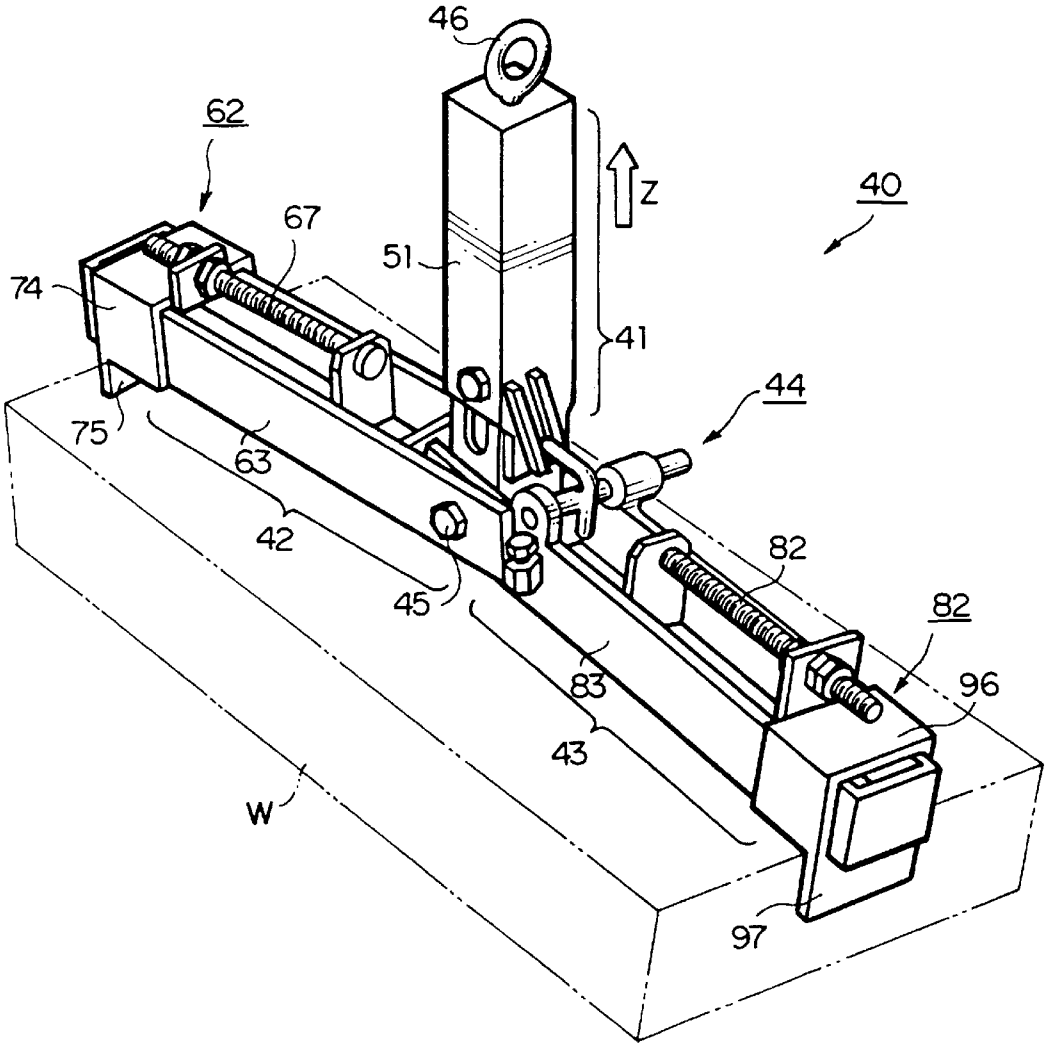

As shown in FIG. 4, the positioning adjusting body 154 is fixed to the tip or inner end of the rail arm 63 and the adjusting bolt 156 is screwed into the screw hole 155 of the positioning adjusting body 154. The axis of the adjusting bolt 156 is positioned under that of the pin holes 85. When the rail arms 63 and 83 turn downwardly about the through pin 45, the head of the adjusting bolt 156 contacts the inner end of the rail arm 83 to restrict further downward turning of the rail arms 63 and 83. Accordingly, even if the rail arms 63 and 83 can be automatically turned downward owing to the releasing operation by the closable restriction mechanism 44, the adjusting bolt 156 can be set to limit the angle where the rail arms 63 and 83 lower into the C-shape as shown in FIG. 10. The adjustment of the angle between the rail arms 63 and 83 can be changed by screwing the length of the adjusting bolt 156 into the screw hole 155.

The hoisting and clamping apparatus according to a second embodiment of the invention will be now described with reference to FIGS. 14 to 22. In this embodiment, the suspended heavy object W is turned horizontally and the longitudinal direction thereof can be turned by remote control.

Figure 14:
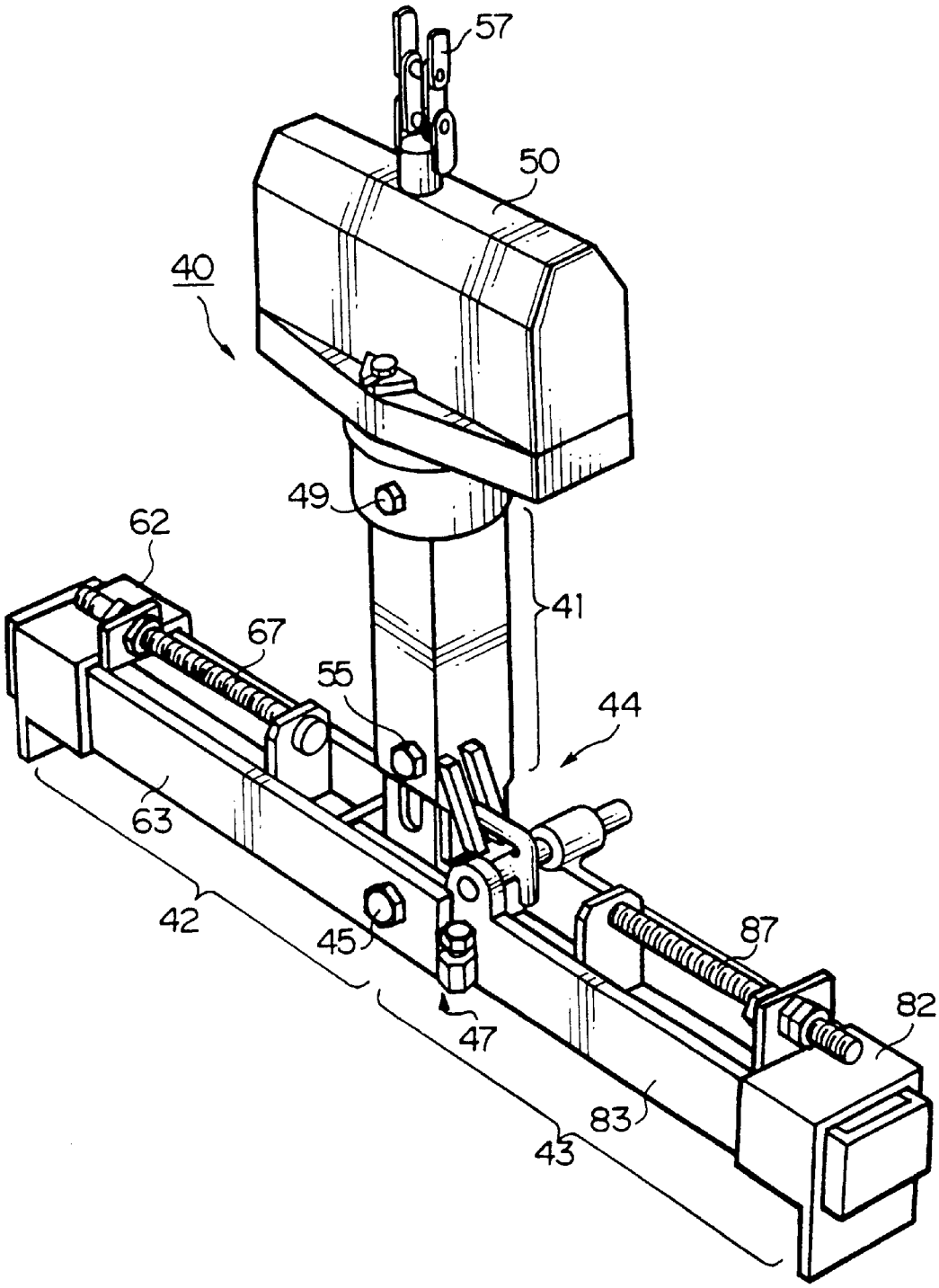
Figure 15:
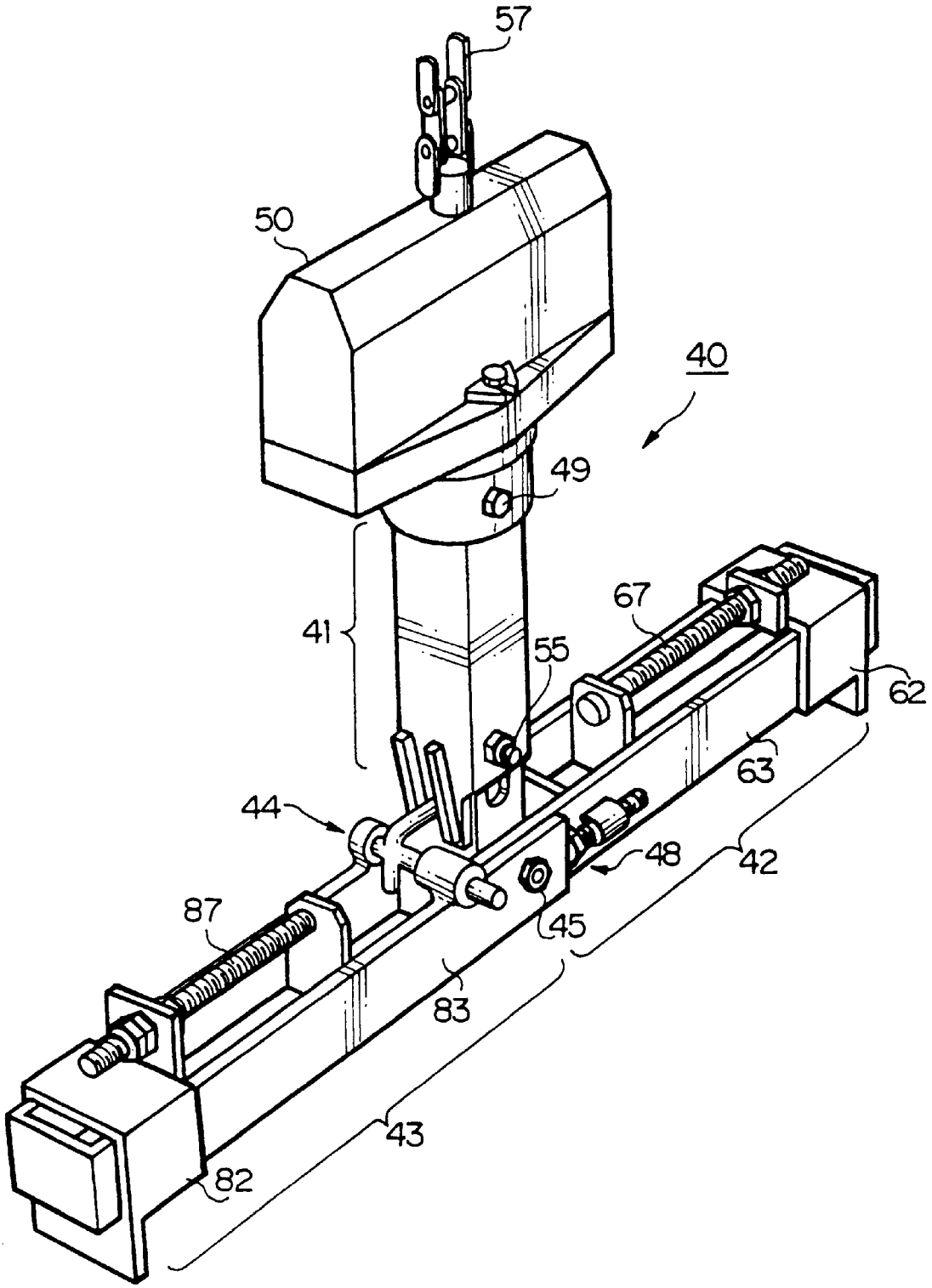

FIG. 14 is a view showing a second embodiment of the hoisting and clamping apparatus 40 from the right upper slanting direction, and FIG. 15 is a view showing the apparatus 40 from the left upper slanting direction opposite to FIG. 14. The hoisting and clamping apparatus 40 comprises the telescopic body 41, the left and right swing bodies 42 and 43 and a turning driving body 50. The telescopic body 41 is coupled with the turning driving body 50 having a long box shape by a connecting pin 49 provided at the upper end of the telescopic body 41. The upper central portion of the turning driving body 50 is coupled with a chain 57 hung by a crane wherein the entire hoisting and clamping apparatus 40 can be suspended by the chain. The structures of the telescopic body 41 and swing bodies 42 and 43 are the same as those of the first embodiment, and hence the explanation thereof is omitted.

Figure 16:
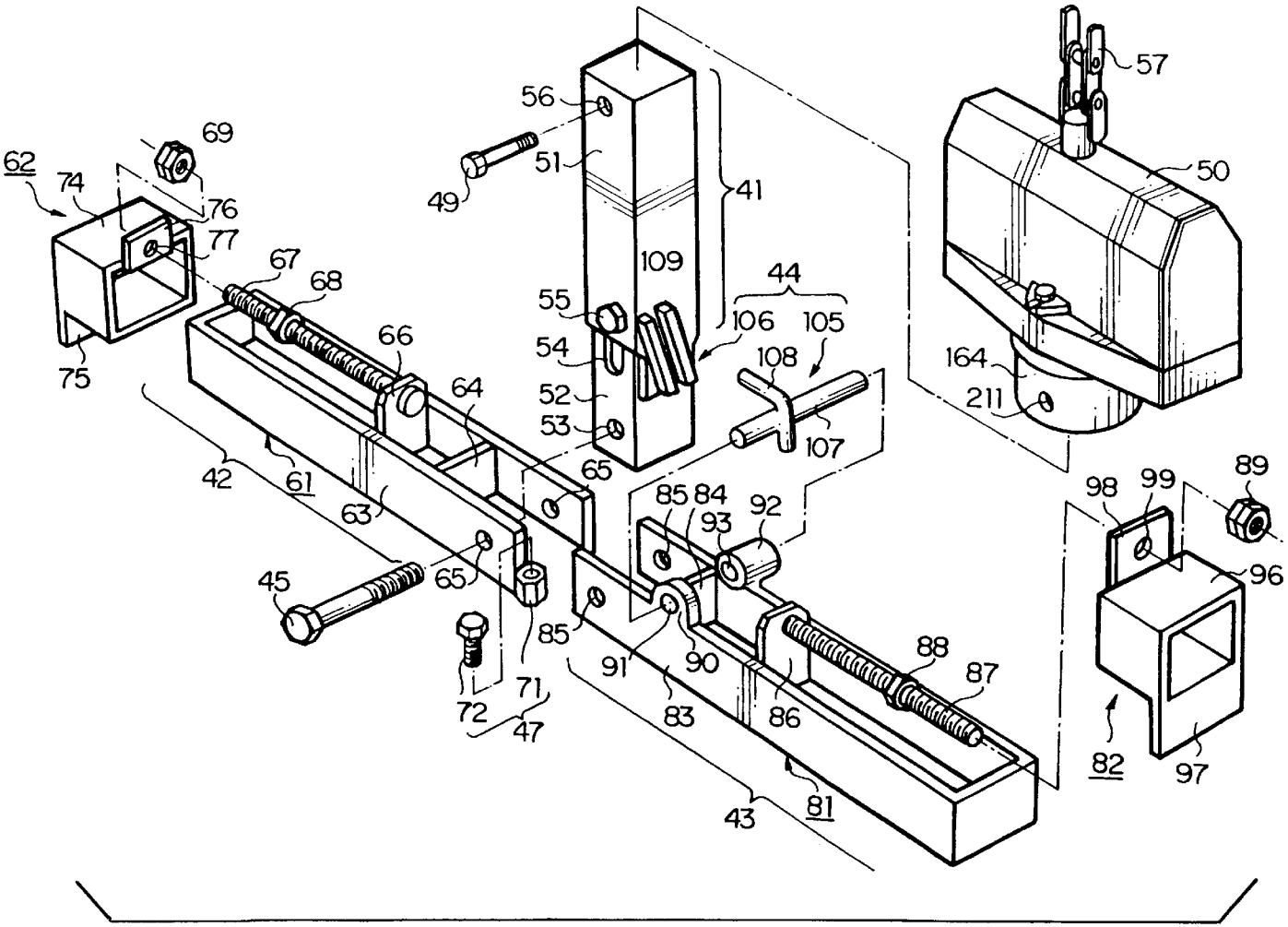

FIG. 16 shows the outer cylinder 51 constituting the telescopic body 41 has a square pipe which is hollow and closed at the upper end thereof. Suspension holes 56 are perforated horizontally in the closed upper side of the outer cylinder 51. The turning driving body 50 arranged above the telescopic body 41 is assembled with the outer cylinder 51 to cover the upper end of the outer cylinder 51 and the suspension pin 49 is inserted into the suspension holes 56 to couple the outer cylinder 51 with the turning driving body 50.

The turning driving body 50 will be now described in detail with reference to FIGS. 17–20.

Figure 17:
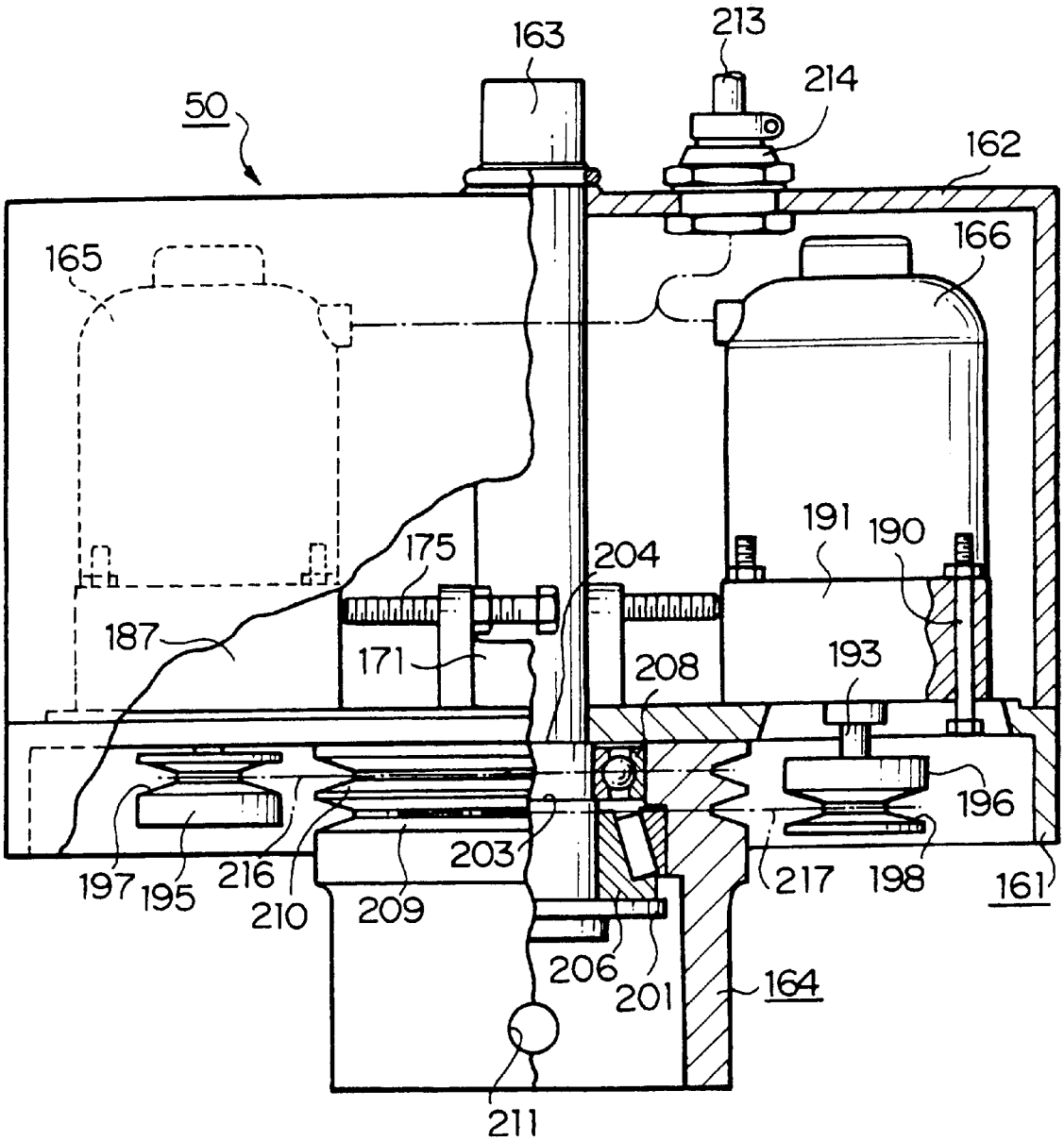

The turning driving body 50 per se is assembled like a unit and mainly comprises a base 161, a cover 162, a suspension shaft 163, a rotary cap 164, and motors 165 and 166. FIG. 17 shows the turning driving body 50 as viewed from a side thereof wherein the right side of the casing is broken away and the internal structure is illustrated.

Figure 18:
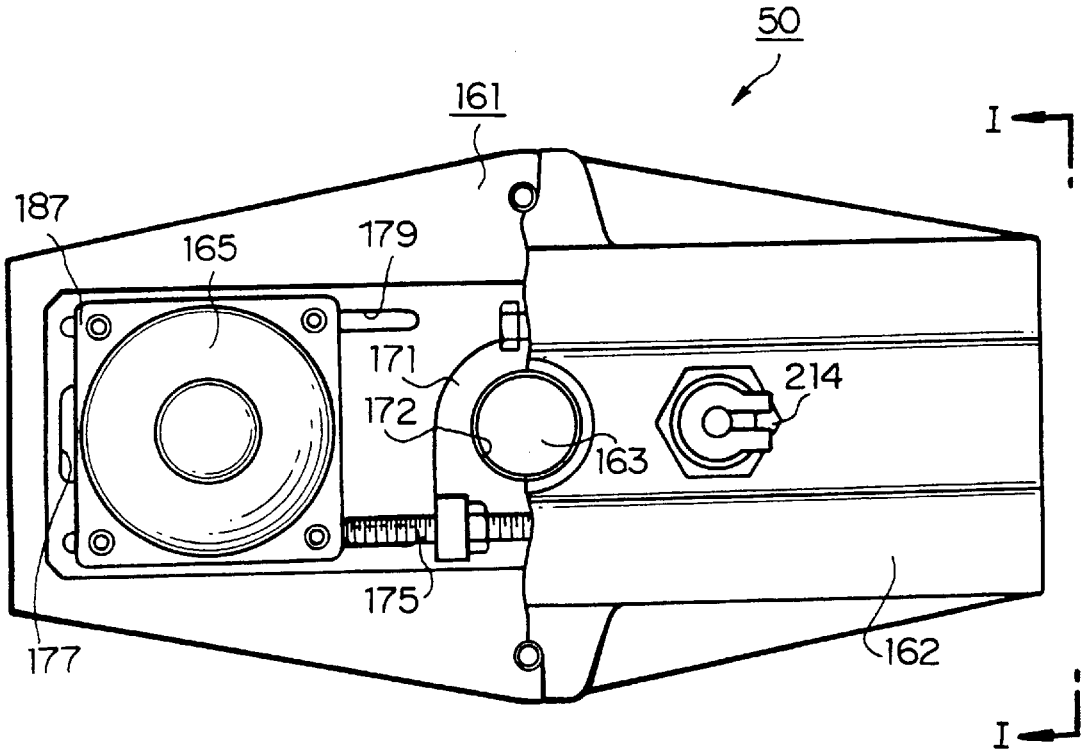
Figure 19:
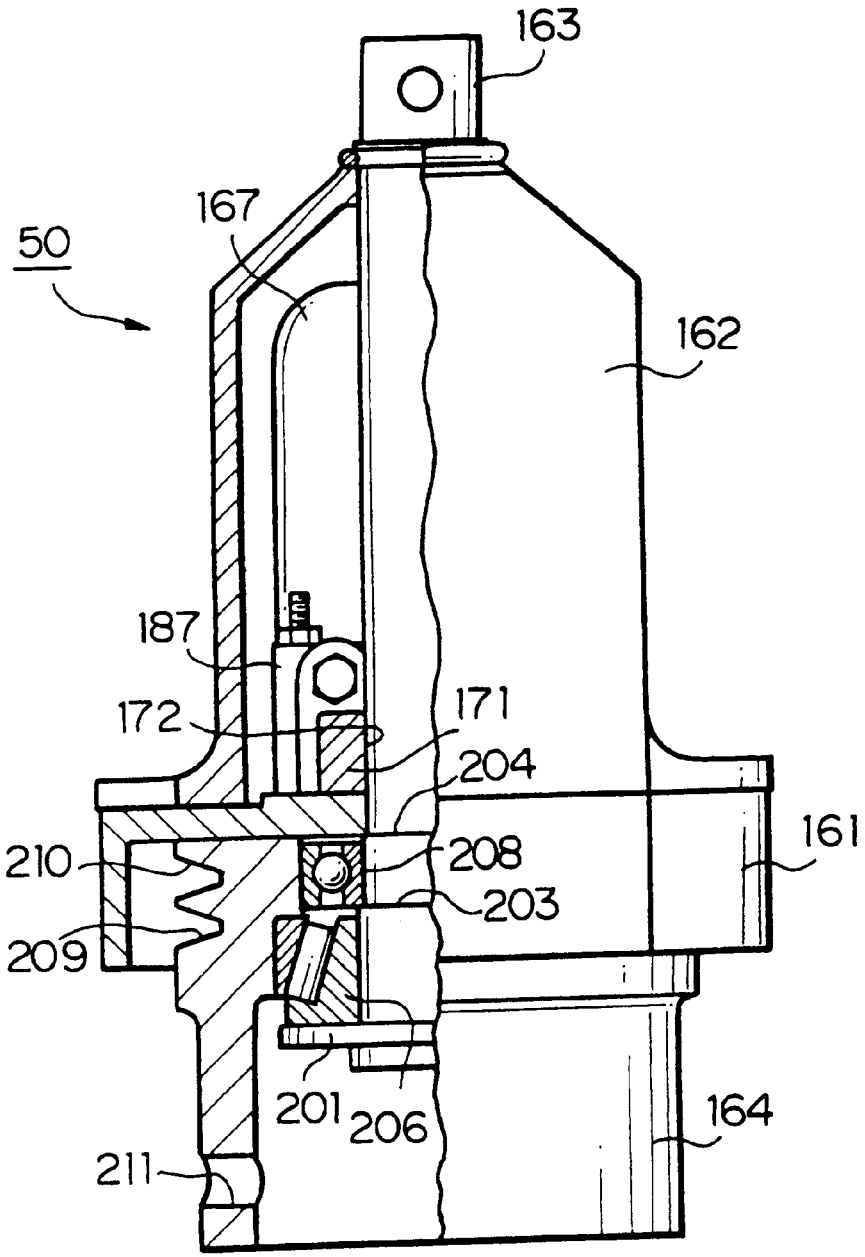
Figure 20:
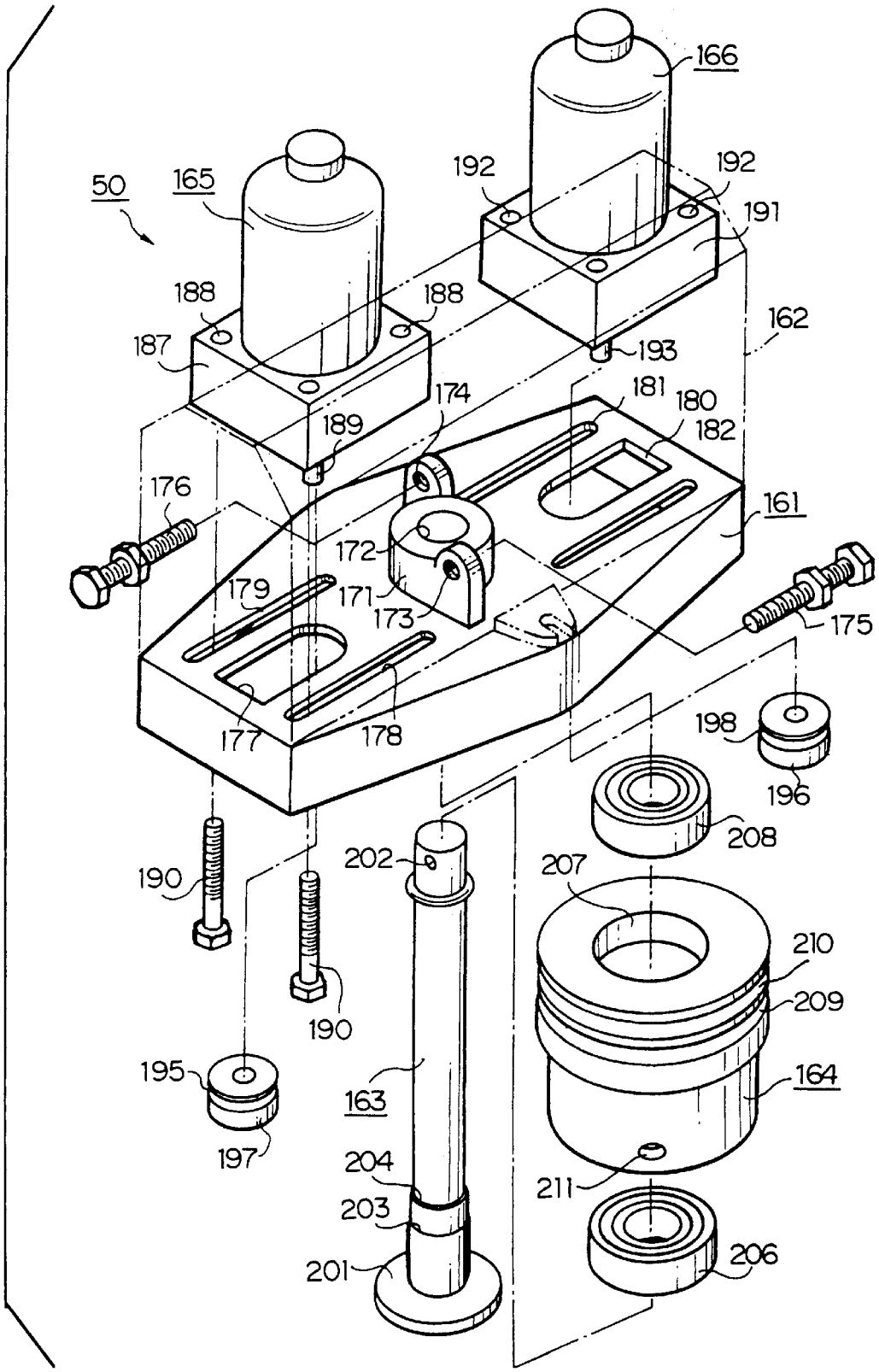

FIG. 18 is a view of the turning driving body 50 as viewed from the upper surface thereof, and FIG. 19 is a view of the turning driving body 50 as viewed from the line I—I in FIG. 18. FIG. 20 is a perspective exploded view wherein the components of the turning driving body 50 are shown.

The base 161 supporting the entire turning driving body 50 is formed of, for example, a high stress resistant material. The central portion of the base 161 has a thin flat shape and the periphery of the base 161 is encircled with a skirt, and has an inverted flat. The plan view of the base 161 is shown in FIG. 18 wherein the left and right portions thereof are parallel with each other and the upper and lower portions thereof are enlarged at the center thereof, namely, the base 161 has a modified hexagonal shape. The cover 162 has a box shape wherein it is hollow at the inside and opened at the lower portion, and it is assembled with the base 161 by bringing the lower opening thereof into contact with the upper surface of the base 161. The cover 162 has a thin thickness and can form a large hermetic space inside thereof by integrating with the base 161.

As shown in FIG. 17, a pair of motors 165 and 166 are mounted on the upper surface of the base 161. The entire hoisting and clamping apparatus 40 can be turned by these motors 165 and 166.

The suspension shaft 163 having a large rod shape perforates the base 161 from the lower center to the upper portion thereof and the upper end of the suspension shaft 163 protrudes from the upper center of the cover 162. The rotary cap 164 is rotatably retained by the lower portion of the suspension shaft 163 so as to be positioned at the lower surface of the base 161, and it is largely opened at the lower center thereof. A coupling hole 211 is perforated in the lower side surface of the rotary cap 164 in the horizontal direction. A cable presser 214 is provided on the upper surface of the cover 162 at a portion close to the suspension shaft 163 and a cable 213 for supplying electric power to the motors 165 and 166 is fixed to the cable presser 214.

As explained above, the base 161 is a modified hexagonal shape wherein a pair of confronting central side portions protrude and the thickness thereof is thin and it has a skirt-shaped wall surface directing downward at the periphery thereof. A thicker shaft portion 171 which is substantially cylindrical and protrudes vertically is provided integrally with the upper surface of the base 161.

The thick wall surfaces or flanges are formed on the right and left surfaces of the shaft portion 171 (right front side and left innermost side in FIG. 20) and screw holes 173 and 174 are defined in each wall surface. The axes of the screw holes 173 and 174 are directed to conform to the longitudinal direction of the base 161. A substantially arch-shaped motor hole 177 is defined vertically in the base 161 at the left central portion thereof and long holes 178 and 179 are defined adjacent the motor hole 177 at the right and left thereof to be parallel with each other. Likewise, another substantially arch-shaped motor hole 180 is defined in the base 161 at the right central portion thereof and long holes 181 and 182 are defined at the right and left thereof to be parallel with each other. These long holes 178 and 179 and 181 and 182 are arranged so that their axes are parallel with each other.

The motor 165 has a hemispherical cylindrical shape at the upper portion thereof and a square block shaped gear box 187 is coupled and supports the lower portion of the motor 165. Screw holes 188 are defined in the gear box 187 at four corners thereof and an output shaft 189 serving as a driving source protrudes downward from the central lower surface of the gear box 187. Likewise, a square block shaped gear box 191 is coupled with the lower portion of the motor 166. Screw holes 192 are defined in the gear box 191 at four corners thereof and an output shaft 193 serving as a driving source protrudes downward from the central lower surface of the gear box 191. To fix the motor 165 to the base 161, the output shaft 189 is inserted into the motor hole 177 and the screw holes 188 are conformed to the long holes 178 and 179. Thereafter, the screws 190 are screwed into the screw holes 188 through the long holes 178 and 179, thereby fixing the gear box 187 to the base 161. Likewise, the motor 166 can be also fixed to the base 161.

The adjusting screw 175 is screwed into the screw hole 173 while the screw 176 is screwed into the screw hole 174, and when the adjusting screws 175 and 176 are turned, the adjusting screws 175 and 176 can be adjusted relative to the screw holes 173 and 174. The side surface of the gear box 187 contacts the tip end of the screw 175, and the position of the gear box 187 is moved in the longitudinal direction of the long holes 178 and 179 and can be finely adjusted in the position thereof by turning the adjusting screw 175. Likewise, the side surface of the gear box 191 contacts the tip end of the adjusting screw 176 and the position of the gear box 191 is moved in the longitudinal direction of the long holes 181 and 182, and can be finely adjusted in the position thereof by turning the adjusting screw 176. When the positions of the gear boxes 187 and 191 are finely adjusted, tension of a belt, described later, can be adjusted.

A pulley 195 is fixed to the output shaft 189 as it protrudes downward from the motor hole 177, and the output shaft 189 and the pulley 195 rotate at the same time. A belt groove 197 is cut around the periphery of the pulley 195. Likewise, a pulley 196 is fixed to the output shaft 193 as it protrudes downward from the motor hole 180, and the output shaft 193 and the pulley 196 rotate at the same time. A belt groove 198 is cut around the periphery of the pulley 196.

The suspension shaft 163 is formed as a long round rod and has a durability capable of supporting the hoisting and clamping apparatus 40 and the heavy object. The outer periphery of the suspension shaft 163 is cylindrical and has a disc shaped flange 201 of large diameter integrally fixed to the lower end thereof. Two shoulders 203 and 204 are formed vertically on the lower outer periphery of the suspension shaft 163 slightly above the disc shaped flange 201. A through hole 202 is defined in the upper portion of the suspension shaft 163 at a position slightly lower than the upper end thereof so as to be perpendicular to the axis of the suspension shaft 163.

The rotary cap 164 is thin in wall thickness at the lower part thereof and is thick at the upper part thereof to form a cylindrical drum. An opening 207 is defined in the upper central portion of the rotary cap 164 and it is smaller than the opening defined in the lower portion of the rotary cap 164, wherein the rotary cap 164 is vertically penetrated by the opening 207.

The cross section of the rotary cap 164 is illustrated in FIG. 19. Belt grooves 209 and 210 are defined vertically in the rotary cap 164 at the upper periphery thereof so as to encircle the rotary cap 164. A coupling hole 211 is perforated in the lower side of the rotary cap 164 in the manner that the axis of the coupling hole 211 is perpendicular to that of the rotary cap 164.

A thrust bearing 206 for rotatably supporting a vertical load is arranged on the rotary cap 164 at the lower surface thereof. A bearing 208 for keeping the circumferential rotation in good condition is arranged on the rotary cap 164 at the upper portion thereof. The inner diameter of the thrust bearing 206 is set to be substantially the same as the outer diameter of the suspension shaft 163 under the shoulder 203 and the outer diameter of the thrust bearing 206 is set to be the same as the inner diameter of the lower opening of the rotary cap 164. The inner diameter of the bearing 208 is set to be substantially the same as the outer diameter of the suspension shaft 163 between the shoulders 203 and 204, and the outer diameter of the bearing 208 is set to be substantially the same as the inner diameter of the opening 207. The suspension shaft 163 and rotary cap 164 can be rotatably assembled via the bearings 208 and 206.

As shown in FIG. 20, the thrust bearing 206 is inserted onto the suspension shaft 163 from the upper end of the suspension shaft 163 and the lower surface of the thrust bearing 206 is brought into contact with the disc shaped flange 201. The lower opening of the rotary cap 164 is inserted onto the suspension shaft 163 from the upper end of the suspension shaft 163 and the outer periphery of the thrust bearing 206 is brought into contact with the lower opening of the rotary cap 164. Thereafter, the bearing 208 is inserted onto the suspension shaft 163 from the upper end thereof and the inner diameter lower part of the bearing 208 is retained by the shoulder 203, and the outer periphery of the bearing 208 is brought into contact with the inner periphery of the opening 207. With such an arrangement, the thrust bearing 206 is retained by the disc shaped flange 201, and the bearing 208 is retained by the shoulder 203, thereby preventing the bearings 206 and 208 from contacting each other.

The thrust bearing 206 is retained by the internal stage of the rotary cap 164 and the load of the rotary cap 164 is supported by the thrust bearing 206 and the peripheral direction of the rotary cap 164 is supported by the bearing 208.

If the thrust bearing 206, rotary cap 164 and bearing 208 are incorporated with the suspension shaft 163 in this order, the suspension shaft 163 is inserted into a shaft hole 172 at the upper end thereof from the lower part to the upper part of the shaft hole 172. Then, the lower surface of the base 161 is retained by the shoulder 204 of the suspension shaft 163 and it can not be inserted at the position over this position so that the base 161 is supported by the shoulder 204. At this state, the head of the suspension shaft 163 protrudes from the upper central portion of the cover 162 which is illustrated in FIG. 19. In this state, if the upper part of the suspension shaft 163 is hoisted by a crane, etc., the base 161 is retained by the shoulder 203 and is suspended and the rotary cap 164 is rotatably held by the bearings 208 and 206.

Accordingly, although the base 161 and the suspension shaft 163 do not turn, the rotary cap 164 can smoothly turn circumferentially relative to the suspension shaft 163. The load applied to the rotary cap 164 is supported by the thrust bearing 206, and hence it is held to be smoothly rotated even if it is pulled down with large force.

Figure 21:
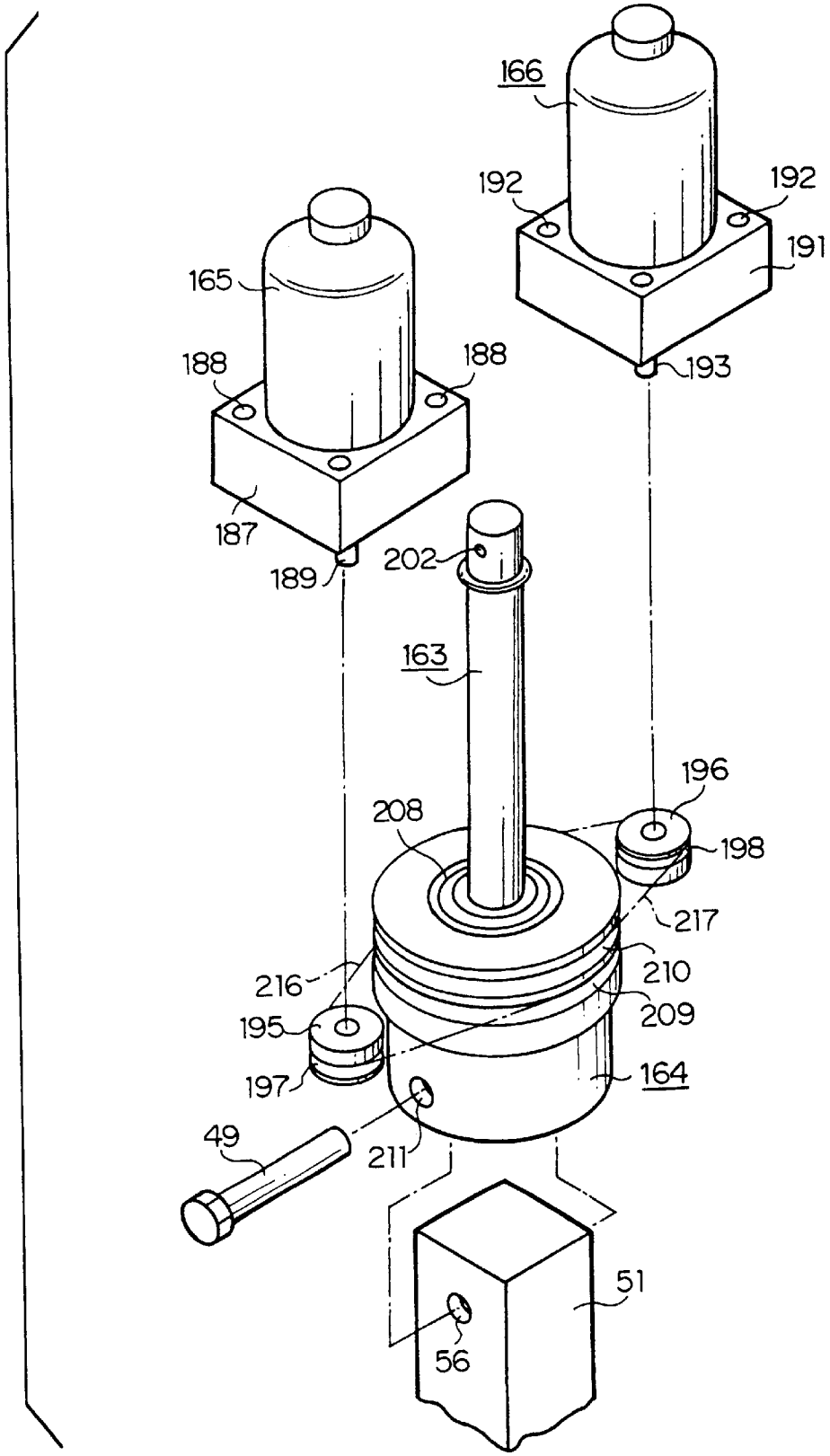

FIG. 21 is a view explaining the components of the driving system of the invention.

As mentioned above, the rotary cap 164 is incorporated into the suspension shaft 163 via the thrust bearing 206 and bearing 208 wherein the rotary cap 164 is rotatably held by the suspension shaft 163 in the peripheral direction thereof. The outer cylinder 51 is inserted into the rotary cap 164 from the lower opening of the rotary cap 164, and the suspension holes 56 and the coupling hole 211 are conformed to each other in the axes thereof, then the suspension pin 49 is inserted into suspension holes 56 and the coupling hole 211 from the side surface of the rotary cap 164 to connect the outer cylinder 51 with the rotary cap 164. The pulley 195 is coupled with the output shaft 189. The endless belt 216 made of an elastic material such as rubber, nylon, etc. is entrained between the belt grooves 197 and 209 while the endless belt 217 made of an elastic material such as rubber, nylon, etc. is entrained between the belt grooves 198 and 210. In such a manner, the belts 216 and 217 are wound around the rotary cap 164 at the right and left thereof and they are wound around the pulleys 195 and 196. To adjust the tension of the belts 216 and 217, the adjusting screws 175 and 176 shown in FIG. 17 are turned to move the gear boxes 187 and 191 to the right and left. Based on the amount of movement of the gear boxes 187 and 191, the interval between the suspension shaft 163 and output shaft 189 or the interval between the suspension shaft 163 and output shaft 193 is adjusted, thereby finely adjusting the tension between the belts 216 and 217.

Figure 22:
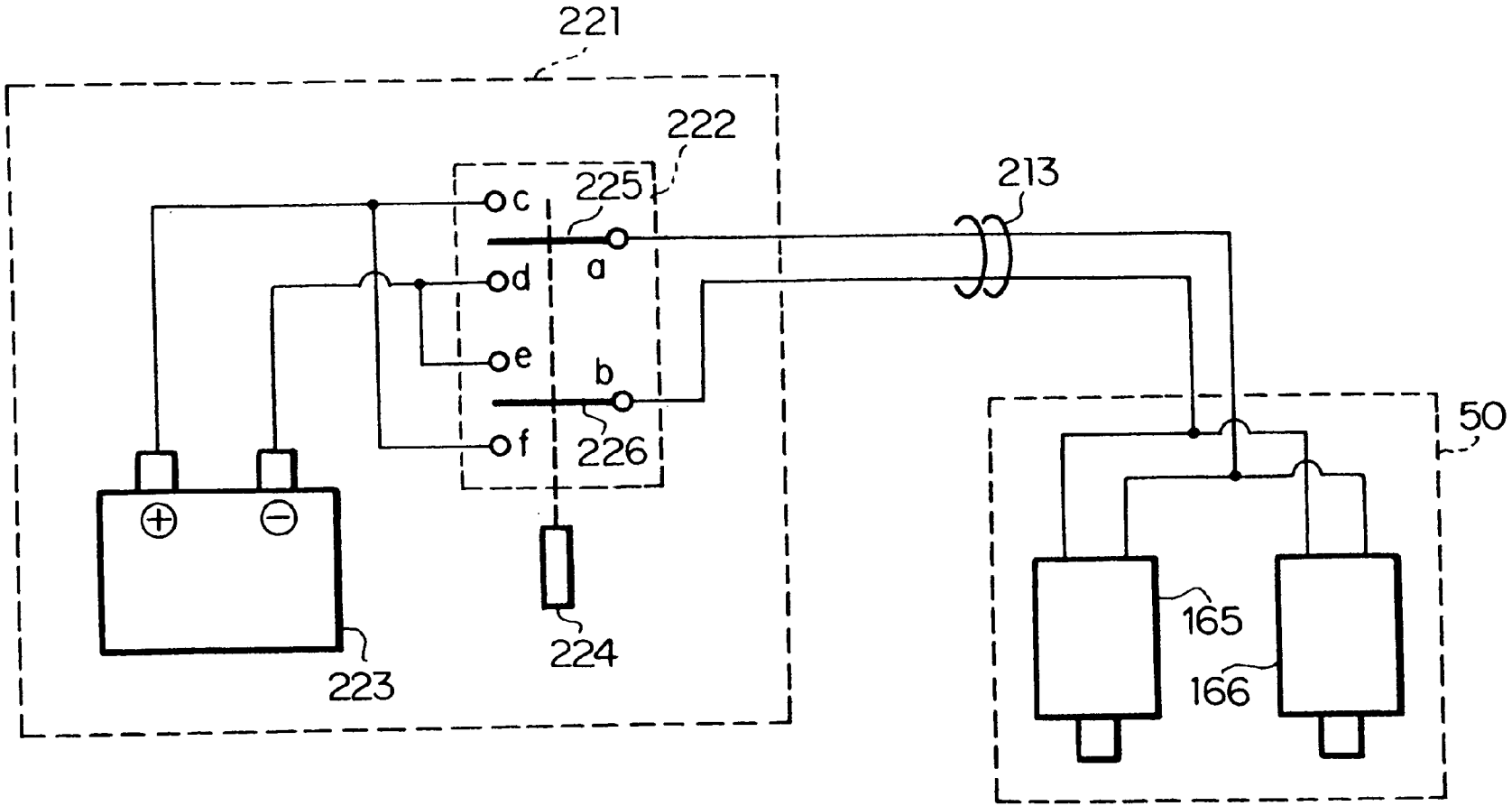

FIG. 22 shows an electric circuit for controlling the turning driving body 50 in the second embodiment. The motors 165 and 166 accommodated in the turning driving body 50 are controlled by direct current voltage and they can be normally or reversely rotated by the difference of the polarity of the DC. The motors 165 and 166 are connected to a power supply cable 213 in parallel therewith. Although not illustrated, a mechanism for controlling the start and direction of rotation of the turning driving body 50 is accommodated in the crane 221 and is operated by an operator, and a selective switch 222 and a battery 223 are accommodated inside the crane 221. The selective switch 222 having two circuits and two contact points is provided at the position close to an operator's room and the two contact points of the selective switch 222 can be switched by an operation button 224. When the button 224 is on or off, a pair of contacts 225 and 226 are operated at the same time and they can be respectively switched to "normal", "neutral" and "reverse" stages. In case of non-operation, the contacts 225 and 226 are in "neutral". One end of the cable 213 is connected with a common terminal a and another end of the cable 213 is connected with a common terminal b. The contact 225 can alternately contact either contact c or d. The contact 226 can alternately contact either of contacts e or f. The contacts c and f are positioned at the anode of the battery 223 while the contacts d and e are connected with the cathode of the battery 223.

As operation to hoist the heavy object W using the hoisting and clamping apparatus 40 of the second embodiment and to horizontally turn the hoisted heavy object W will be now described with reference to FIGS. 23 to 26. The heavy object W is formed of for example a cover or a block body which per se is several kilograms and has no protrusions or grips at the periphery thereof. The heavy object W is thus difficult to be hoisted by manpower.

Figure 23:
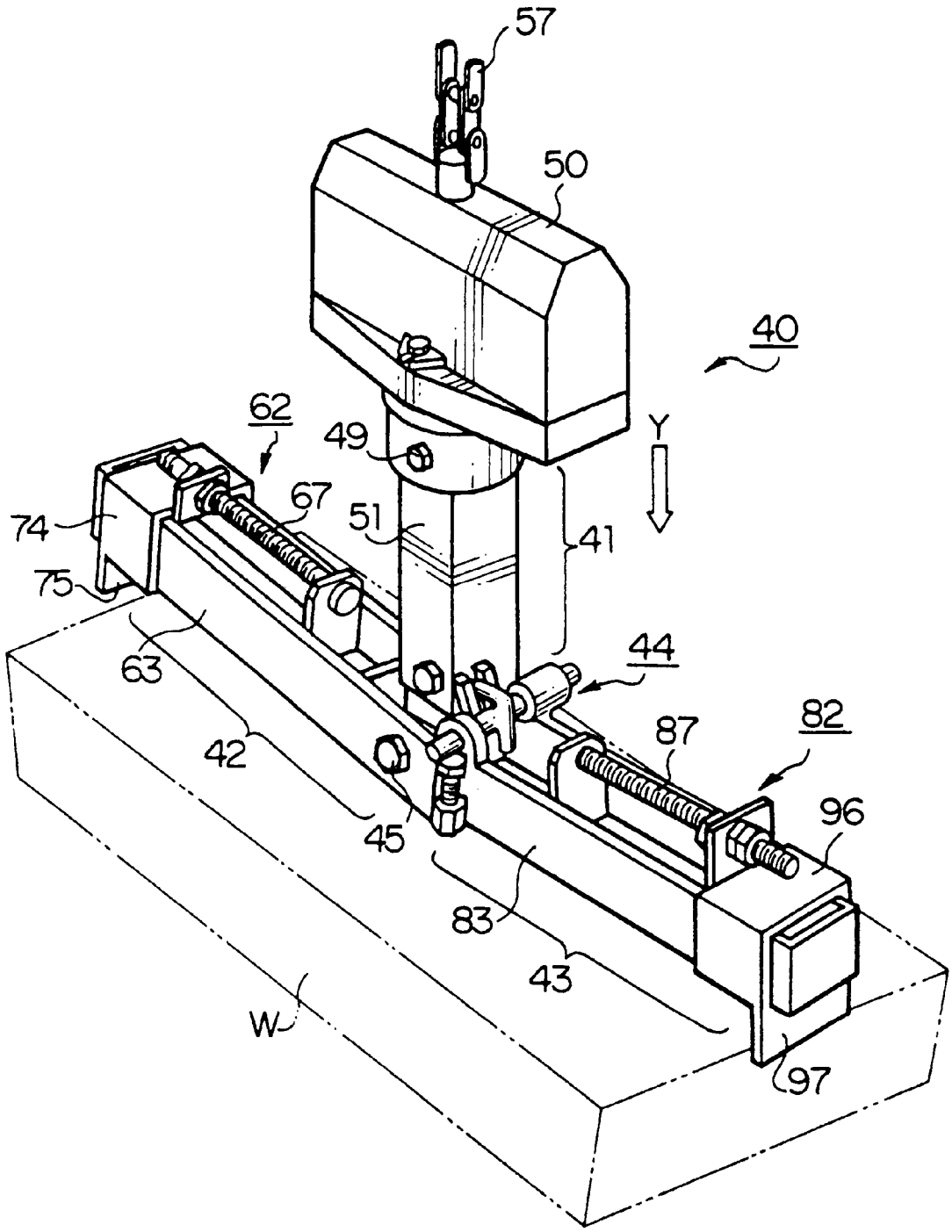
Figure 24:
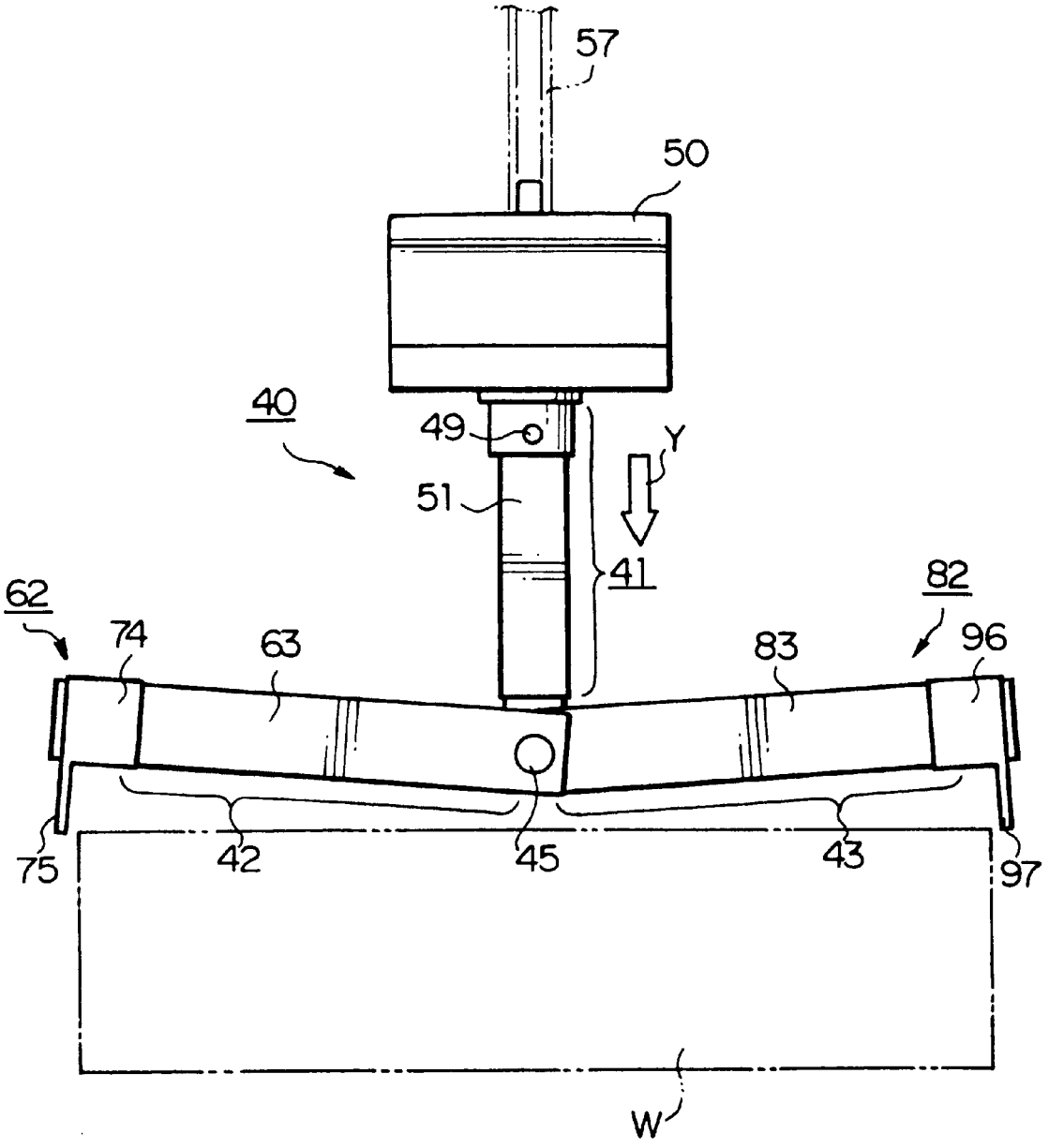

In FIGS. 23 and 24, the heavy object W is horizontally positioned on the ground when the hoisting and clamping apparatus 40 is slowly lowered in the direction Y. The center of the hoisting and clamping apparatus 40 (the position where the telescopic body 41, left swing body 42 and right swing body 43 cross with one another) is moved into contact with the heavy object W, so that the hoisting and clamping apparatus 75 and 97 can grip the heavy object W at the right and left sides thereof. The gripping operation is the same as that of the hoisting and clamping apparatus 40 in the first embodiment.

Figure 25:
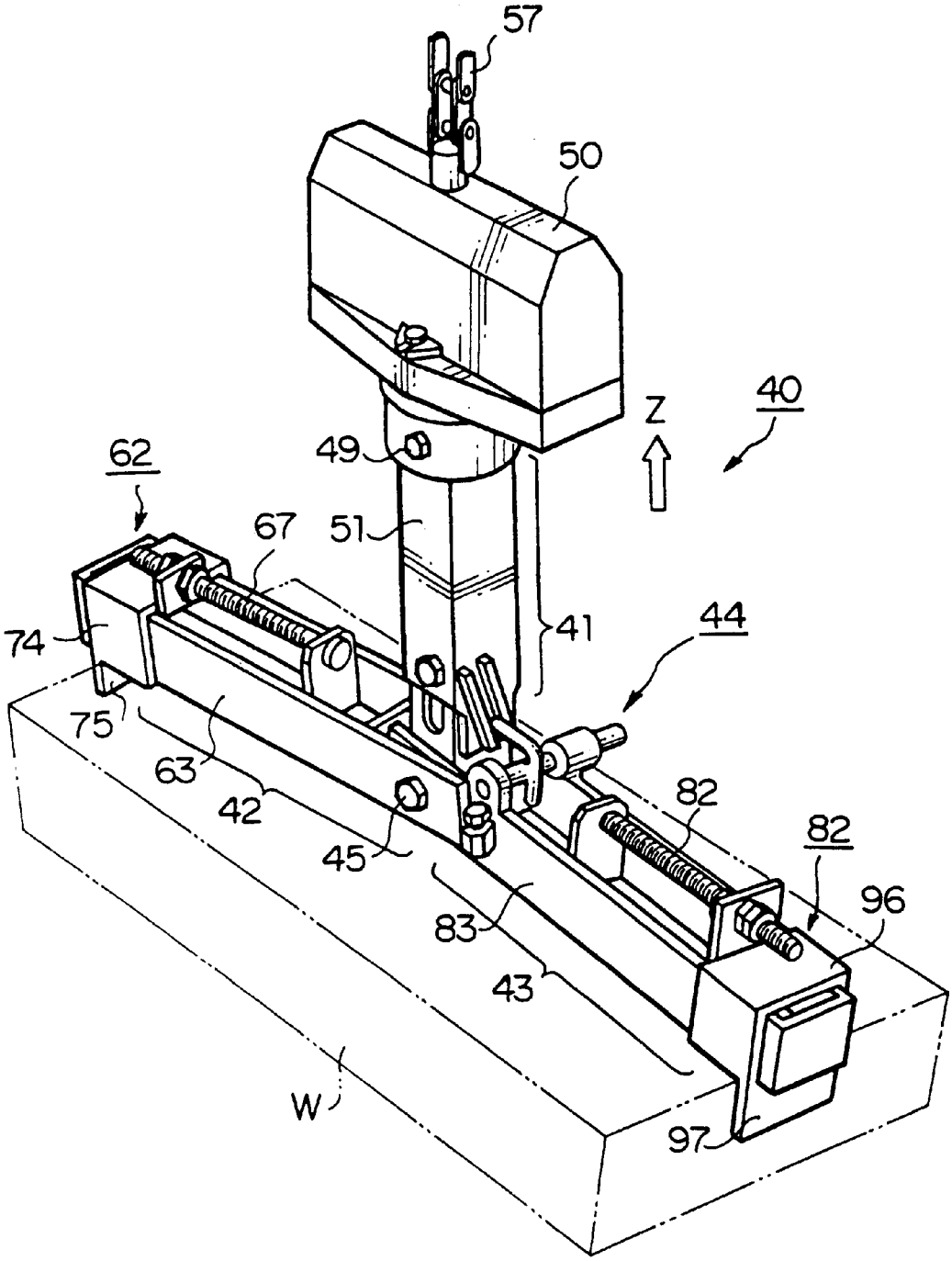
Figure 26:
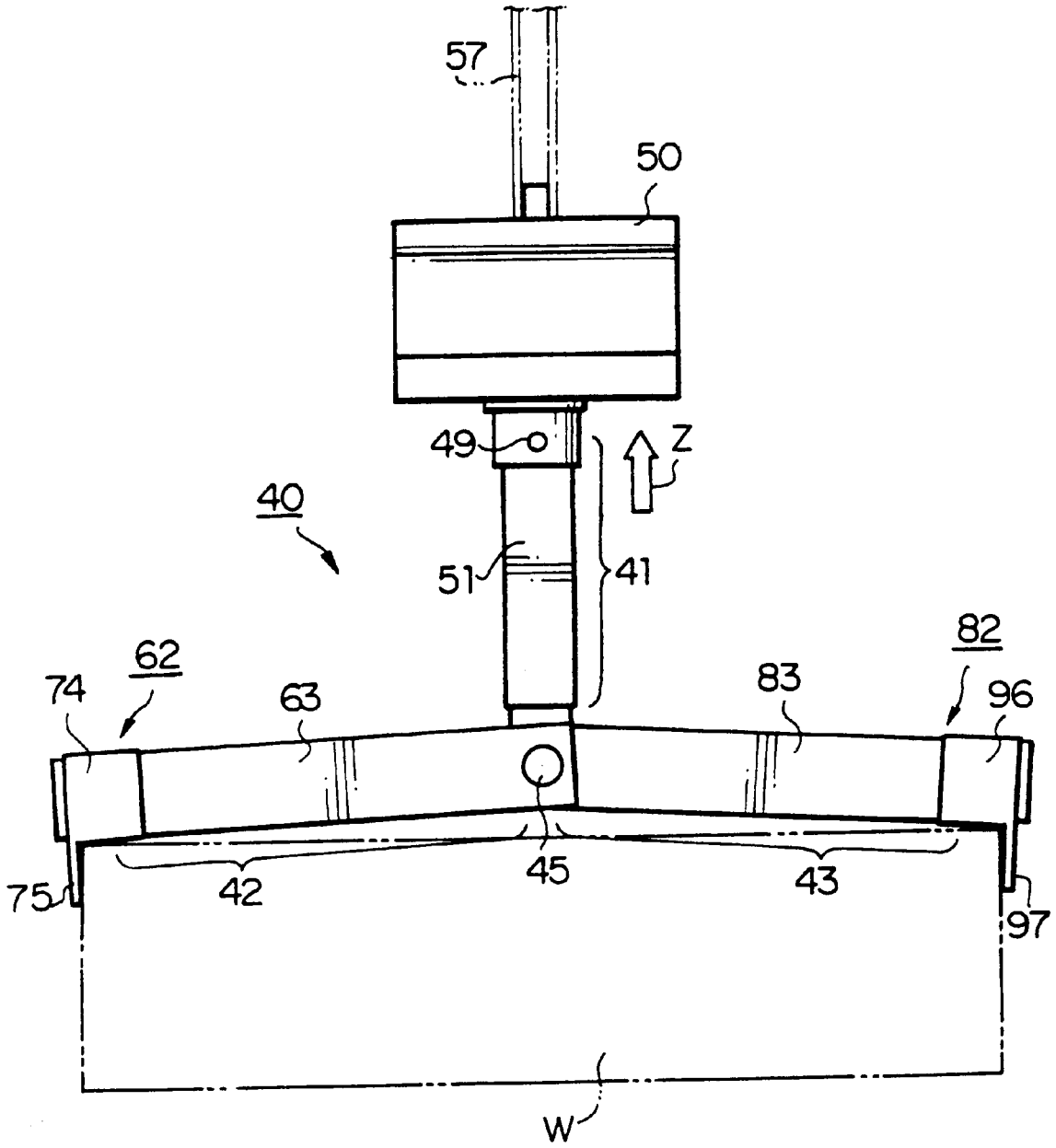

When the telescopic body 41 is pulled out in the direction Z via the drive housing 50 as shown in FIG. 25, after the restriction of the turning of the rail arms 63 and 83 by the closable restriction mechanism 44 is released, the heavy object W is strongly gripped by this pulling force by the contact pressers 75 and 97 and is pulled upward in the direction Z.

Thus the heavy object W is clamped by the contact pressers 75 and 97 from the left and right sides thereof and can be moved to an intended position while it is suspended. Even if the heavy object W is moved, there are many cases where the longitudinal direction of the heavy object W is not aligned or oriented with that of the spot where the heavy object W is to be installed. In such a case, the turning driving body 50 is operated to rotatably move the entire hoisting and clamping apparatus 40 in the horizontal direction, thereby adjusting the longitudinal direction of the heavy object W to conform to that of the spot where the heavy object W is intended to be installed.

The turning operation is manually performed by an operator on the crane. The operator pushes or pulls the operation button 224 while the heavy object is suspended to select the "normal" or "reverse" rotation. First, when the operation button 224 is pushed to select the "normal" rotation, the contact 225 in the "neutral" position contacts the contact c, while the contact 226 in the "neutral" position contacts the contact e. Accordingly, the power from the battery 223 is supplied to the motors 165 and 166 via the cable 213, so that the output shafts 189 and 193 of the motors 165 and 166 are rotated in "normal" rotation in the same direction. Since the pulleys 195 and 196 are fixed to these output shafts 189 and 193, pulleys 195 and 196 are rotated in the same direction and the belt 216 wound around the belt groove 197 of the pulley 195 is drawn to the "normal" rotation and the belt 217 wound around the belt groove 198 of the belt groove 197 is also drawn to the "normal" rotation. Since these belts 216 and 217 are respectively wound around the belt grooves 209 and 210 formed on the outer periphery of the rotary cap 164, the rotary cap 164 is moved in "normal" rotation by the drawing force of both belts 216 and 217.

Since the rotary cap 164 is retained by the thrust bearing 206 and bearing 208 with respect to the suspension shaft 163, the rotary cap 164 can smoothly rotate with respect to the suspension shaft 163 by the drawing force of the belts 216 and 217. Since the outer cylinder 51 is coupled with the lower portion of the rotary cap 164 via the suspension pin 49, the outer cylinder 51 is moved in "normal" rotation, so that the entire hoisting and clamping apparatus 40 and the heavy object W are rotated in the normal direction with the rotation of the outer cylinder 51. When the heavy object W is rotated through a predetermined angle so that the longitudinal direction of the spot to be installed is aligned with that of the heavy object W, the pushed operation button 224 is returned to the "normal" position and the contact 225 is moved away from the contact c and the contact 226 is moved away from the contact e. Accordingly, the power from the battery 223 is not supplied to the cable 213 so that the rotation of the motors 165 and 166 stops. Then, the rotary cap 164 stops its rotation and the hoisting and clamping apparatus 40 and the heavy object W suspended by the outer cylinder 51 stop at that angular position.

To turn the hoisting and clamping apparatus 40 and heavy object W in a direction opposite to the previous manner, the operation button 224 is pulled by the operator to make the operation button 225 contact the contact d and to make the contact 226 contact the contact f. Then, the polarity of the power to be supplied from the battery 223 to the cable 213 is inverted, and hence the inverted power is supplied to the motors 165 and 166. Accordingly, the output shaft 189 of the motor 165 and the output shaft 193 of the motor 166 are rotated in a direction opposite to the previous rotation, and these turning force are transmitted to the rotary cap 164 via the pulleys 195 and 196 and the belts 216 and 217, and hence the rotary cap 164 is reversely rotated. In such a manner, the hoisting and clamping apparatus 40 and the heavy object W suspended by the lower portion of the rotary cap 164 are rotated in the direction opposite to the previous direction so that the heavy object W can be turned horizontally at a necessary angle and the longitudinal direction of the heavy object W can be conformed to that of the spot where the heavy object W is installed.

If the heavy object W is clamped and moved to a given spot, the heavy object W is lowered at that spot to release the gripping of the heavy object W. This can be automatically performed by lowering the chain 57 hung by the crane to thereby lower the hoisting and clamping apparatus 40 as a whole and the heavy object W. That is, the release of gripping of the heavy object W can be automatically performed by lowering the lower surface of the heavy object W to the ground, and the chain 57 is further lowered from this position to thereby move only the turning driving body 50 and outer cylinder 51. This operation is the same as that of the hoisting and clamping apparatus 40 in the first embodiment.

A hoisting and clamping apparatus according to a third embodiment will be now described with reference to FIGS. 27 to 29. This embodiment is used for suspending the block by clamping the block. The block is used for a wall surface or revetment. The shape of the block is not symmetric in right and left thereof.

That is, the object has a shape protruding rearward compared with the right and left lengths thereof, and its center of gravity is displaced from the alignment between the pair of swing arms. With the hoisting and clamping apparatus according to this third embodiment, it is possible to automatically clamp, and hoist the block which has a displaced center of gravity by swing arms which are extended horizontally in three directions.

Figure 27:
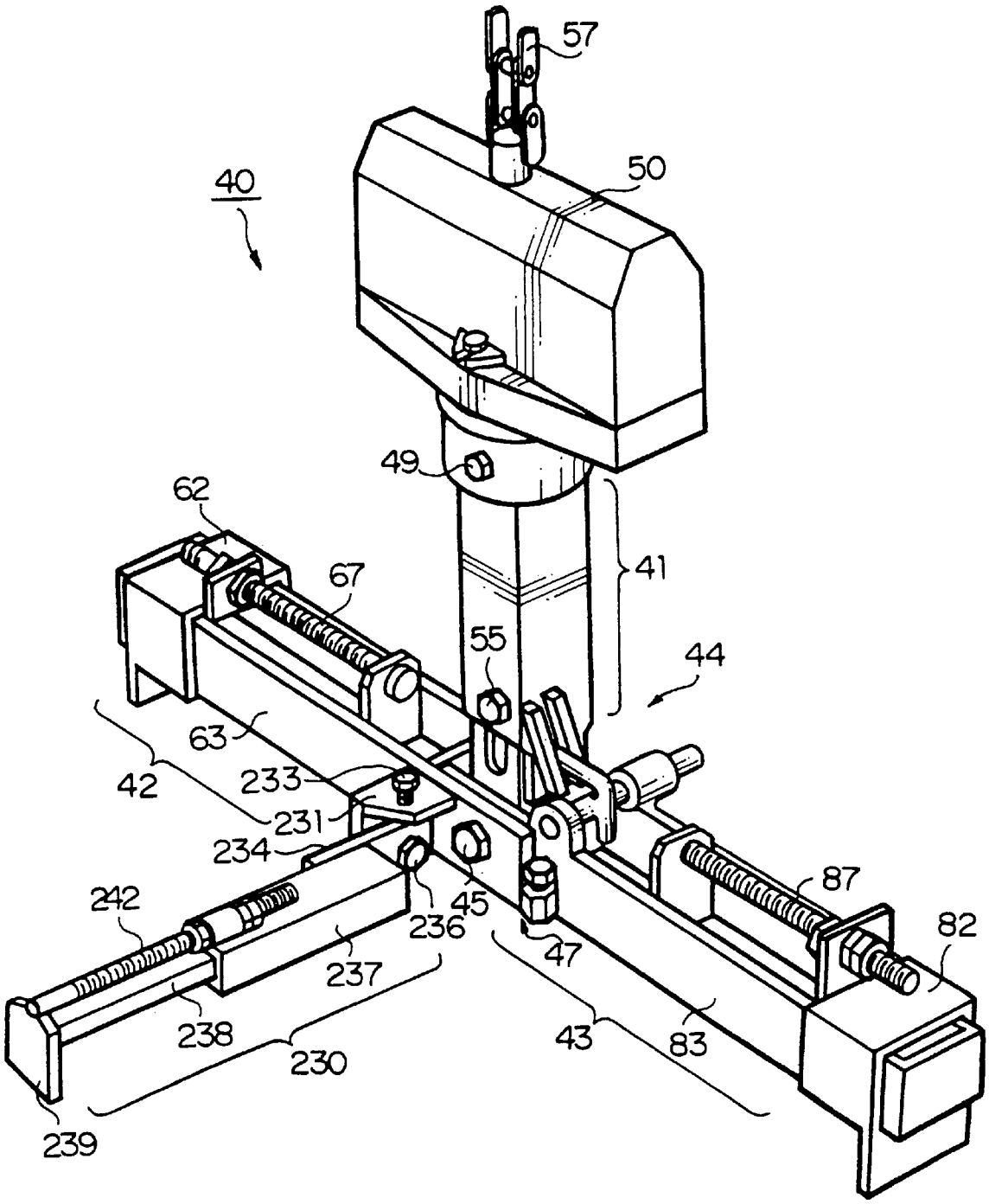

FIG. 27 is a view showing a state where the hoisting and clamping apparatus 40 of the third embodiment is assembled. The hoisting and clamping apparatus 40 of the third embodiment is the same as that shown in FIGS. 14 to 26 except that a mechanism for supporting the weight of the rear portion of the block is added. Accordingly, the components which are the same as the hoisting and clamping apparatus 40 as shown in FIGS. 14 to 26 are denoted by the same numerals and explanation thereof is omitted.

In this third embodiment, the hoisting and clamping apparatus 40 adds an auxiliary swing body 230 to the hoisting and clamping apparatus 40 as shown in FIGS. 14 to 26 and includes the telescopic body 41, left swing body 42, right swing body 43 and the turning driving body 50. FIG. 27 is a perspective view showing the hoisting and clamping apparatus which is assembled, and FIG. 28 is an exploded perspective view showing the main constitutions thereof. A supporting angle 231 for supporting the auxiliary swing body 230 is fixed to the tip end side surface of the rail arm 63 (right front side in FIG. 27 and close to the through pin 45) by welding, etc. The supporting angle 231 has an L-shape cross section and it is arranged in the manner that the upper surface thereof is flat and the side surface thereof is vertically arranged. The auxiliary swing body 230 is coupled with the side surface of the supporting angle 231 so as to be vertically swingable. If the hoisting and clamping apparatus 40 is viewed from above, it is arranged as if it forms a T-shape as defined by the left swing body 42, right swing body 43 and auxiliary swing body 230. Since the auxiliary swing body 230 is vertically swingable by the supporting angle 231 and the left swing body 42 and right swing body 43 are structured to be vertically swingable by the through pin 45, the hoisting and clamping apparatus 40 is assembled to grip the object positioned thereunder like chuck claws from the three directions thereof.

Figure 28:
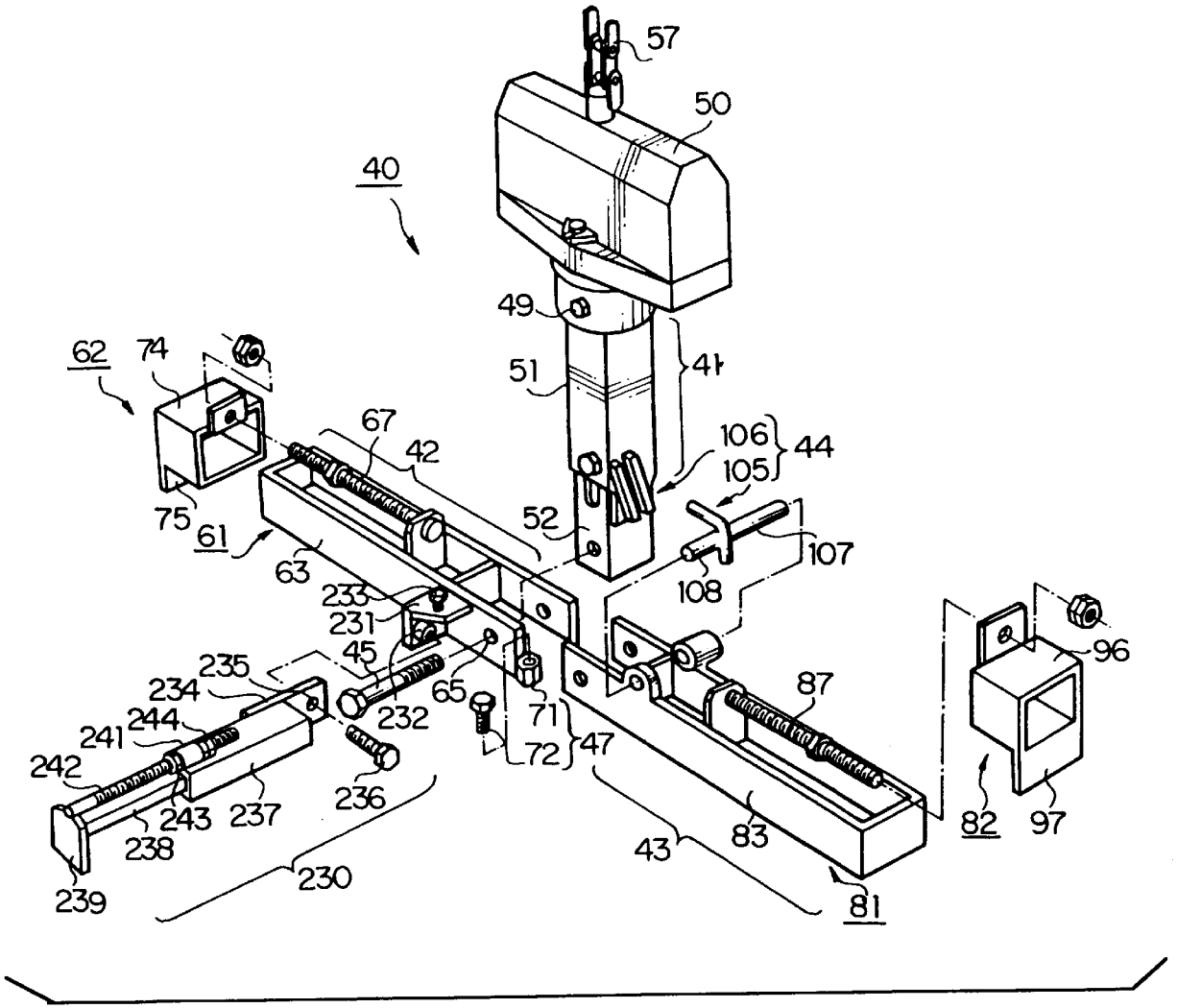
Figure 29:
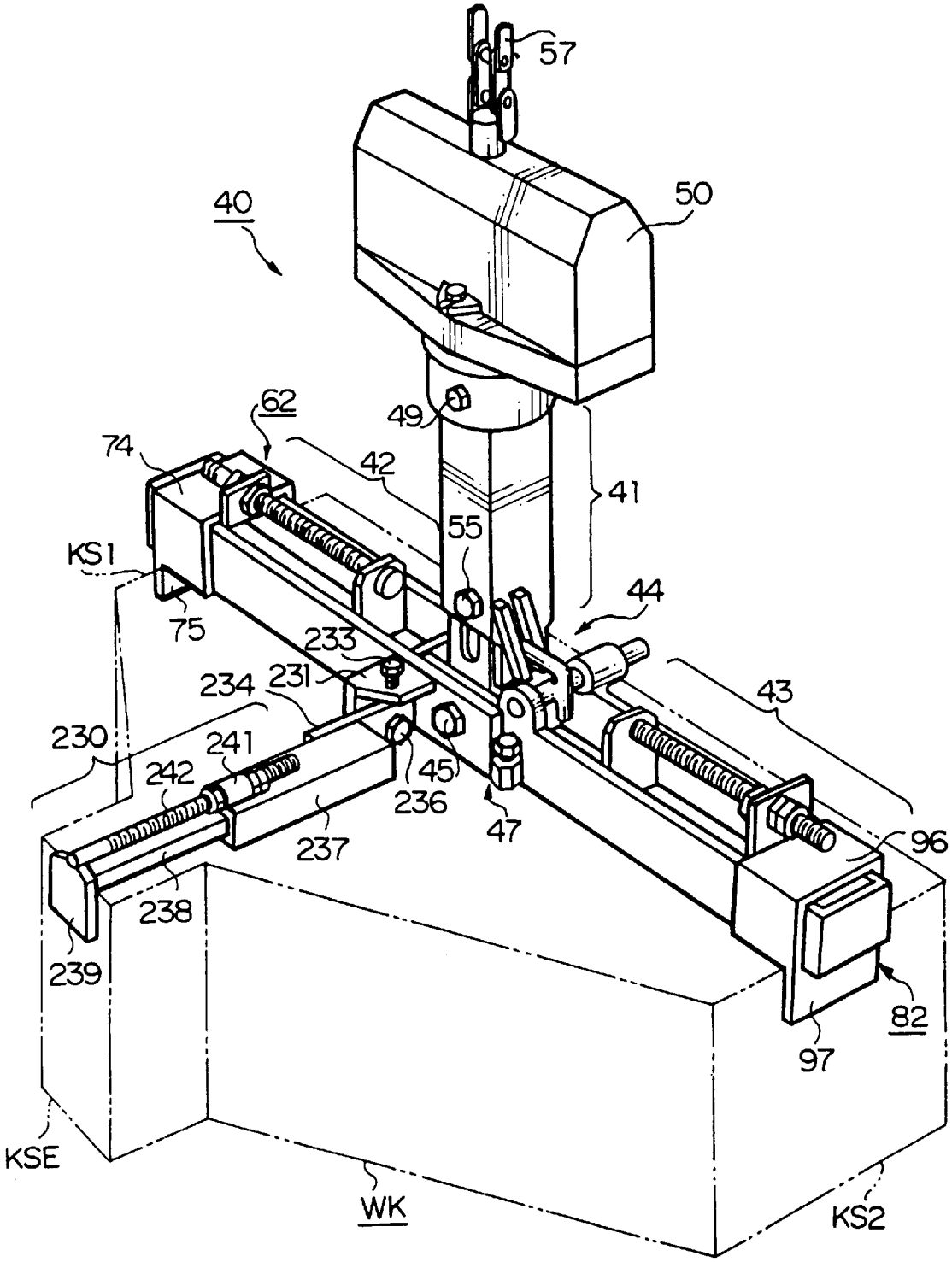

The supporting angle 231 is illustrated in detail in FIG. 28, wherein it is fixed to the tip end side surface of the rail arm 63 constituting the left swing body 42. The supporting angle 231 has an L-shape in cross section and it is fixed to the side surface of the rail arm 63 by welding, etc. The supporting angle 231 is positioned horizontally at the upper surface thereof and a lowering adjusting bolt 233 is screwed into the central portion of the flat upper surface thereof so as to move forward or backward, and the side surface of the shaft supporting angle 231 is vertically positioned and a screw hole 232 is defined in the central portion of the side surface.

The auxiliary swing body 230 mainly comprises an auxiliary arm 234, a pipe arm 237, a slide bar 238, a contact presser 239, and a long bolt 242. The auxiliary arm 234 has a long thin shape and a pin hole 235 is defined in the tip end of the auxiliary arm 234 (innermost right side directed to the rail arm 63 in FIG. 28). The pipe arm 237 has a long square piped shape and is hollow, and it is opened at both ends thereof. The auxiliary arm 234 is fixed to the tip end of the pipe arm 237 (innermost right side in FIG. 28) and the pipe arm 237 and the auxiliary arm 234 are linearly arranged. A through pipe 241 having a small diameter is fixed to the upper surface of the rear end of the pipe arm 237 (left front side in FIG. 28), and the axis of the through pipe 241 is conformed to the longitudinal direction of the pipe arm 237.

The slide bar 238 has a rod shape in cross section and the outer diameter of the slide bar 238 is substantially the same as that of the inner diameter of the pipe arm 237 in cross section. The contact presser 239 having a square shape is fixed to the tip end of the slide bar 238, and the plane surface of the slide bar 238 is arranged to be perpendicular to the axis of the slide bar 238, and most of the plane surface of the slide bar 238 is directed to protrude downward. The rear end of the long bolt 242 is fixed to the contact presser 239 and the axis of the long bolt 242 is arranged in parallel with that of the slide bar 238.

The above components are assembled to form the auxiliary swing body 230 in the following manners. First, a nut 243 is screwed onto the through pipe 241 and it is arranged in an appropriate position. The tip end of the slide bar 238 is inserted into the opening of the pipe arm 237 while the tip end of the long bolt 242 is inserted into the opening of the through pipe 241. The outer diameter of the slide bar 238 is substantially the same as the inner diameter of the pipe arm 237, there is no play between the slide bar 238 and the pipe arm 237 so that the former can be smoothly inserted into the latter. A nut 244 is screwed onto the long bolt 242 from the tip end thereof after the long bolt 242 is inserted into the through pipe 241, so that long bolt 242 is fixed to the through pipe 241 by the nut 243 and the nut 244. Since the long bolt 242 is coupled with the slide bar 238 via the contact presser 239, if the long bolt 242 is fixed to the through pipe 241, the slide bar 238 is fixed to the pipe arm 237 and both nuts 243 and 244 are fastened to fix the slide bar 238 to the pipe arm 237 so that the entire length of the auxiliary swing body 230 can be determined. To adjust the length of the auxiliary swing body 230, the nuts 243 and 244 are loosened to move the long bolt 242 away from the through pipe 241 and the nuts 243 and 244 are fastened again in the position where the long bolt 242 is moved toward or away from the through pipe 241.

Next a set screw 236 is inserted into the pin hole 235 defined in the tip end of the auxiliary arm 234 and then inserted into the screw hole 232 defined in the supporting angle 231. Owing to this set screw 236, the auxiliary arm 234 can swing vertically relative to the supporting angle 231 and the entire auxiliary swing body 230 can swing vertically relative to the side surface of the rail arm 63. Although the auxiliary arm 234 can swing vertically relative to the supporting angle 231, due to the set screw 236, the lowering adjusting bolt 233 is screwed into the upper surface of the supporting angle 231 at the upper surface thereof, the upper tip end of the auxiliary arm 234 contacts the lower end of the lowering adjusting bolt 233. Then, the auxiliary arm 234 cannot turn downward beyond the position where it contacts the lowering adjusting bolt 233, and this angular position becomes the lowest position where the auxiliary arm 234 lowers downward. The lowest position of the auxiliary arm 234 becomes a closed angle and the position where the closed angle is formed can be adjusted by turning the lowering adjusting bolt 233. A closed angle where the auxiliary swing body 230, namely, the pipe arm 237, the slide bar 238 and the contact presser 239, lowers downward beyond the horizontal position can be finely adjusted by the lowering adjusting bolt 233.

An operation of the hoisting and clamping apparatus according to the third embodiment of the invention will be now described with reference to FIG. 29. There is explained in FIG. 29 that the contact pressers 75, 97 and 239 clamp a block WK. The block WK is thick in its thickness and has a trapezoidal shape like a chessman when viewed from the above, and the position of the center of gravity is displaced from the center thereof. The left and right side surfaces KS1 and KS2 of the block WK are parallel with each other and a rear end KSE protrudes in slightly triangular shape. If the block WK having such a shape is clamped and hoisted by the hoisting and clamping apparatus 40, the hoisting and clamping apparatus 40 is suspended by a chain 57 hung by a crane, the left swing bodies 42 and 43 are lowered on the upper surface of the block WK while they are opened, then the rear end KSE of the block WK is caught by the contact presser 239 and the contact presser 75 is positioned at the left side KS1 and the contact presser 97 is positioned at the right side surface KS2.

Even after the lower surfaces of the rail arms 63 and 83 and the pipe arm 237 are brought into contact with the upper surface of the block WK, the chain 57 is lowered to operate in the manner that the inner cylinder 52 is pushed into the outer cylinder 51, then the outer cylinder 51 is pulled out from the inner cylinder 52 by lifting the chain 57 to extend the telescopic body 41 as a whole, so that the restriction of the turning of the left swing bodies 42 and 43 by the closable restriction mechanism 44 is released. Accordingly, when the hoisting and clamping apparatus 40 is hoisted again by the chain 57, the left swing bodies 42 and 43 are turned downward about the pin 45, and the contact presser 75 is brought into contact with the side surface KS1, the contact presser 97 is brought into contact with the side surface KS2 and both sides of the block WK are brought into contact with and clamped by left swing bodies 42 and 43 due to the turning force of the left swing bodies 42 and 43. Simultaneously with this operation, the contact presser 239 is brought into contact with the rear end KSE, and the auxiliary swing body 230 is turned downward about the set screw 236 at the same time when the left swing bodies 42 and 43 are lifted by the telescopic body 41 so that the longitudinal directions of the pipe arm 237 and slide bar 238 are acute with respect to the surface of the block WK and inclined. Then, the force to be lifted upward by the set screw 236 is diverted to draw the pipe arm 237 and slide bar 238 toward the set screw 236 so that the contact presser 239 is strongly brought into contact with the rear end KSE. Accordingly, the left and right sides, and rear end of the block WK are respectively clamped by the contact pressers 75, 97 and 239 at the three directions thereof so that the block WK is hoisted by the friction generated between each side surface of the block WK and the contact pressers 75, 97 and 239, when the entire hoisting and clamping apparatus 40 is lifted by the chain 57 and block WK is clamped at each surface thereof and is hoisted.

If the block WK hoisted by the hoisting and clamping apparatus 40 is to be moved by the crane to a specific spot, it is turned horizontally by the turning driving body 50 to make the installing spot conform to the longitudinal direction of the block WK, then the block WK is installed on the ground. To release the clamping of the block WK by the hoisting and clamping apparatus 40, the chain 57 is still lowered after the lower surface of the block WK contacts the ground to thereby lower the turning driving body 50 and outer cylinder 51 for inserting the inner cylinder 52 inside the outer cylinder 51 to contract the telescopic body 41. Interlocked with the contracting operation, the closable restriction mechanism 44 is switched to restrict the turning of the rail arms 63 and 83 so that the slide shaft 107 contacts the head of the adjusting bolt 72 so as to restrict the rail arms 63 and 83 from turning downward about the through pin 45. As a result, the rail arms 63 and 83 remain in a state where they open like wings. Accordingly, the contact presser 75 is moved away from the side surface KS1 and the contact presser 97 is moved away from the side surface KS2 so that the block WK is released from the contact pressers 75 and 97.

Figure 6:
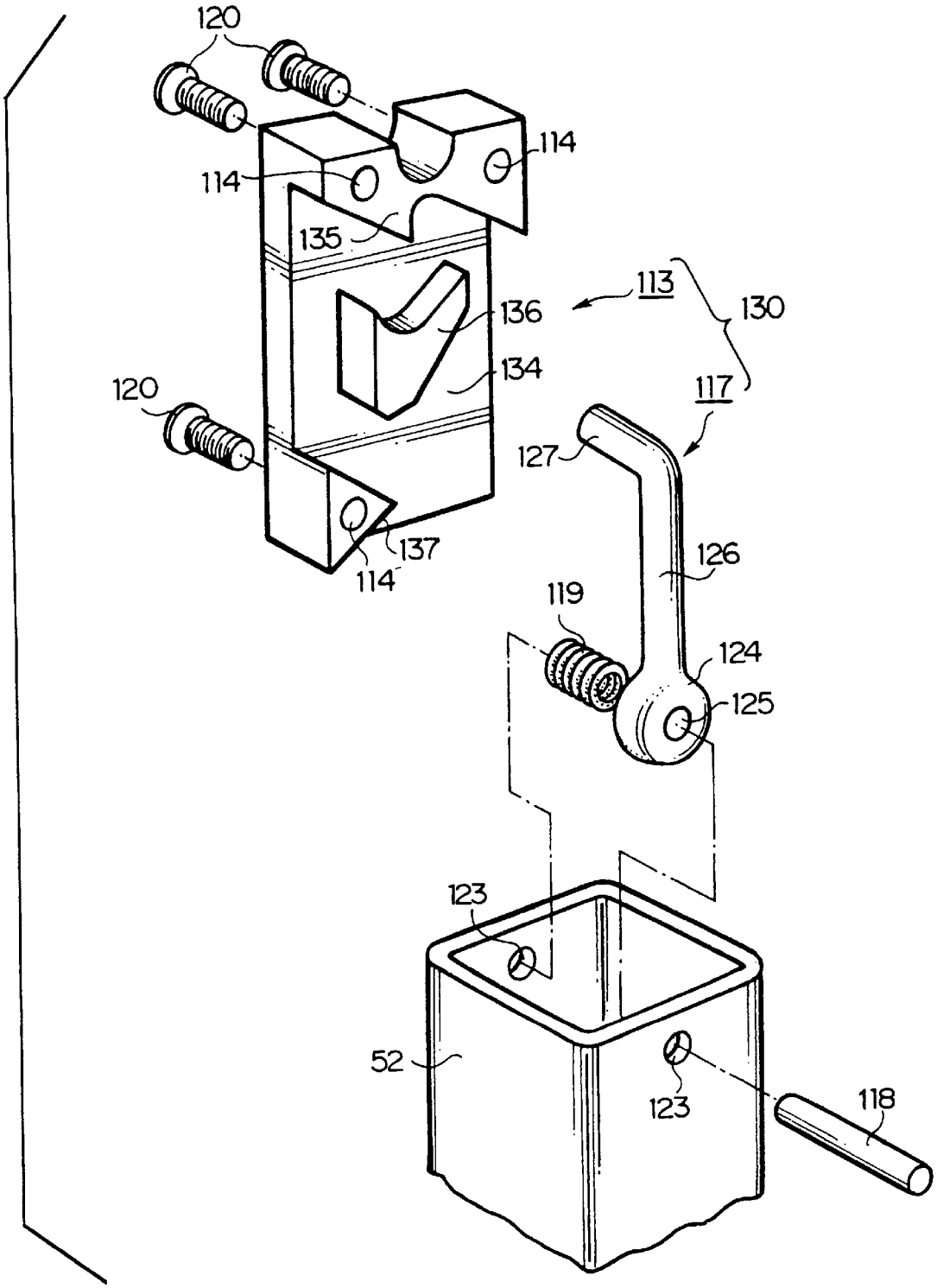

When the telescopic body 41 is contracted when inner cylinder 52 is inserted into the outer cylinder 51 after the outer cylinder 51 is lowered, the retaining position of the cam by the position stopping mechanism 130 inside the telescopic body 41 is changed so that the telescopic body 41 remains contracted. That is, the guiding claw 127 as shown in FIGS. 5 and 6 is moved relative to the cam plate 113, and the guiding claw 127 is retained by the bottom C of the upper circular cam surface 143 of the middle cam part 136 so that the telescopic body 41 is not further contracted, and hence the inner cylinder 52 can be pulled upward if the outer cylinder 51 is lifted. In such a manner, when the outer cylinder 51 is lowered, then the telescopic body 41 which was contracted is lifted again by the chain 57, the swing bodies 42 and 43 open like the wings of a butterfly so that the contact pressers 75 and 97 automatically release the side surfaces KS1 and KS2 of the block WK. When the hoisting and clamping apparatus 40 is lifted, the auxiliary swing body 230 turns downward about the set screw 236. However, the contact presser 239 merely contacts the rear end KSE, it is moved away from and lifted interlocked with the lifting operation of the hoisting and clamping apparatus 40. Since a series of operations are repeated, the block WK is automatically clamped and hoisted, and then moved to the intended spot where it can be automatically released.

According to the present invention, the telescopic body can be extended in length thereof in the longitudinal direction thereof, and it can be stopped at the position where it is extended at the maximum and at the position where it is contracted at the minimum. The closable restriction mechanism operates at these maximum and minimum positions to restrict the swing bodies extended to the right and left from turning downward about the turning shaft. Accordingly, it is possible to permit the swing bodies to remain opened by the closable restriction mechanism while the telescopic body is contracted. In this state, the telescopic body is approached to the heavy object so as to make the opened contact pressers be positioned close to both sides of the heavy object. When the telescopic body is lifted so as to be extended, the turning of the swing bodies downward by the closable restriction mechanism is released so that the right and left contact pressers are brought into contact with both sides of the heavy object and they can hoist the heavy object when the telescopic body is lifted. When the heavy object is lowered to contract the telescopic body, the closable restriction mechanism restricts the swing bodies from turning downward to permit the swing bodies to open to the right and left, thereby automatically releasing the retention between the contact pressers and the heavy object. It is possible to turn the hoisted heavy object horizontally by the turning driving body so as to adjust the position of the installing spot and the longitudinal direction of the heavy object.

Since this operation can be interlocked with the operation to suspend or hoist the telescopic body by the crane, it can dispense with an operator who sets or releases the retention between the hoisting and clamping apparatus and the heavy object at the position close to the hoisting apparatus such as suspending or hoisting the conventional heavy object, thereby saving time and labor. Since it is not necessary to arrange the operator at the position close to the heavy object where an accident is more likely to occur, danger can be prevented in advance. Further, a mechanism for clamping and releasing the heavy object by the extension and contraction of the telescopic body is simplified, which saves time and labor without requiring other power such as electric signals and hydraulic pressure.

According to the present invention, the swing bodies are coupled with the lower end of the telescopic body at the right and left thereof, and the auxiliary swing body is coupled with the side of the swing bodies so that one pair of swing bodies and the auxiliary swing body are arranged to form a T-shape horizontally. Since the contact pressers are provided at each outer end of each swing body, when the swing bodies are positioned over the heavy object, the contact pressers are brought into contact with the heavy object at three directions to grip and clamp the heavy object. Accordingly, in case of clamping and hoisting the heavy object such as a block with a displaced center of gravity, the clamped heavy object can be surely clamped and moved without turning the heavy object upside down.

Although a particular preferred embodiment of the invention has been disclosed in detail for illustrative purposes, it will be recognized that variations or modifications of the disclosed apparatus, including the rearrangement of parts, lie within the scope of the present invention.

What is claimed is:

1. A hoisting and clamping apparatus comprising:

a telescopic body which is positioned substantially perpendicularly to the ground, a first swing body which is positioned substantially in a horizontal direction, and a second swing body which is positioned substantially in a horizontal direction;

a lower end of the telescopic body, a tip end of the first swing body and a tip end of the second swing body are coupled with one another to be freely turnable about a turning shaft to form an inverted T-shape;

contact pressers respectively provided at a lower surface of the first and second swing bodies, wherein the contact pressers are brought into contact with a heavy object at opposite sides thereof, and wherein the swing bodies as coupled to the lower end of the telescopic body are disposed in substantially a C-shape so as to bring the contact pressers into contact with the opposite sides of the heavy object for clamping and hoisting the heavy object;

the telescopic body is extendible or contractible in a longitudinal direction thereof and can be locked in either an extended position or a contracted position;

a closable restriction mechanism provided at one of the swing bodies for restricting the swing bodies from turning downward about the turning shaft; and the closable restriction mechanism is interlocked and synchronized with telescopic operation of the telescopic body to alternately restrict the closing or opening operation by the swing bodies so as to alternately clamp or release the heavy object.

2. An apparatus according to claim 1, wherein:

the telescopic body comprises an upper telescopic body member and a lower telescopic body member, the tip ends of the swing bodies are coupled to a lower end of the lower telescopic body member by the turning shaft, and the upper telescopic body member is assembled with the lower telescopic body member to be slidable in a longitudinal direction thereof;

the upper telescopic body member has a slide guiding member which is fixed thereto and has a cam surface, the lower telescopic body member has a contact moving member which is movable along the cam surface of the slide guiding member, said slide guiding member and the contact moving member forming a position stopping mechanism; and the telescopic body being alternately stopped by the position stopping mechanism at a position where the telescopic body becomes the shortest or a position where the telescopic body becomes the longest in length when the upper and lower telescopic body members are extended or contracted.

3. An apparatus according to claim 2, wherein:

said slide guiding member is formed of a flat plate shape and has an upper cam part at an upper side portion thereof and a middle cam part at a slightly central side portion thereof;

the upper cam part has a lower circular arc cam surface and a lower linear cam surface which are directed downward, said lower circular arc cam surface and said lower linear cam surface form a continuous saw-tooth shape, and a jointing point between the lower circular arc cam surface and the lower circular cam surface positioned substantially at a central portion of the slide guiding member and protruding downward;

the middle cam part is formed of an island shape having an outer peripheral cam surface having an upper circular cam surface at a part thereof and which curves downward, and a lower linear cam surface at a lower part thereof, said lower linear cam surface being inclined toward the lower circular arc cam surface, and the lowest position of the upper circular cam surface is displaced sidewardly toward the lower linear cam surface of the upper cam part from said jointing point;

the contact moving member is formed as a swinging claw swingably attached to the lower telescopic body member adjacent a base end thereof, and an upper end of the swinging claw has a guiding claw which is bent perpendicularly like a hook, and the guiding claw contacting the cam surface of the slide guiding member;

the guiding claw contacts the lower circular arc cam surface when the upper and lower telescopic body members perform a contracting operation, and contacts the upper circular cam surface to stop further extension between the upper and lower telescopic body members when the upper and lower telescopic body members perform an extending operation, then the guiding claw contacts the lower linear cam surface to move along the inclination thereof so that it is displaced to a position where it comes off from a vertical position of the middle cam part when the upper and lower telescopic body members perform the contracting operation, and the guiding claw moves downward from the middle cam part when the upper and lower telescopic body members perform an extending operation, then the guiding claw contacts the lower linear cam surface of the middle cam part to move so as to be guided along the lower circular cam surface when the upper and lower telescopic body members perform the contracting operation, so that the telescopic body can be temporarily stopped at a position where the telescopic body is extended at the longest length or contracted at the shortest length during a cycle of the cam when the upper and lower telescopic body members perform the telescopic operation.

4. An apparatus according to claim 1, wherein:

a lateral slide body is provided at one of the swing bodies, said lateral slide body being interlocked with telescopic operation of the telescopic body to slide perpendicularly in a longitudinal direction of one of the swing bodies;

an opening adjusting part provided at the other of the swing bodies, said opening adjusting part contacting the lateral slide body depending on the position of the lateral slide body, and restricting the lateral slide body from turning about the turning shaft;

whereby the lateral slide body is moved perpendicularly in a longitudinal direction of the swing body in synchronization with the telescopic operation of the telescopic body so that the opening adjusting part contacts the moved lateral slide body, thereby restricting the swing bodies from turning downward about the turning shaft.

5. An apparatus according to claim 4, wherein:

the telescopic body comprises an upper telescopic body member and a lower telescopic body member, the tip ends of the swing bodies are coupled to a lower end of the lower telescopic body member by the turning shaft, and the upper telescopic body member is assembled with the lower telescopic body member to be slidable in a longitudinal direction thereof; and the upper telescopic body member has a slide guiding member fixed thereto, said slide guiding member having a cam surface, the lower telescopic body member has a contact moving body which is movable along the cam surface of the slide guiding member, said slide guiding member and contact moving body forming a position stopping mechanism.

6. An apparatus according to claim 1, wherein:

the closable restriction mechanism comprises a thrust operation body provided at the telescopic body and a lateral slide body provided at one of the swing bodies;

the thrust operation body is fixed to a lower portion of an upper telescopic body member of the telescopic body and comprises a pair of aslant sidewardly-spaced rails which are arranged in a direction aslant relative to the telescopic operation of the telescopic body;

the lateral slide body comprises a sliding shaft which is retained by said one swing body to be slidable perpendicularly to a longitudinal direction thereof, and a retaining claw which is fixed to the sliding shaft and engaged at a tip end thereof between the pair of aslant rails; and the retaining claw which is engaged between the pair of aslant rails is pushed perpendicularly to the longitudinal direction of the swing body when the upper telescopic body member extends or contracts so that the retaining claw moves the sliding shaft toward or away from the other swing body, and wherein the swing bodies are restricted from swinging downward when the sliding shaft contacts the other swing body, and the swing bodies are not restricted from swinging downward when the sliding shaft does not contact the other swing body.

7. An apparatus according to claim 1, wherein:

the telescopic body comprises an inner cylinder which at a lower end thereof is coupled with the tip ends of the swing bodies by the turning shaft, and an outer cylinder which is slidable relative to the inner cylinder in the longitudinal direction thereof;

long slots are defined in both sides of the inner cylinder in the longitudinal direction thereof, and the inner and outer cylinders are coupled with each other so as to be freely extended or contracted in the longitudinal direction by a coupling pin fixed to a lower portion of the outer cylinder and inserted into the long slots;

a swinging claw having a guiding claw at a tip end thereof which is bent in a hook shape, said swinging claw being supported by the inner cylinder at an upper portion thereof so as to be turnable and protruding upward therefrom; and the outer cylinder has a flat cam plate fixed to an upper inner surface thereof, said cam plate having a cam surface with which the guiding claw contacts.

8. An apparatus according to claim 1, wherein:

the swing body comprises a long arm body, and a slide body which is inserted onto the arm body so as to move in the longitudinal direction thereof;

a long bolt directed in the longitudinal direction of the arm and having a screw on the outer surface thereof;

the slide body has an insertion hole through which the long bolt is inserted, and a contact presser fixed to the low surface thereof; and the slide body is inserted onto the arm body and the long bolt is inserted into the insertion hole at the same time so that the slide body is clamped by a nut which screws onto the long bolt to fix the slide body to the arm body, thereby adjusting the position of the contact presser.

9. An apparatus according to claim 1, wherein:

a closing adjusting part is fixed to one swing body, and the swing bodies are restricted from turning downward about the turning shaft at an angle exceeding a predetermined angle when the closing adjusting part contacts the other swing body.

10. A hoisting and clamping apparatus comprising:

a telescopic body which is positioned substantially perpendicularly relative to the ground, a first swing body which is coupled with a lower end of the telescopic body to be turned freely and is directed horizontally, and a second swing body which is coupled with a lower end of the telescopic body to be turned freely and is directed horizontally;

a downwardly directed first contact presser provided at a portion close to a rear end of the first swing body, and a downwardly directed second contact presser provided at a portion close to a rear end of the second swing body;

a turning driving body which is suspended by a crane and coupled with an upper end of the telescopic body; and the telescopic body and the swing bodies are structured to form an inverted T-shape as viewed from a side thereof, the contact pressers provided at the swing bodies are brought into contact with opposite sides of a heavy object, the swing bodies coupled with the telescopic body are lifted upward in a substantially C-shape while the telescopic body is pulled up so as to bring the contact pressers into contact with the heavy object at opposite sides thereof so that the heavy object is clamped and hoisted, and the telescopic body and the pair of swing bodies and the heavy object are turned in a horizontal direction by the turning driving body.

11. An apparatus according to claim 10, wherein:

a closable restriction mechanism operates while interlocking with the telescopic operation of the telescopic body for restricting the swing bodies from turning downward; and the closable restriction mechanism is interlocked with the telescopic operation of the telescopic body to alternately restrict the closing and opening operation of the first and second swing bodies, the restriction of the closing and opening operation by the closable restriction mechanism is released when the lower surfaces of the swing bodies contact the upper surface of the heavy object.

12. An apparatus according to claim 10, wherein:

an auxiliary swing body is coupled with one of the first and second swing bodies at the tip end thereof, and a downwardly directed contact presser is provided at a portion close to a rear end of the auxiliary swing body;

whereby the swing bodies engage the heavy object at three positions thereof.

13. An apparatus according to claim 10, wherein:

the turning driving body comprises a suspension shaft which is suspended by a crane at an upper end thereof, a base table coupled with the suspension shaft at the midway portion thereof, a turning cap retained by the lower end of the suspension shaft to be freely turned for coupling to the telescopic body, a motor mounted on the base table for turning an output shaft thereof when power is on, and a belt extended between the output shaft of the motor and the turning cap for transmitting a driving torque of the motor.

14. A hoisting and clamping apparatus comprising:

a telescopic body which is positioned substantially perpendicularly relative to the ground, a first swing body which is coupled with a lower end of the telescopic body to be turned freely and is directed horizontally, a second swing body which is coupled with a lower end of the telescopic body to be turned freely and is directed horizontally, a downwardly directed contacting claw provided at a portion close to a rear end of the first swing body, another downwardly directed contacting claw provided at a portion close to a rear end of the second swing body, an auxiliary swing body which is coupled at the tip end thereof with one of the first and second swing bodies, and a turning driving body which is suspended by a crane and coupled at a lower portion thereof with an upper end of the telescopic body; and the telescopic body and the first and second swing bodies are coupled with one another to form an inverted T-shape as viewed from a side thereof to be turned freely, the pair of swing bodies and the auxiliary swing body are coupled with one another to form a T-shape as viewed from above, the pair of contacting claws provided at the first and second swing bodies are brought into contact with opposite sides of a heavy object, and the contacting claw provided at the auxiliary swing body is brought into contact with a rear side of the heavy object, then the swing bodies are lifted upward in substantially C-shape so as to bring the contact claws into engagement with the heavy object so that the heavy object is lifted, and the telescopic body and the heavy object engaged by the swing bodies can be turned in a horizontal direction by the turning driving body.

15. An apparatus according to claim 14, wherein:

the turning driving body comprises a suspension shaft which is suspended by a crane at an upper end thereof, a base table coupled with the suspension shaft at the midway portion thereof, a turning cap retained by the lower end of the suspension shaft to be freely turned for coupling to the telescopic body, a motor mounted on the base table for turning an output shaft thereof when power is on, and a belt extended between the output shaft of the motor and the turning cap for transmitting a driving torque of the motor.

* * * * *